US007045693B2

(12) United States Patent
Rose et al.

(10) Patent No.: US 7,045,693 B2
(45) Date of Patent: May 16, 2006

(54) TUNING SYSTEMS FOR STRINGED MUSICAL INSTRUMENTS

(75) Inventors: Floyd D. Rose, 6427 Lake Washington Blvd., NE., Kirkland, WA (US) 98033; John Thomas Riboloff, Redmond, WA (US)

(73) Assignee: Floyd D. Rose, Kirkland, WA (US)

( * ) Notice: Subject to any disclaimer, the term of this patent is extended or adjusted under 35 U.S.C. 154(b) by 123 days.

(21) Appl. No.: 10/341,219

(22) Filed: Jan. 13, 2003

(65) Prior Publication Data

US 2003/0177883 A1 Sep. 25, 2003

Related U.S. Application Data

(60) Provisional application No. 60/347,534, filed on Jan. 11, 2002.

(51) Int. Cl.
*B10D 3/01* (2006.01)

(52) U.S. Cl. ..... 84/298

(58) Field of Classification Search ..... 84/298, 84/299, 300, 301, 302, 290, 267, 313
See application file for complete search history.

(56) References Cited

U.S. PATENT DOCUMENTS

| | | | |
|---|---|---|---|
| 1,475,345 | A | 11/1923 | Lambert et al. |
| 2,191,776 | A | 2/1940 | Schreiber |
| 2,976,755 | A | 3/1961 | Fender |
| 3,313,196 | A | 4/1967 | Mari |
| 3,407,696 | A | 10/1968 | Smith et al. |
| 3,599,524 | A | 8/1971 | Jones |
| 3,678,795 | A | 7/1972 | Fullerton |
| 3,763,736 | A | 10/1973 | Williams |
| 3,911,777 | A | 10/1975 | Rendell |
| 3,911,778 | A | 10/1975 | Martin |
| 3,915,049 | A | 10/1975 | Bean |
| 4,027,570 | A | 6/1977 | Rendell et al. |
| 4,037,506 | A | 7/1977 | How |
| 4,111,093 | A | 9/1978 | Field et al. |
| 4,135,426 | A | 1/1979 | Rickard |
| 4,142,435 | A | 3/1979 | Pozar |
| 4,171,661 | A | 10/1979 | Rose |
| 4,201,108 | A | 5/1980 | Bunker |
| 4,206,679 | A | 6/1980 | Wilson |
| 4,208,941 | A | 6/1980 | Wechter |
| 4,241,637 | A | 12/1980 | Brent |
| 4,283,982 | A | 8/1981 | Armstrong |
| 4,304,163 | A | 12/1981 | Siminoff |
| 4,348,934 | A | 9/1982 | Ogata |
| 4,366,740 | A | 1/1983 | Tripp |
| 4,377,101 | A | 3/1983 | Santucci |
| 4,389,917 | A | 6/1983 | Tiebout, III |
| 4,425,831 | A | 1/1984 | Lipman |
| 4,433,603 | A | 2/1984 | Siminoff |

(Continued)

*Primary Examiner*—Kimberly Lockett
(74) *Attorney, Agent, or Firm*—Lerner, David, Littenberg, Krumholz & Mentlik, LLP

(57) ABSTRACT

Various tuning and bridge systems for stringed musical instruments are disclosed for facilitating release of the tension on the strings to enable disassembly and removal of the strings from the instrument. In embodiments for release of the strings from individual string holders, the string holders are mounted for pivotable movement, and a latch is provided for holding the string holder against rotation in one direction, the latch being moveable to a release position to permit free rotation to release the string. In embodiments for release of tension on all the strings, a bridge latch is provided for latching the bridge base to the instrument so that the strings are placed under tension to permit play, the bridge latch being moveable to a release position to permit movement of the bridge base to release the tension on all the strings.

164 Claims, 44 Drawing Sheets

U.S. PATENT DOCUMENTS 4,457,201 A 7/1984 Storey
4,462,295 A 7/1984 Hundley
4,472,994 A 9/1984 Armstrong
4,475,432 A 10/1984 Stroh
4,497,236 A 2/1985 Rose
4,522,101 A 6/1985 Peavey et al.
4,549,461 A 10/1985 Rose
4,555,970 A 12/1985 Rose
4,573,391 A 3/1986 White
4,608,904 A 9/1986 Steinberger
4,608,906 A 9/1986 Takabayashi
4,632,005 A 12/1986 Steinberger
4,638,708 A 1/1987 Kamal
4,638,711 A 1/1987 Stroh
4,648,304 A 3/1987 Hoshino et al.
4,656,915 A 4/1987 Osuga
4,672,877 A * 6/1987 Hoshino et al. ..... 84/299
4,674,389 A 6/1987 Fender
4,677,891 A 7/1987 Gressett, Jr. et al.
4,681,011 A 7/1987 Hoshino, deceased
4,690,027 A 9/1987 Ido
4,696,218 A 9/1987 Hoshino et al.
4,712,463 A 12/1987 Kubicki et al.
4,724,737 A 2/1988 Fender
4,768,415 A 9/1988 Gressett, Jr. et al.
4,779,506 A 10/1988 Takeuti
4,793,236 A 12/1988 McGuire et al.
4,803,906 A 2/1989 Fender
4,840,102 A 6/1989 Pittman
4,854,210 A 8/1989 Palazzolo
4,882,967 A 11/1989 Rose
4,905,563 A 3/1990 Davies
4,939,970 A 7/1990 Hoshino et al.
4,945,801 A 8/1990 Stroh et al.
4,967,631 A 11/1990 Rose
4,982,640 A 1/1991 Buscarino
5,012,716 A 5/1991 Pagelli
5,014,588 A 5/1991 Omata et al.
5,033,353 A 7/1991 Fala et al.
5,052,269 A 10/1991 Young, Jr.
5,072,646 A 12/1991 Valkama
D324,693 S 3/1992 Rose
5,097,737 A 3/1992 Uhrig
5,123,326 A 6/1992 Clevinger
5,125,311 A 6/1992 Boulanger et al.
5,136,918 A 8/1992 Riboloff
5,140,884 A 8/1992 Bowden
5,171,927 A 12/1992 Kubicki et al.
5,191,159 A 3/1993 Jordan
5,198,601 A 3/1993 McCabe
5,227,571 A 7/1993 Cipriani
5,265,512 A 11/1993 Kubicki et al.
5,277,095 A 1/1994 Steinberger
5,295,427 A 3/1994 Johnsen et al.
5,337,643 A 8/1994 Cantrell
5,343,793 A 9/1994 Pattie
5,347,904 A 9/1994 Lawrence
5,347,905 A 9/1994 Cipriani
5,353,672 A 10/1994 Stewart
5,355,759 A 10/1994 Hoshino
5,361,667 A 11/1994 Pritchard
5,372,057 A 12/1994 Hart
5,390,578 A 2/1995 Raymer
5,398,581 A 3/1995 Castillo
5,410,936 A 5/1995 Ellsworth et al.
5,413,019 A 5/1995 Blanda, Jr.
5,421,233 A 6/1995 Bunker
5,431,079 A 7/1995 Bunker
5,438,901 A 8/1995 Sperzel
5,452,637 A 9/1995 DeCola
5,458,035 A 10/1995 Okamura
5,477,764 A 12/1995 Carrico
5,519,165 A 5/1996 Gregory
5,522,299 A 6/1996 Rose
5,537,907 A 7/1996 Rose
5,539,143 A 7/1996 Rose
5,549,027 A 8/1996 Steinberger et al.
5,567,903 A 10/1996 Coopersmith et al.
5,589,653 A 12/1996 Rose
5,600,078 A 2/1997 Edwards
5,614,688 A 3/1997 Donnell
5,631,432 A 5/1997 Muncy
5,637,818 A 6/1997 Fishman et al.
5,637,823 A 6/1997 Dodge
5,661,252 A 8/1997 Krawczak
5,672,835 A 9/1997 Doughty
5,679,910 A 10/1997 Steinberger et al.
5,684,256 A 11/1997 Rose
5,689,075 A 11/1997 Rose
5,696,335 A 12/1997 Rose
5,700,965 A 12/1997 Rose
5,705,760 A 1/1998 Rose
5,717,150 A 2/1998 Rose
5,739,444 A 4/1998 Borisoff
5,945,615 A 8/1999 Rose
6,046,393 A 4/2000 Rose
6,046,397 A 4/2000 Rose
6,051,773 A 4/2000 Rose
6,111,176 A 8/2000 Rose
6,137,039 A 10/2000 Rose
6,194,645 B1 2/2001 Rose
6,198,030 B1 3/2001 Rose

* cited by examiner

TUNING SYSTEMS FOR STRINGED MUSICAL INSTRUMENTS

CROSS-REFERENCE TO RELATED APPLICATIONS

The present application claims the benefit of U.S. provisional application No. 60/347,534 filed Jan. 11, 2002, which is incorporated herein by reference.

BACKGROUND OF THE INVENTION

The present invention relates to stringed musical instruments, such as guitars, and various components thereof. More particularly, the present invention relates to tuning systems for stringed musical instruments, and in particular tuning systems for musical instruments having strings which include an anchor at one or both ends thereof. The present invention also relates to bridge systems for stringed musical instruments.

Conventional guitars, and other stringed musical instruments, include strings placed under tension which extend along and above a fretboard mounted on the neck of the instrument. In order to produce sounds associated with musical notes, the strings are placed in contact with two critical contact points or surfaces. The first critical contact surface is generally at the nut of the instrument, which in the case of a guitar is usually arranged on the neck adjacent to the first fret of the fretboard. The second critical contact surface is generally provided on or at the bridge of the instrument, which typically is provided on the instrument body beyond an opposing end of the fretboard. The strings are generally fixed to the instrument at a distance beyond the critical contact surfaces at the nut and the bridge.

As is known to those skilled in the stringed musical instrument art, the sound produced by the strings is affected by the harmonic length (i.e. the distance between where the strings contact the critical contact surfaces at the nut and the bridge). Harmonic tuning of the strings is accomplished by adjusting the distance between the critical contact points or surfaces at the bridge and nut on the stringed musical instrument.

The tension of the strings is a second factor which significantly affects the tones generated by the strings during play. String tension may be adjusted by tightening or loosening the strings at the nut or bridge end of the guitar or other musical instrument. Adjustment of the tension in the strings affects the pitch thereof, and thus, such adjustment is commonly known as pitch tuning.

Inventors have made efforts over the years, to improve the mounted arrangement of strings with respect to the nut and bridge critical contact surfaces. For instance, in recent years, Floyd Rose, who is one of the inventors of the present invention, developed string assemblies which include a string having bullet-shaped anchors secured at both ends thereof. That system is disclosed in U.S. Pat. No. 5,717,150, the disclosure of which is hereby incorporated by reference. The '150 patent also discloses a guitar having a nut assembly and a bridge assembly, wherein a bullet-shaped anchor at one end of each string is secured in a string holder of the nut assembly, and wherein a bullet-shaped anchor at the other end of each string is secured in a corresponding saddle or string holder of the bridge assembly. The guitar and associated strings disclosed in the '150 patent represent substantial improvements over the previous state of the prior art, but there is room for still further improvements in tuning systems for use with musical instruments having strings which include an anchor at one or both. ends thereof, such as the bullet-shaped anchors disclosed in the '150 patent.

As is known, the structure of the string retention components of stringed musical instruments can make replacement of the strings a difficult process. It can also make tuning the instrument a difficult and time-consuming process. The problems associated with replacing strings and tuning are related, since a stringed musical instrument generally needs to be retuned whenever a string is replaced.

One of the more popular stringed musical instruments is the guitar. Guitars having traditional tuning pegs suffer from these types of shortcomings. Such shortcomings have been addressed, in part, by development of new strings and new bridge assemblies that achieve convergent tuning, wherein proper pitch tuning and proper harmonic tuning are substantially simultaneously achieved. One such system is disclosed in the aforementioned U.S. Pat. No. 5,717,150 by Floyd D. Rose. In accordance with the disclosure in the '150 patent, the strings of the instrument are precut, and have bullets at both ends of the strings. The bullets at the ends of the strings are held in place in a predetermined fashion by the nut and bridge assemblies on the guitar.

While the guitar and associated strings disclosed in the '150 patent represent substantial improvements over the previous state of the art, existing string retention components used in the nut and bridge assemblies thereof have not resulted in an efficient, easy to use string replacement procedure. Therefore, new tuning systems having new string retention components are desired to allow for the quick, simple and efficient release and replacement of the strings on a stringed instrument, while still providing an efficient apparatus for tuning of the strings on the instrument. In particular, a need still exists for systems to allow for rapid and efficient release of the strings. on the stringed musical instrument and replacement thereof in a simple and efficient manner, and also one which allows for quick and simple retuning of the stringed musical instrument whenever a string or strings are replaced.

SUMMARY OF THE INVENTION

The present invention overcomes the shortcomings of the prior art by providing tuning and bridge systems which facilitate the rapid replacement of strings and retuning of the instrument. Various tuning systems and mechanisms are disclosed for enabling rapid release of the tension on the strings to enable disassembly and removal of the strings from the string retention components, including systems and mechanisms for release of the string tension for individual stings, as well as systems and mechanisms for release of the tension on all of the strings secured to the bridge assembly, and to even permit removal of the bridge assembly from the instrument. In addition, the present invention provides improved tuning apparatus for providing quick, easy and efficient tuning of the strings, including tuning apparatus for quick, easy and efficient convergent tuning of the strings, i.e. substantially simultaneous harmonic and pitch tuning.

In accordance with one aspect of the present invention, there is provided a removable bridge assembly for a stringed musical instrument having an instrument body and at least one string. The bridge assembly comprises a bridge base carrying at least one string holder for securing an end of a string of the musical instrument, and a support mechanism which is mountable to the instrument body and which has a bridge engagement portion which is releasably mateable with the bridge base to mount the bridge base on the instrument body in a position to place the string secured in the at least one string holder under tension. A latch mechanism is carried by either the bridge base or the body of the musical instrument, and is releasably engageable with the other of the instrument body and the bridge base. The latch mechanism is positionable in a latching position and a release position. The latch mechanism, when in the latching position, secures the bridge base in mating engagement with the bridge engagement portion of the bridge support mechanism so that the string secured by the at least one string holder is under tension on the instrument body to permit play of the instrument. The latch mechanism, when in the release position, permits movement of the bridge base relative to the support mechanism to release the tension on the string secured in the at least one string holder, and to thereby permit the disengagement of the bridge base from the bridge engagement portion.

In accordance with one embodiment of this aspect of the present invention, a plurality of string holders are carried by the bridge base for securing an end of a plurality of strings. Also, when the latch mechanism is in the release position, the bridge base is adapted to pivot or move toward the nut of the instrument to release the tension on the strings secured in the string holders, which in turn allows the bridge base to be disengaged from the bridge engagement portion of the support mechanism and removed from the instrument, to allow easy and rapid replacement of the strings held by the plurality of string holders.

In accordance with a further embodiment of this aspect of the present invention, the bridge support mechanism comprises a pair of mounting posts which are adapted to be secured to the instrument body and which the bridge base may matingly engage and pivot about upon release of the latch mechanism, so as to release the tension of the strings secured in the string holders. Still further, in accordance with a preferred arrangement, the latch mechanism comprises a pivotably supported, threaded latch member mounted to the instrument body and having a latch head engageable with a rear latching portion at the rear portion of the bridge base. Preferably the bridge base is mounted with respect to the mounting posts so as to pivot or rock thereabout along a front edge of the bridge base, with the latch head when engaged with the rear latching portion of the bridge base serving to prevent pivoting movement of the bridge base in a direction to release the tension on the strings. Preferably, the position of the head of the latch member may be adjusted to adjust the orientation of the bridge base on the instrument body. By pressing of the bridge downwardly, in a manner to increase the tension on the strings. held thereby, the latch member may be pivoted out of the way and the bridge base then released to pivot upwardly to release the tension on all of the strings.

In accordance with another aspect of the present invention, there is provided a bridge assembly for a stringed musical instrument having at least one string and an instrument body. The bridge assembly includes a bridge base for supporting at least one string holder for holding one end of a string of the musical instrument, and at least one anchor member attached to the body of the stringed musical instrument. A releasable latch mechanism is provided which is attached to either the bridge base or the anchor member, and which is arranged and operative to engage the other component, i.e. the anchor member or the bridge base, to secure the bridge base in a position on the instrument body so that the string held by the at least one string holder is placed under tension. The latch mechanism is operative to be moveable to a release position to permit movement of the bridge base relative to the instrument body to release the tension on the string held by the at least one string holder.

In accordance with one embodiment of this aspect of the present invention, a single anchor member is all that is required to secure the bridge assembly to the stringed musical instrument. When the latch mechanism is moved to the release position, and the tension on the string held by the string holder is released, the latch mechanism may be disengaged from the bridge base (or from the anchor member if the latch mechanism is attached to the bridge base itself) to allow the bridge base to be removed from the instrument. In this manner, the string held in the string holder supported on the bridge base may be easily and rapidly replaced, and the bridge base then repositioned on the instrument and the latch mechanism attached and moved into position to secure the bridge base to the instrument body to tension the string.

In accordance with a further aspect of the present invention, there is provided a string tuning apparatus for a stringed musical instrument having a plurality of strings, in which the strings make a first critical contact with the instrument on the nut of the instrument and a second critical contact on the bridge of the instrument. The string tuning apparatus includes a bridge base having a support surface, and a plurality of string holders for the plurality of strings of the musical instrument. Each of the string holders is operative to hold one end of a string and is supported on the bridge base for movement in a direction toward or away from the nut of the musical instrument. Each of the string holders also includes an extension member or leg extending below the support surface of the bridge base. A tuning mechanism is also provided for each of the string holders for adjusting the tension of the string held thereby. Each such tuning mechanism is carried by the bridge base and comprises a riser block operatively arranged to be slideably engageable with the extension leg of its associated string holder so that sliding movement of the riser block relative to the extension leg causes the extension leg to move the string holder in a direction toward or away from the nut of the musical instrument to adjust the tension of the string held thereby. Each tuning mechanism also includes an adjustment device for causing the riser block to move relative to the extension leg.

In accordance with a still further aspect of the present invention, there is provided a tuning apparatus for a stringed musical instrument having a plurality of strings, in which each of the strings of the musical instrument makes a first critical contact with the instrument at the nut of the instrument and a second critical contact at the bridge of the instrument. The tuning apparatus comprises a bridge base and a plurality of string holders for the plurality of strings of the musical instrument, each of the string holders being operative to hold one end of a string and being supported on the bridge base for movement in a direction toward or away from the nut of the musical instrument. The string holders also include an extension member or leg. A tuning mechanism is provided for each of the string holders for adjusting the tension of the string held thereby. Each tuning mechanism comprises a longitudinally extending threaded rod carried by the bridge base, and supported for rotation at first and second spaced support positions on the bridge base. Each tuning mechanism also includes a riser block which threadably engages its associated threaded rod between the first and second spaced support positions. Each riser block is operatively arranged to be slideably engageable with the extension leg of the associated string holder as the threaded rod is rotated, so that movement of the riser block relative to the extension leg causes the extension leg to move the string holder in a direction toward or away from the nut of the musical instrument to thereby adjust the tension of the string held by the string holder.

In accordance with a preferred embodiment of this aspect of the tuning apparatus of the present invention, the bridge base includes a support wall arranged to support each of the riser blocks for sliding movement therealong in response to rotation of the threaded rods. The riser block of each string holder is arranged so that the riser block is positioned between the support wall and its associated extension leg, and is operative to slide along the support wall and the extension leg in response to rotation of its associated threaded rod. Such an arrangement is particularly advantageous in assuring for a smooth adjustment of the position of the extension leg, and thus of the string holder, in order to adjust the tension of the respective strings. In this regard, such an arrangement is particularly advantageous in providing for convergent tuning of the strings, since adjustment of the position of the string holder, and thus the tension of the string, serves not only to accomplish harmonic tuning of the strings (by virtue of the movement of the critical contact for the string on the bridge base), but also to accomplish pitch or tension tuning of the string.

In accordance with a still further aspect of the present invention, there is provided a tuning apparatus for a stringed musical instrument having a plurality of strings and which includes a bridge base and a plurality of string retention members for the plurality of strings. Each of the string retention members is operative to hold one end of a string, and is mounted on the bridge base for rotation about a transverse axis which extends transversely to the longitudinal extent of the string held thereby. A string tensioning mechanism for each of the string retention members is provided which is operative to move the associated string retention member to adjust the tension of the string held thereby. Each of the string tensioning mechanisms includes a latching mechanism which is operative to hold the associated string retention member against rotation in a first direction about the transverse axis as a result of tension on the string held thereby, but is also operative to release holding the string retention member so as to permit free rotation of the string retention member in the first direction. In this manner, each latching mechanism serves to quickly release the tension on the string and its associated string retention member to allow rapid and easy replacement of the strings individually as may be desired. At the same time, adjustment of the tension, and thus the tuning of the strings, is easily accomplished with the string tensioning mechanism.

In accordance with one embodiment of this aspect of the present invention, the string tensioning mechanisms each comprise an adjustment member carried by the bridge base which is supported by the bridge base for movement relative thereto and which is operative to cause the string retention member to move to adjust the tension of the string held thereby.

In a preferred embodiment of this aspect of the present invention, the adjustment member adjusts the rotational position of the string retention member to adjust the tension of the string held thereby. Also, the latching mechanism comprises a pivotable support member pivotably supported by the bridge base so as to be pivotable between a latching position and a release position. The adjustment member is supported by the pivotable support member for movement relative thereto, and is arranged so that an engagement portion of the adjustment member is in engagement with the string retention member when the pivotable support member is in the latching position, but is removed from engagement with the string retention member when the pivotable support member is in the release position. Thus, in accordance with this aspect of the present invention, the elongated adjustment member may simply be pivoted out of engagement with the string retention member, and the string retention member may then be freely pivoted in the first direction to release the tension on the string held thereby, and thus permit removal of the string from the string retention member.

In accordance with a still further embodiment of this aspect of the present invention, there is provided a saddle base member for each of the string retention members which is mounted for movement on the bridge base, with each of the string retention members being mounted on its respective saddle base member for rotational movement about the transverse axis. Each string tensioning mechanism is operative to cause movement of the saddle base member to adjust the tension of the string held by the string retention member. Each latch member may advantageously be carried by the saddle base member and be operative to move between a latching position in which the string retention member is held by the latch mechanism in a fixed position relative to the saddle base member, and a release position in which the string retention member is free to rotate relative to the base member.

In accordance with a preferred embodiment of this aspect of the present invention, each of the string tensioning mechanisms may comprise an adjustment member rotatably supported on the bridge base and operatively arranged to engage the saddle base member to move the saddle base member in response to rotation of the adjustment member. In this regard, the saddle base member may include an extension leg, and the adjustment member may be arranged to engage the extension leg to cause movement of the saddle base member. Alternatively, the latch member may be mounted for sliding movement relative to the saddle base member, and the adjustment member may be moveably supported on the bridge base and arranged to engage the slidable latch member to cause rotation of the saddle base member in response to movement of the adjustment member to adjust the tension of the string held thereby.

The above features and advantages of the present invention will be more fully described and understood with reference to the following detailed description of the preferred embodiments of the present invention, when considered in conjunction with the accompanying drawings.

BRIEF DESCRIPTION OF THE DRAWINGS

FIG. 48 is a rear perspective view of the bridge assembly of FIG. 45, showing one of the string retention components in a released position.

DETAILED DESCRIPTION OF THE PREFERRED EMBODIMENTS

Figure 1:
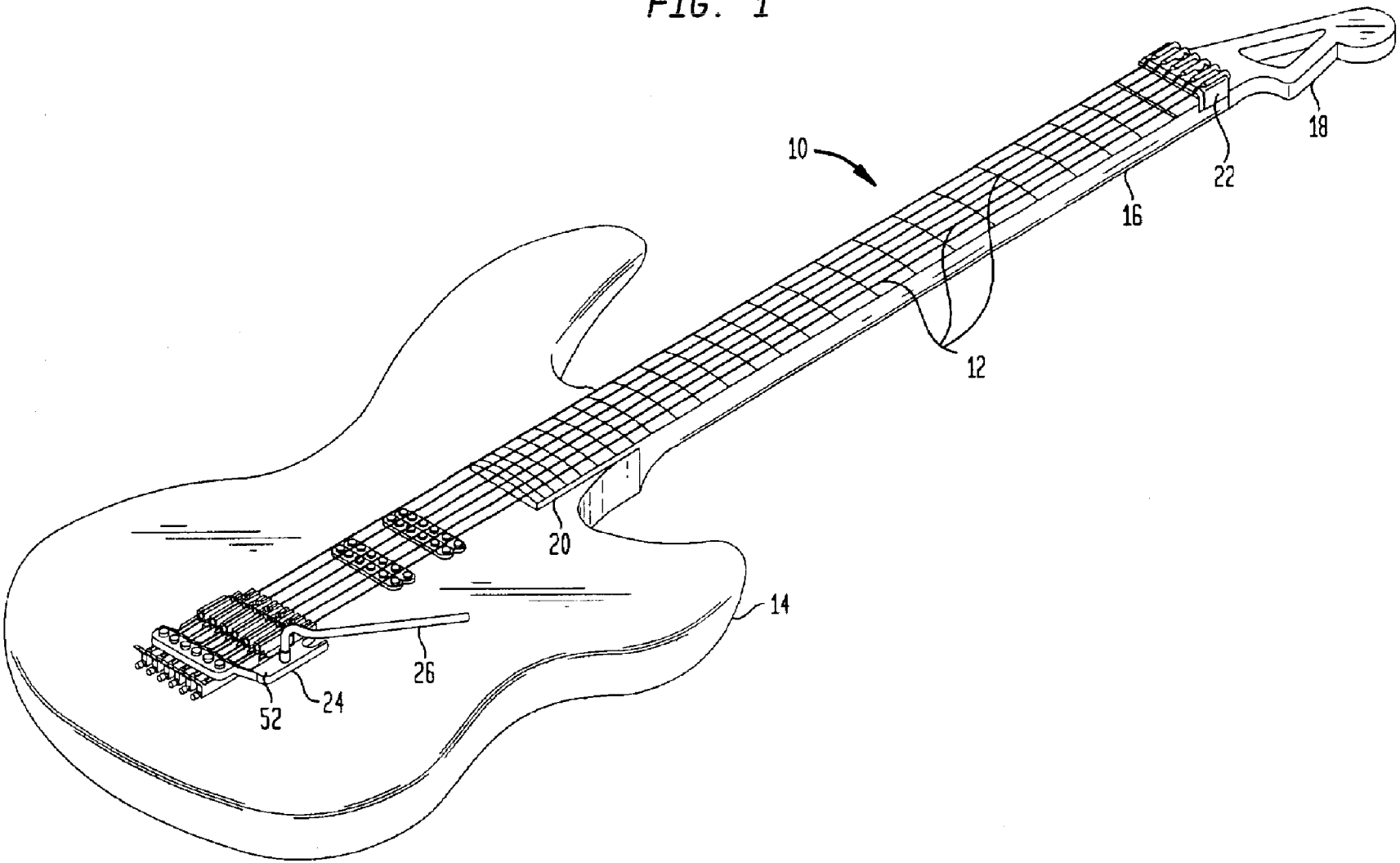
FIG. 1 is a perspective view of an electric guitar type of stringed musical instrument, incorporating a string tuning apparatus in accordance with one aspect of the present invention.

Like reference numerals have been used whenever possible to designate like components in the various embodiments of the present invention. Thus, in certain embodiments, various components or features may be designated by different reference numerals, while similar components and features will be designated by the same reference numerals.

Referring first to FIGS. 1–19 of the drawings, FIG. 1 shows an electric guitar type of stringed musical instrument 10 utilizing a string tuning apparatus in accordance with one aspect of the present invention. While this aspect of the present invention has been employed with respect to an electric guitar 10, it should, however, be appreciated that the present invention can be used in connection with various other types of stringed musical instruments, including, but not limited to, acoustic guitars, violins, banjos, and the like, wherein the associated strings 12 need to be retained in place on the instrument 10 and replaced at various times during the life of the instrument.

Although not illustrated in FIG. 1, the electric guitar 10 would typically include all of the normal accessories that can be found on an electric guitar. The guitar 10, as shown in FIG. 1, includes an instrument body 14 and a neck 16 having a head 18. A fretboard 20 is arranged on the neck 16. The fretboard 20 extends between a first end of the neck 16 near the head 18 of the guitar 10 and a second end of the neck 16 which extends towards the body 14 of the guitar 10. A plurality of strings 12 are mounted so as to extend between a nut assembly 22 arranged at or near the head 18 and a bridge assembly 24 arranged on the body 14 of the guitar 10. Note that the guitar 10 does not have tuning pegs on its head 18 since the plurality of strings 12 terminate with the nut assembly 22. The bridge assembly 24 can include a tremolo apparatus, including a tremolo bar 26, for simultaneously releasing the tension on all of the strings 12 during play of the guitar 10 to provide special sound effects.

Figure 2:
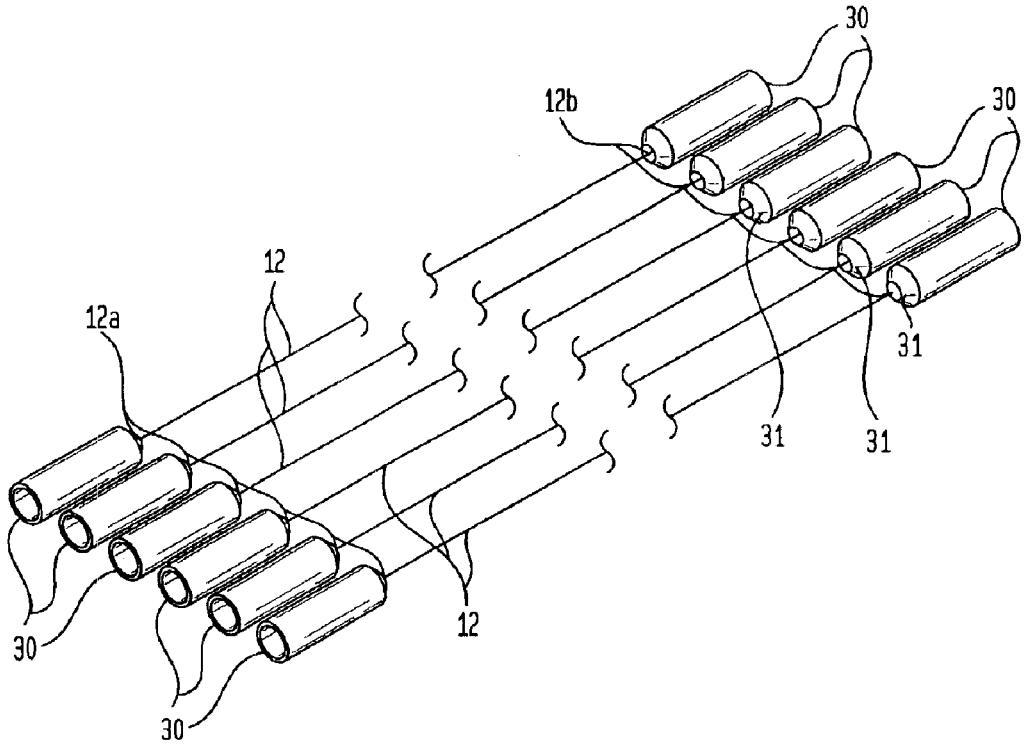
FIG. 2 illustrates a set of guitar strings for use with a guitar of the type as shown in FIG. 1.

The plurality of strings 12 is illustrated in greater detail in FIG. 2. Six guitar strings 12 are illustrated. Each of the guitar strings 12 has a first end 12*a* and a second end 12*b*. Bullets 30 or other string anchors are attached to each of the guitar strings 12 at the first end 12*a*, and bullets 30 or other string anchors are attached to each of the guitar strings 12 at the second end 12*b*. The bullets 30 on the first ends 12*a* of the guitar strings 12 are to be retained in place on the guitar 10 by components on the bridge assembly 24, and the bullets 30 on the second ends 12*b* of the strings 12 are to be retained in place by components in the nut assembly 22. Of course, the ends of the strings 12 can be reversed in the nut assembly 22 and the bridge assembly 24. Strings with bullets on their ends are shown and described in U.S. Pat. Nos. 5,717,150; 6,111,176; and 6,137,039, each of which is hereby incorporated by reference.

Figure 3:
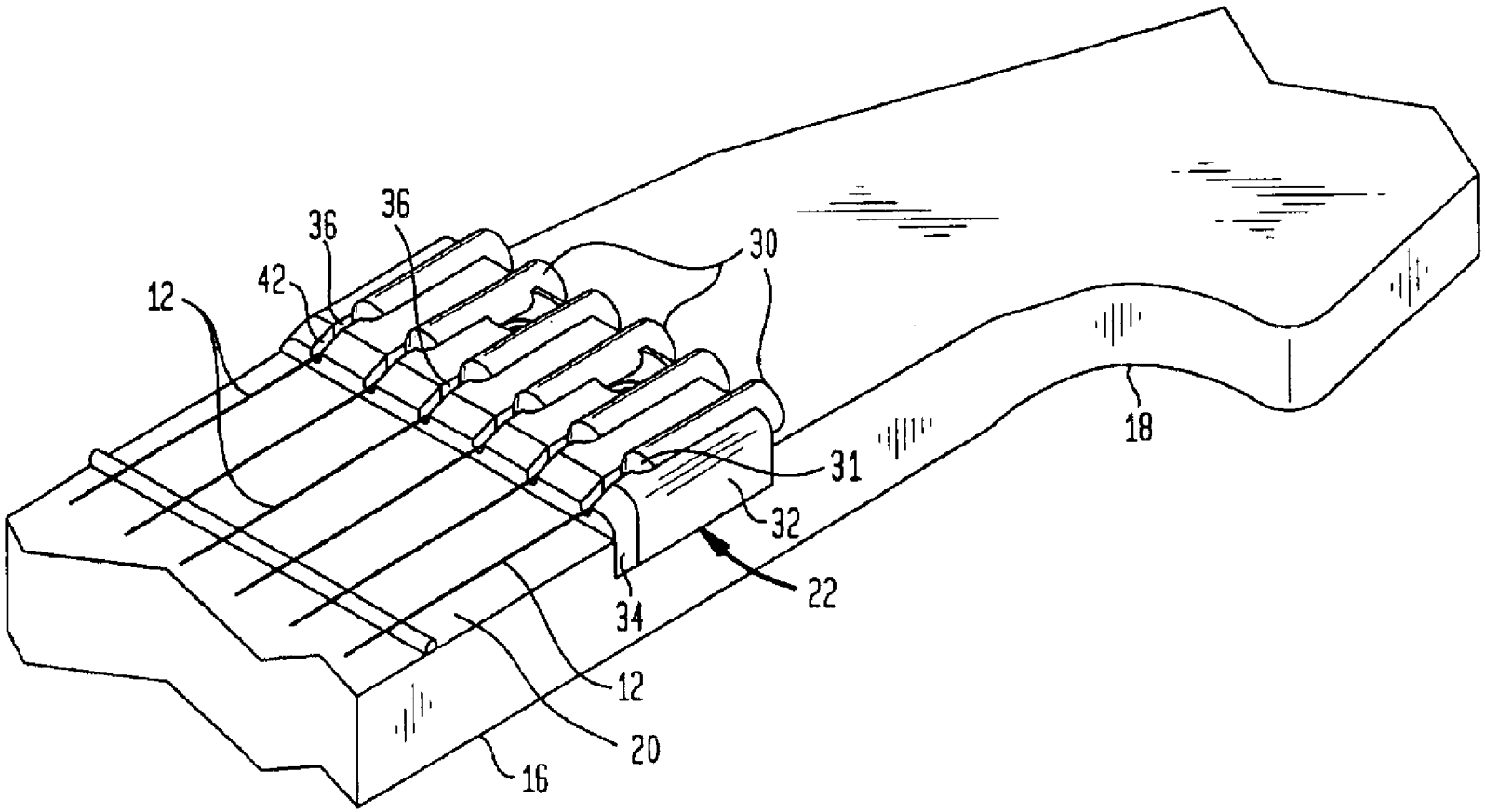
FIG. 3 is an enlarged perspective view of a nut assembly and corresponding strings, assembled on the head of a guitar of the type as shown in FIG. 1.
Figure 4:
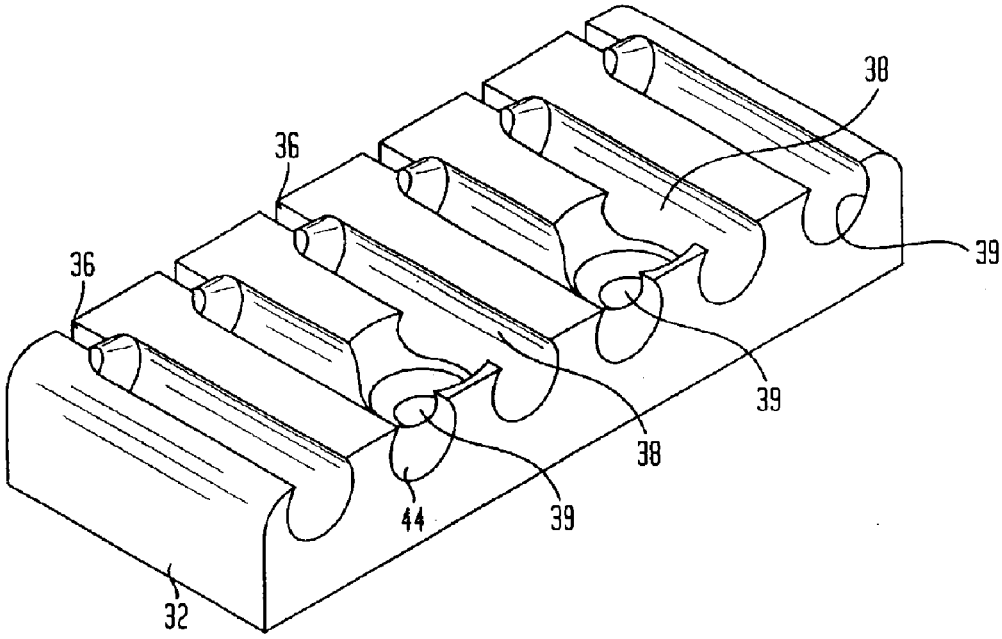
FIG. 4 is an enlarged rear perspective view of the string holder component of the nut assembly of FIG. 3.
Figure 5:
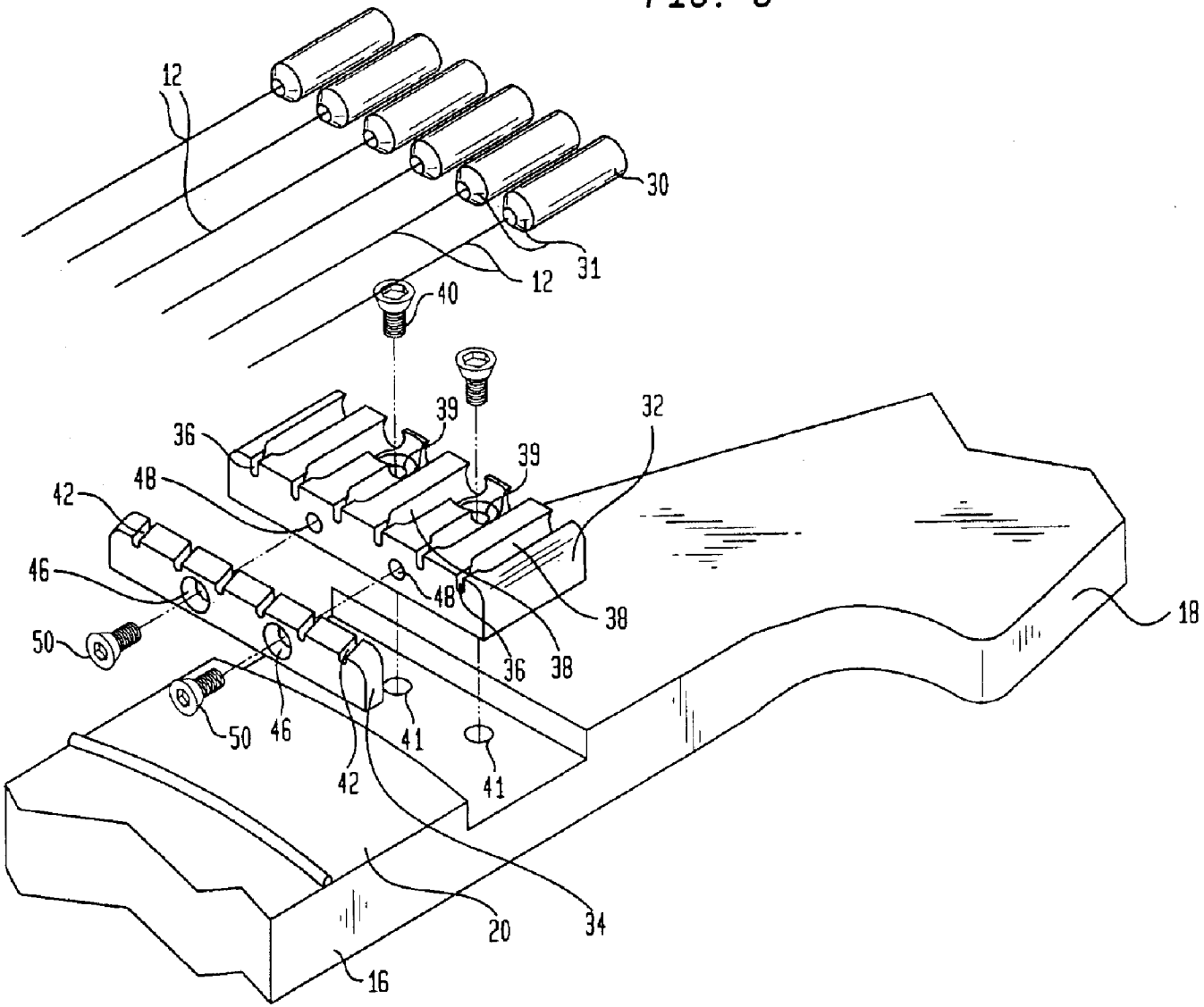
FIG. 5 is an exploded perspective view of the nut assembly shown in FIG. 3, illustrating how the nut assembly is assembled on the head of a guitar.

The nut assembly 22 is illustrated in greater detail in FIGS. 3 to 5. The nut assembly includes a string holder assembly 32 and a nut 34. The string holder assembly 32 has six narrow channels 36 at its forward end for the six guitar strings 12 and six wider, bullet-shaped cavities 38 therebehind for receipt of the bullets 30 on the ends 12*b* of the guitar strings 12. The string holder assembly 32 is secured to the neck 16 of the guitar 10 by two screws 40. The nut 34 has six channels 42 for the guitar strings 12. Each of the six narrow channels 36 in the string holder assembly 32 align with the channels 42 in the nut 34 to provide a path for the respective guitar strings 12.

Referring to FIG. 4, each of the bullet-shaped cavities 38 has an open end 44 at the rear of the string holder assembly 32. Each of the cavities 38 receives one of the bullets 31, respectively, on one of the respective guitar strings 12. It is preferred that each of the bullet-shaped cavities 38 be cylindrical, because the bullets 30. are preferably cylindrical. In general, it is preferred that the shape of the cavities 38 match the shape of the bullets 30. It is also preferred that the ends of the cavities 38 nearer to the narrow channels 36, respectively, be contoured to match the ends of the bullets 30 that are attached to the strings 12. The similar shaping of the bullets 30 and the cavities 38 results in each of the bullets 30 fitting into its respective cavity 38 in a snug fit. The snug fit prevents the guitar strings 12 from being affected by any undue motion of the bullets 30 while the guitar 10 is being played.

When a new string 12 is being placed in the guitar 10, the bullet 30 on the string 12 is preferably inserted, string-end first, into the open end 44 of the cavity 38 at the rear of the string holder assembly 32. The string 12 is placed through the narrow channel 36 at the forward or front end of the string holder assembly 32 and through the channel 42 in the nut 34. The string 12, when so assembled, is in contact with the channel 42 in the nut 34. The channel 42 thereby provides a critical contact point or surface for the string 12. The critical contact point or surface is sometimes called a termination point, and represents the point or surface at which a string 12 contacts the nut assembly 22. A similar critical contact point or surface is also provided for the string 12 on the bridge assembly 24. It is well known that the critical contact point or surface at both ends of the strings 12 is important in tuning the guitar 10. Each of the channels 42 in the nut 34 provides a critical contact point or surface for the strings 12, respectively.

Referring to FIG. 3, when the bullets 30 are inserted into the respective cavities 38, a portion of the bullets 30 can protrude from the respective open ends 44 at the rear of the string holder assembly 32. This may simplify the removal of the bullets 30 from the respective cavities 38 when a string 12 is to be replaced.

Referring to FIG. 5, an exploded view of the nut assembly 22, including the string holder assembly 32 and the nut 34, is illustrated. A variety of fastening devices can be used to secure the nut 34 to the string holder assembly 32. In a preferred embodiment, the nut 34 includes two recessed holes 46, and the string holder assembly 32 includes two threaded holes 48 that align with the holes 46, respectively. Two bolts or screws 50 are inserted through the holes 46 into the threaded holes 48 to secure the nut 34 to the string holder assembly 32.

A variety of fastening devices can also be used to secure the nut assembly 22 to the guitar 10. In a preferred embodiment, the nut assembly 22 is secured to the guitar 10 by securing the string holder assembly 32 to the neck 16 of the guitar 10. More particularly, the string holder assembly 32 includes two recessed holes 39. The recessed holes 39 are preferably located in the block of the string holder assembly 32 so as not to extend into any of the cavities 38. The guitar neck 16 has two holes 39 that align with the recessed holes 39 on the string holder assembly 32. Two screws 40, or any other fastening devices, are inserted through the respective holes 39 and into the respective holes 41 to secure the string holder assembly 32 to the guitar 10.

The string holder assembly 32 and the nut 34 are preferably constructed from aluminum. They can also be constructed from steel, or from potted metal zinc alloy (ZMAC), or from many other materials.

The bridge assembly 24, and various components thereof, are shown in FIGS. 6–11 and 17–19. As with the nut assembly 22, the bridge assembly 24 may be used with various stringed instruments, including guitars. The term "bridge" is often used in the art to only designate the critical contact points or surfaces for the strings. These are the points or surfaces where the guitar strings 12 actually contact corresponding bridge elements. However, it should be appreciated that the terms "bridge" or "bridge assembly", as used herein, include more than just the critical contact points or surfaces. In particular, the term "bridge assembly" is used to refer to the entire assembly having the critical contact points or surfaces and which includes the tuning apparatus or system for the strings 12. Thus, the bridge assembly 24 includes various other components. It is further noted that the bridge assembly 24 illustrated in the figures can be used with a variety of nut assemblies, in addition to the one illustrated in FIGS. 3 to 5. Still further, various components of the bridge assembly 24 can be used with a variety of other types of bridge assemblies, such as fixed bridge assemblies for electric guitars, as well as acoustic guitars.

Figure 6:
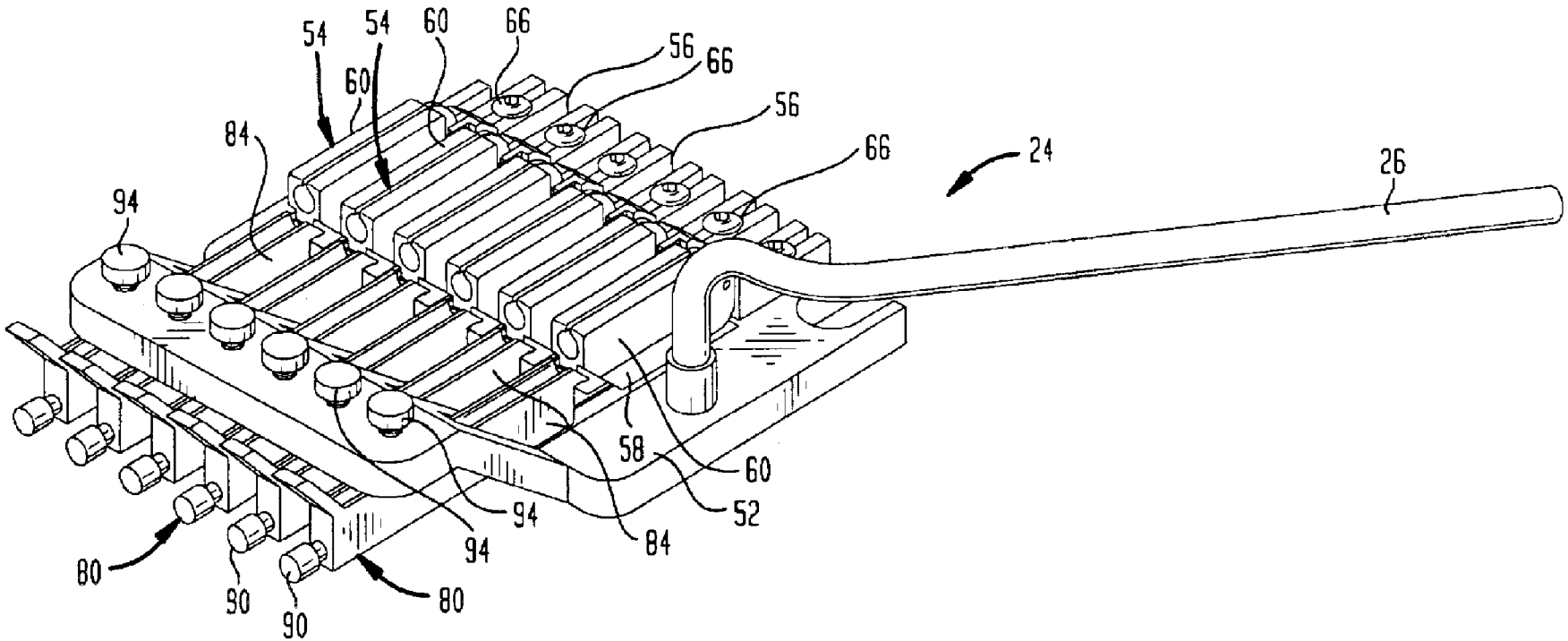
FIG. 6 is an enlarged perspective view of the bridge assembly of the guitar of FIG. 1, illustrating the string tuning apparatus in accordance with one aspect of the present invention.
Figure 7:
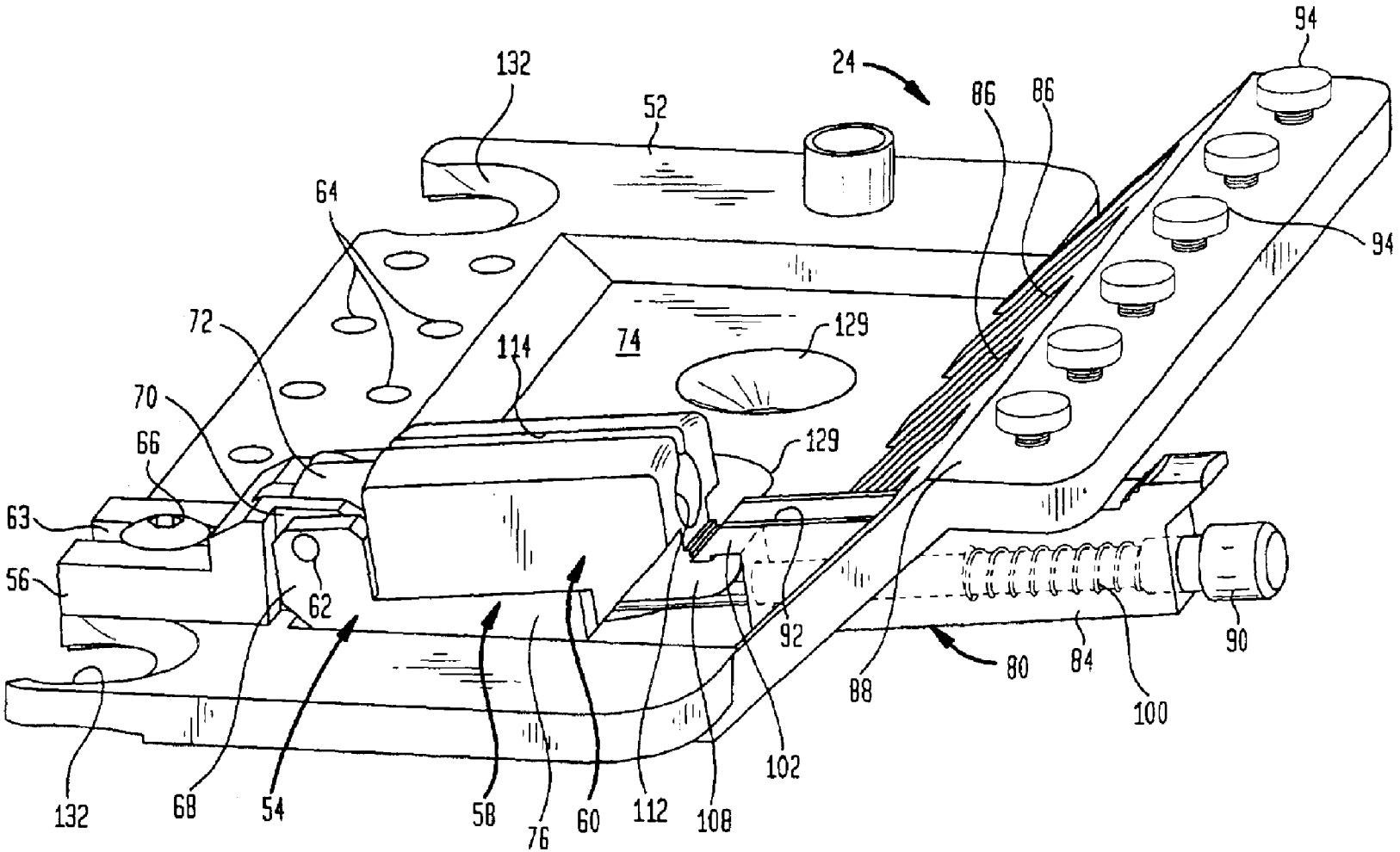
FIG. 7 is an enlarged perspective view of the bridge assembly of FIG. 6, from the opposite side to that of FIG. 6, having a single string holder assembly arranged in a locked position and with the other string holder assemblies removed for clarity.
Figure 8:
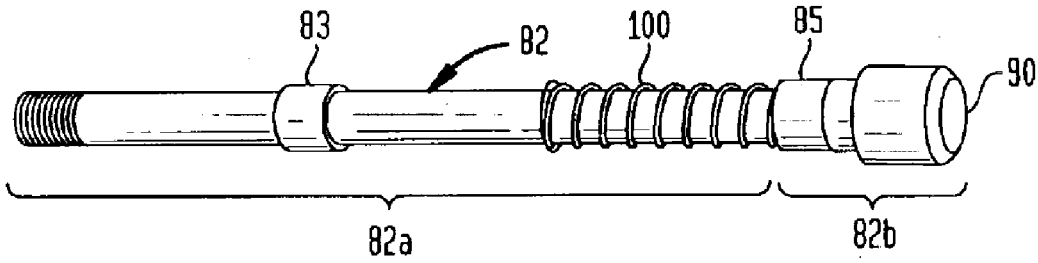
FIG. 8 is a side elevational view of a latch bar for use in the string holder assemblies of the bridge assembly shown in FIG. 6.

Referring to FIG. 6, the bridge assembly 24 includes a bridge base 52 having a plurality of individually adjustable, string holder assemblies 54 supported thereon for securing the ends of strings 12 on the bridge assembly 24. Referring to FIG. 7, one of the string holder assemblies 52, which is illustrative of each of the string holder assemblies 54, is shown positioned on the bridge base 52, with the other string holder assemblies being removed for clarity.

Each string holder assembly 54, according to a preferred embodiment, includes a front block or intonation adjustment member 56, a saddle base or support member 58 used for tuning of the strings 12, and a saddle pivot member or string retention member 60. As explained more fully hereinbelow, the front block 56 serves as an intonation adjustment member, and pivotably supports the saddle base member 58 and saddle pivot member 60 for pivotable movement about a pin 62 or common axis. Each of the front blocks 56, saddle base members 58 and saddle pivot members 60 may preferably be made of aluminum. However, they can also be made from steel or potted metal zinc alloy (ZMAC), or can be made from any of many different materials commonly used for bridge assemblies and components for stringed musical instruments.

Each of the front blocks 56 includes a forward slot 63 which may be used for securing the front block 56 to the bridge base 52. In this regard, the bridge base 52 includes two threaded holes 64 for each of the string holder assemblies 54. Each front block 56, and thus each string holder assembly 54, is retained on the bridge base 52 by aligning the slot 63 therein with one of the threaded holes 64, and inserting a suitable fastening device 66 to secure the front block 56 in position on the bridge base 52. The slot 63 and the holes 64 allow for some range of adjustment of the string holder assemblies 54 on the bridge base 52. This adjustment is used primarily for harmonic tuning of the strings 12, as it sets the position of the critical contact surfaces on the bridge assembly 24.

Figure 10:
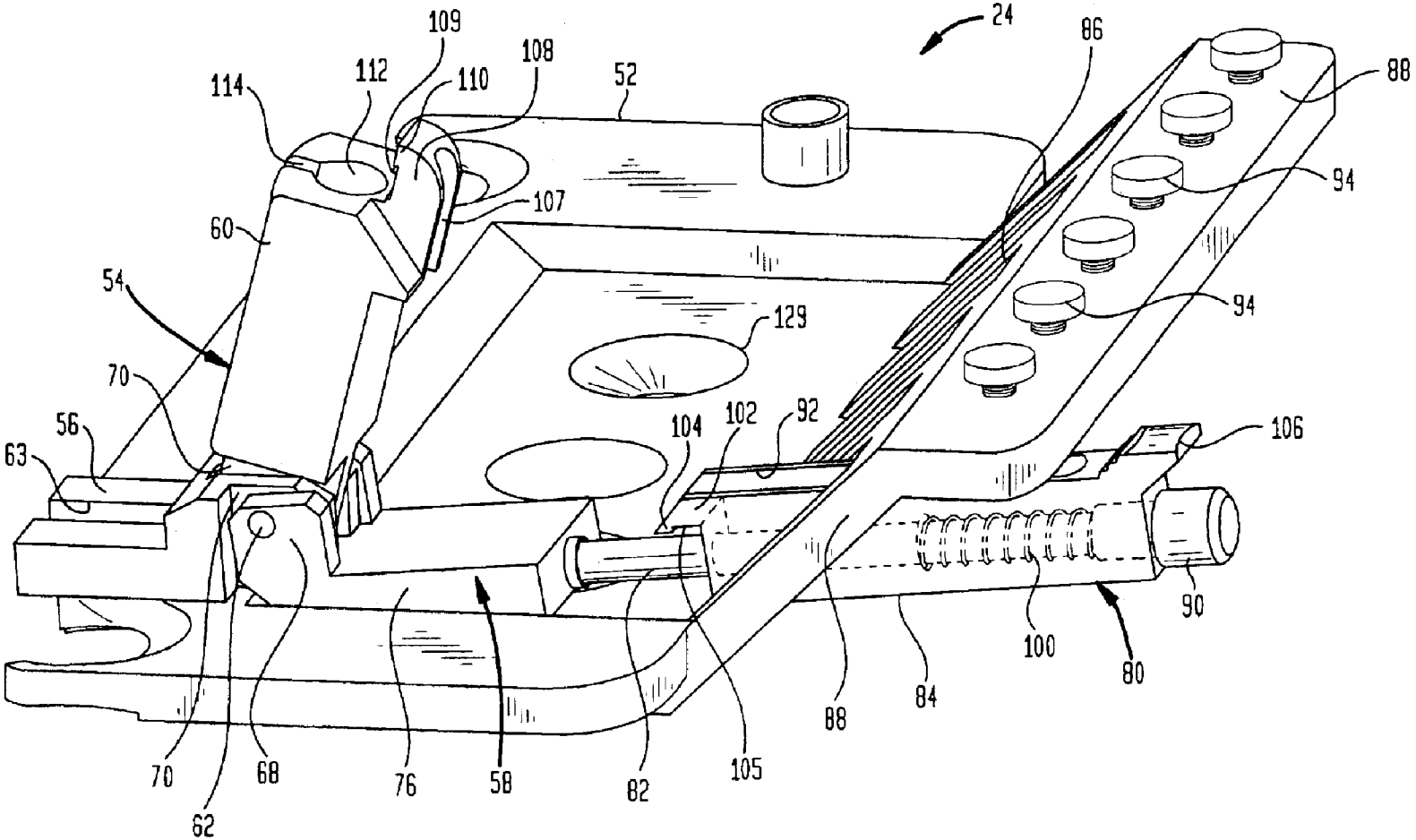
FIG. 10 is an enlarged perspective view, similar to that of FIG. 7, but showing the single string holder assembly in an unlocked or release position.

As best seen in FIGS. 7 and 10, the saddle base member 58 and saddle pivot member 60 are pivotally connected to the front block 56 by means of a pivot bar or pin 62 which extends transversely across the width of the front block 56, the saddle base member 58 and the saddle pivot member 60. In this regard, the saddle base member 58 includes a pair of upstanding, spaced flanges 68 at its forward end, which are adapted to be arranged adjacent rearwardly extending, spaced flanges 70 on the front block 56, with a forward nose 72 of the saddle pivot member 60 being arranged between the rearwardly extending flanges 70 of the front intonation adjustment block 56. The pivot pin or bar 62 extends through the flanges 68 of the saddle base member 58, the flanges 70 of the intonation adjustment block 56 and the forward nose 72 of the saddle pivot member 60. Thus, it will be appreciated that the saddle base member 58 and saddle pivot member 60 may freely pivot together in either direction relative to their associated front block member 56. Also, the saddle pivot member 60 may freely pivot in either direction relative to the associated saddle base member 58 and front block 56.

Also as best seen in FIGS. 7 and 10, the bridge base 52 includes a recessed area 74 behind the holes 64 used for mounting of the front intonation adjustment blocks 56. When the string holder assemblies 54 are mounted to the bridge base 52, each of the saddle base members 58 sits in the recessed area 74. The recessed area 74 provides clearance for accommodating pivoting of the saddle base members 58. Each saddle base member 58 includes a rearwardly extending support 76 for attachment of a support bar or rod 82 of a latch mechanism 80. As explained more fully hereinbelow, during normal play of the instrument 10, the saddle pivot member 60 is secured by means of the latch mechanism 80 in a lowered position adjacent to the associated saddle base member 58.

Referring to FIGS. 6 and 7, the latch mechanism 80 for securing the saddle pivot member 60 adjacent to the associated saddle base member 58 comprises a support bar or rod 82 and a sliding latch member 84 which extend rearwardly from the saddle base member 58 through appropriate slots 86 provided in an upstanding, rearwardly extending flange 88 of the bridge base 52. The support bar 82, which is shown in greater detail in FIG. 8, preferably is made of brass, and includes a rear knob 90 and a series of cylindrical sections of differing diameters. The support bar is preferably made of two pieces or sections 82*a*, 82*b*, in order to enable assembly of the support bar 82 with the sliding latch member 84, as described below.

Figure 9:
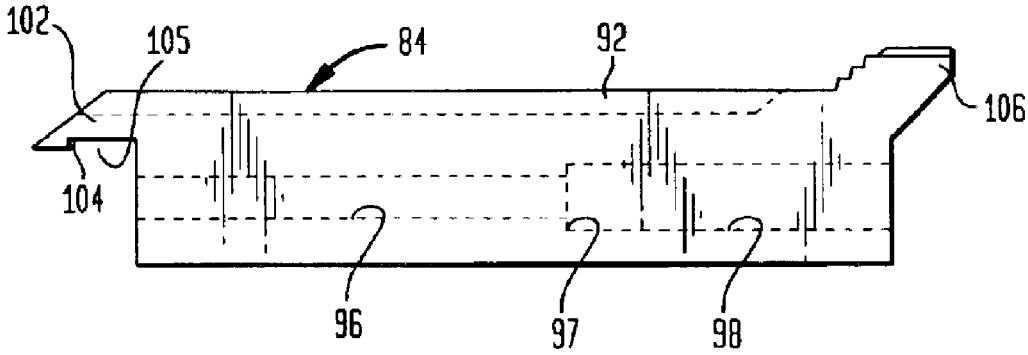
FIG. 9 is a side elevational view of the sliding latch component employed in the string holder assemblies of the bridge assembly of FIG. 6.

The sliding latch member 84 is best shown in greater detail in FIG. 9. The latch member 84 includes a grooved section 92 in its top surface, which is adapted to receive the end of a tuning adjustment screw 94 threadably mounted on the rearwardly extending flange 88, as described more fully hereinbelow. The sliding latch member 84 also includes front and rear bores 96, 98 therethrough which are coaxially arranged but of different diameters, the forward bore 96 being of smaller diameter than the rear bore 98. The forward bore 96 is adapted to receive the rearward end of the forward piece 82*a* of the support bar 82, with the enlarged cylindrical section 83 arranged to contact the exterior of the sliding latch member 84. The forward piece 82*a* also includes a threaded end at its forward end which is adapted to be threadably secured into the rear end face of the associated saddle base member 58.

The rearward end of the forward piece 82*a* of the support bar 82 extends through the front, small bore 96 and into the rear, large bore 98 of the latch member 84. The rearward end is adapted to receive thereon a coil spring 100 in the rear, large bore 98. The coil spring 100 is conveniently inserted through the rear of the latch member 84 into the enlarged bore 98 and placed about the rearward end of the forward piece 82*a*. The second or rear piece 82*b* of the support bar 82 is then inserted through the rear opening of the bore 98 and threaded onto the end of the rearward end of the forward piece 82*a* of the support bar 82. The coiled spring 100 thus is arranged to engage the annular surface 97 (see FIG. 7) between the front and rear bores 96, 98 at the forward end of the rear bore 98 of the latch member 84, and to engage against the end surface of the enlarged cylindrical section 85 of the rear piece 82*b* of the support bar 82. As best seen in FIGS. 7, 9 and 10, the sliding latch member 84 also includes a forward lip 102 having locking fingers 104, and an upstanding rear protrusion 106 which may be used to assist in the sliding motion of the latch member 84 relative to the support bar 82.

When assembled and in its latched position, the sliding latch member 84 is biased forwardly relative to the support bar 82 by means of the spring 100, which urges the front surface of the latch member 84 against the enlarged cylindrical stop 83 on the support bar 82, and with the knob 90 on the end of the rear piece 82*b* displaced rearwardly of the rear surface of the latch member 84. However, the latch member 84 may be pulled rearwardly relative to the support bar 82 so that the rear knob 90 is adjacent or against the rear surface of the latch member 84 and with the spring 100 compressed. When in this position, the enlarged cylindrical section 83 of the forward piece 82*a* is displaced forwardly of the front surface of the latch member 84.

As noted hereinabove, the forward end of the support bar 82 is adapted to be threadably engaged in a threaded bore provided in the rear of the saddle base member 58. In this regard, the cylindrical nature of the support bar 82 enables placement of the generally rectangular block-shaped sliding latch member 84 through a slot 86 in the rearwardly extending flange 88 and threaded into the rear of its respective. saddle base member 58. When so assembled, the sliding latch member 84 is biased by the spring 100 along the respective support bar 82 towards the respective string holding assembly 54. The sliding latch member 84, however, can be slid backwards along the support bar 82 away from the string holding assembly 54 by pulling the sliding latch member 84 backwardly and compressing the spring 100. The sliding of the latch member 84 backwards is preferably accomplished by placing a finger or thumb on the rear protrusion 106 of the sliding latch member 84 and retracting the sliding latch member 84 away from the saddle base member 58. For reasons that will be discussed shortly, it is preferable to press down on the string holder assembly 54 while pulling or pushing backward on the sliding latch member 84. It is to be understood that each of the string holder assemblies 54, and each of the respective support bars 82 and sliding latch members 84, are connected and operated in the foregoing manner to aid in the replacement of the respective strings 12.

The string holding assembly 54 is illustrated in its locked or down position in FIG. 7, and in its unlocked or released position in FIG. 10. When in the locked position, the saddle pivot member 60 is held in position relative to the rear support 76 of the saddle base member 58. In this regard, the saddle pivot member 60 includes a protruding ledge 108, which can either be an integral part of the saddle pivot member 60 or can be a separate component attached thereto. The protruding ledge 108 includes a recessed area 109 and raised finger 110 on its top surface for receiving the locking fingers 104 of the sliding latch member 84, with the raised finger 110 received in recessed portions 105 of the fingers 104. This arrangement facilitates locking of the sliding latch member 84 in position and preventing accidental release of the saddle pivot member 60. The protruding ledge 108 also preferably includes a groove 107 in its bottom so as to fit around the cylindrical forward end of the support bar 82, and thereby provides stability to the saddle pivot member 60 when the string holder assembly 54 is in its locked position.

Figure 11:
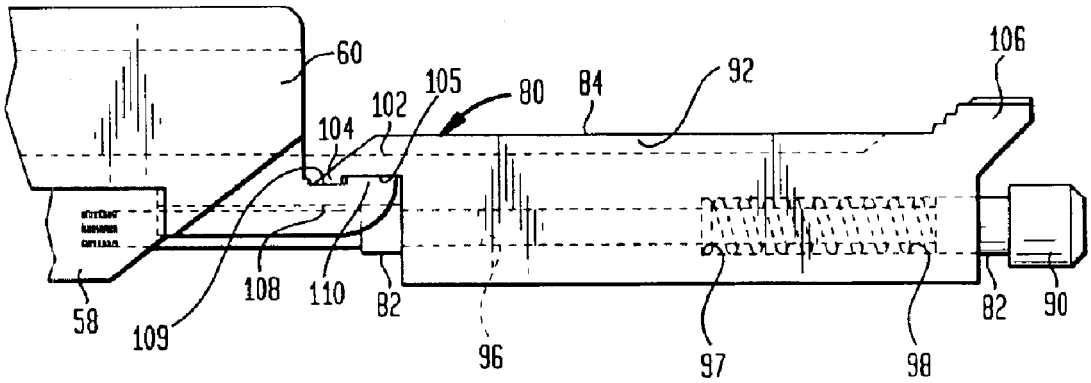
FIG. 11 is an enlarged side view of a portion of the string holder assembly of the bridge assembly of FIG. 6, cut away to illustrate the latch mechanism holding the rotatable string retention component in position relative to the saddle base component.

When in the locked position, the saddle pivot member 60 is held in that position by the interface of the protruding ledge 108 on the saddle pivot member 60 and the forward lip 102 on the sliding latch member 84, with the fingers 104, 110 being interlocked. This interface and interlocking is shown in FIG. 11. Release of the saddle pivot member 60, so that it may be pivoted upwardly relative to the saddle base member 58, is accomplished by pressing down on the string holder assembly 54 and pulling the sliding latch member 84 rearwardly, which serves to move the forward lip 102 away from the protruding ledge 108.

In a preferred embodiment, the saddle pivot member 60 has a central bullet-shaped cavity 112 extending longitudinally from the rear end thereof, together with a top slotted opening or channel 114 extending between the top surface of the saddle pivot member 60 and the bullet-shaped cavity 112. The slotted opening 114 extends along the longitudinal length of the saddle pivot member 60, whereas the bullet-shaped cavity 112 stops short of the forward end. As with the string holder assembly 32 of the nut assembly 22, the bullet-shaped cavity 112 in each of the saddle pivot members 60 is contoured to match the shape of the bullet 30 to be received therein. In accordance with a preferred embodiment, the cavity 112 and the bullets 30 connected to the strings 12 are cylindrical. There is also provided a grooved section 116 in the forward nose 72 of the saddle pivot member 60 on which the string 12 is adapted to rest and which thus provides the critical contact surface for the string 12.

In order to assemble the strings 12 into the string holder assembly 54, a bullet 30 on one end of each of the strings 12 is inserted, via the string section first, into the cavity 112 by passing the string 12 through the slotted opening or channel 114 and then pulling back on the bullet 30 to clear the rear of the saddle pivot member 60. The bullet 30 is then inserted snuggly into the cavity 112.

When a bullet 30 is inserted into the cavity 112, the string 12 attached to the bullet 30 extends forwardly across the groove 116 in an upward fashion, and exits the bridge assembly 24 via the groove 116 toward the nut 34. The upward extension of the string 12 through the groove 116, while the string 12 is under tension, creates an upward force on the string 12. This arrangement, in turn, creates an upward force on the rear of saddle pivot member 60, tending to urge it to pivot or rotate in a counterclockwise direction as shown in FIG. 7. This upward force on the saddle pivot member 60 creates an upward pressure on the protruding ledge 108, and thereby creates an upward force against the forward lip 102, keeping the saddle pivot member 60 in place against the saddle base member 58. This is also aided by the interlocking nature of the raised finger 110 on the ledge 108 and the fingers 104 on the forward lip 102.

Thus, pressing down on the saddle pivot member 60 when operating the sliding latch member 84 relieves the force between the elements. Pulling back on the sliding latch member 84 leaves the protruding ledge 108 unopposed by the fingers 102 on the latch member 84 so that the saddle pivot member 60 can move to the unlocked position as shown in FIG. 10. In other words, when the sliding latch member 84 is pulled backward leaving the protruding ledge 108 of the saddle pivot member 60 unopposed by the latch member 84, the tension exerted on the saddle pivot member 60 by the string 12 serves to cause the saddle pivot member 60 to pivot about the pin 62 and to move into the unlocked or release position, as shown in FIG. 10. This serves to relieve the tension on the string 12 so that the string 12 in turn can be simply removed by pulling on the bullet 30 relative to the saddle pivot member 60 and removing the bullet 30 from the cavity 112 so that the string 12 can simply be lifted therefrom. Preferably, the longitudinal depth of the cavity 112 is less than the length of the bullet 30 so that the end of the bullet 30 extends from the cavity 112 to facilitate easy removal of the string 12 from the saddle pivot member 60 when the saddle pivot member 60 has moved to its release position.

Figure 17:
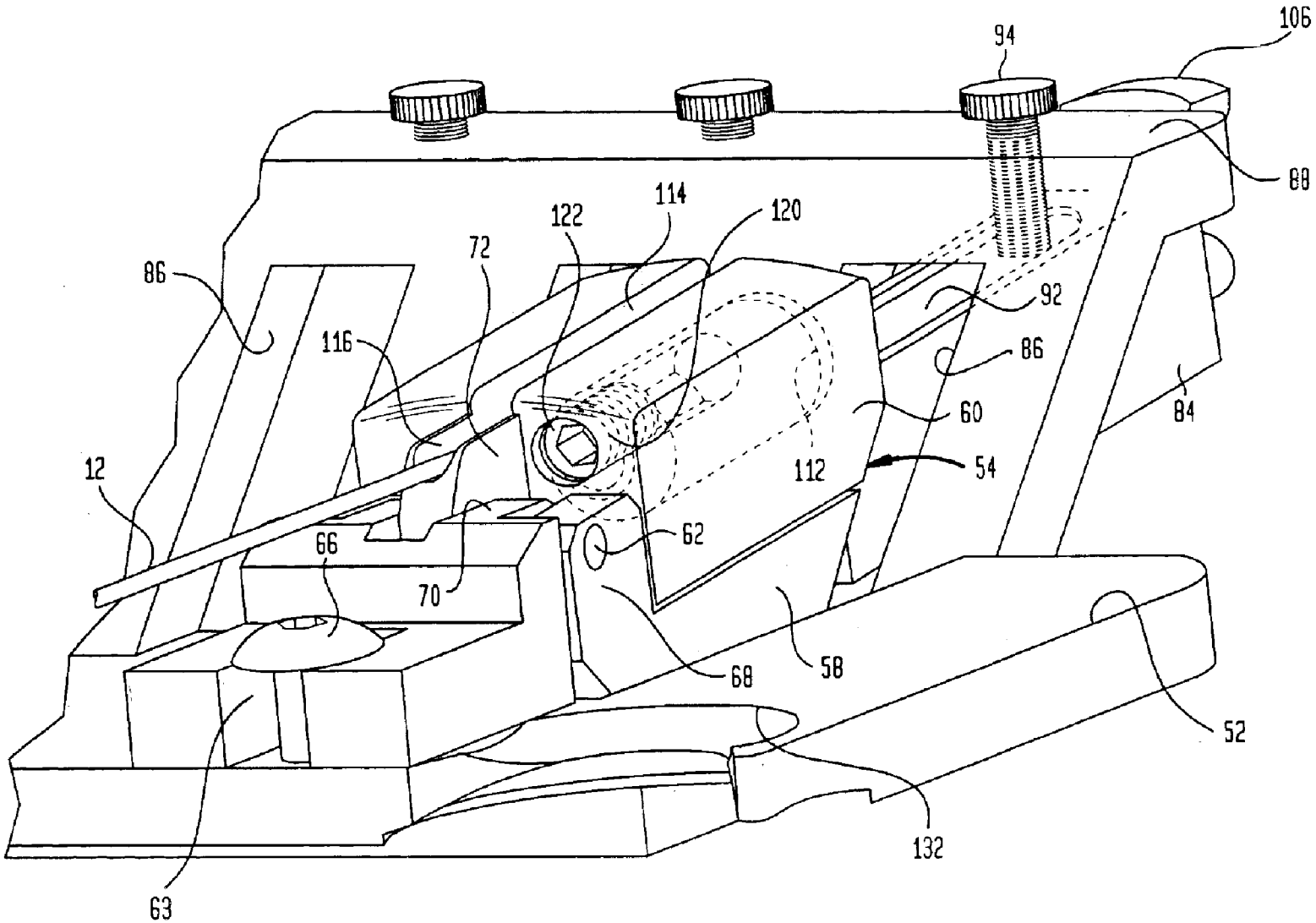
FIG. 17 is an enlarged side perspective view, partially broken away, showing one of the string retention components employed in the bridge assembly of FIG. 6.

As illustrated in FIG. 7, a plurality of threaded holes 118 are provided in the top of the rearwardly extending flange 88 of the bridge base 52 for receiving threaded tuning adjustment members 94. As seen in FIG. 6, the threaded tuning adjustment members 94 are inserted into the threaded holes 118 so as to extend therethrough and into contact with the grooved section 92 of the sliding latch member 84, as best seen in FIGS. 7 and 17. When the bridge assembly 24 is installed on a guitar 10 and the strings 12 are placed under tension, the strings 12 exert a force on the respective saddle pivot members 60 and, when latched to the saddle base member 58, on the saddle base member 58 as well. This pivoting action serves to urge the latch mechanisms 80 upwardly as viewed in FIG. 7, so that the latch mechanisms 80 are placed in contact with the lower ends of the threaded screws 94.

It will be appreciated that pivoting of the saddle pivot members 60 upwardly or downwardly causes the tension on the strings 12 whose bulleted ends are retained therein to be varied as well. This accordingly enables tuning of the strings 12 by increasing or decreasing the tension thereof. In this regard, the forward intonation block 56 for each of the individual string holder assemblies 54 is placed in the appropriate position on the bridge base 52 to provide the desired harmonic tuning for the string (by virtue of defining the appropriate spacing between the critical contact surfaces at the nut 34 and the critical contact surfaces provided on the nose section 72 of the saddle pivot members 60). The pitch tuning for the string 12 is then achieved by turning of the respective thumb screw 94 which is in contact with the latch mechanism 80 for the string holder assembly 54. Tuning of each of the guitar strings 12 is achieved in a similar manner for each of the string holder assemblies 54.

Figure 18:
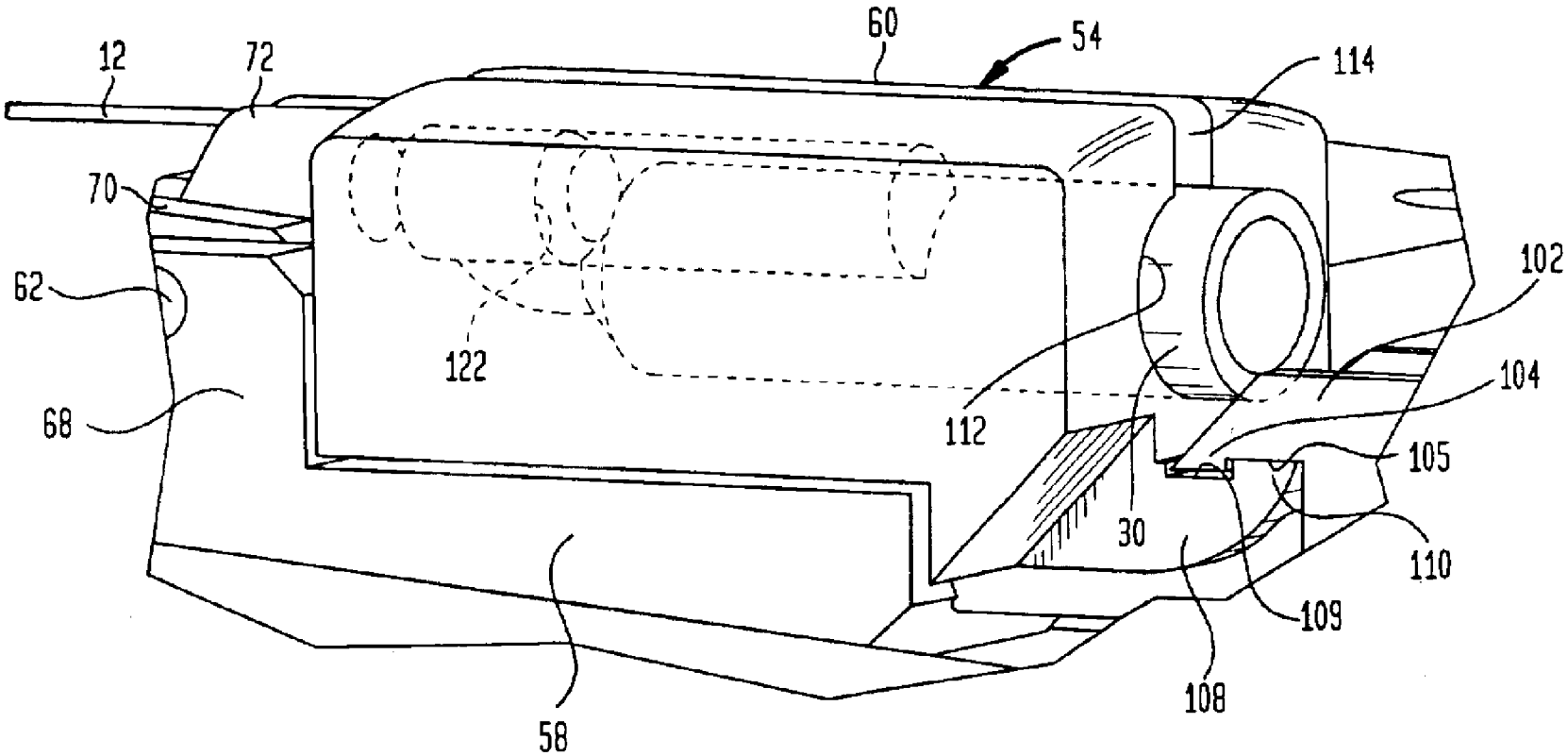
FIG. 18 is an enlarged side perspective view, from a different angle to that illustrated in FIG. 17, partially broken away, showing one of the string retention components of the bridge assembly of FIG. 6.
Figure 19:
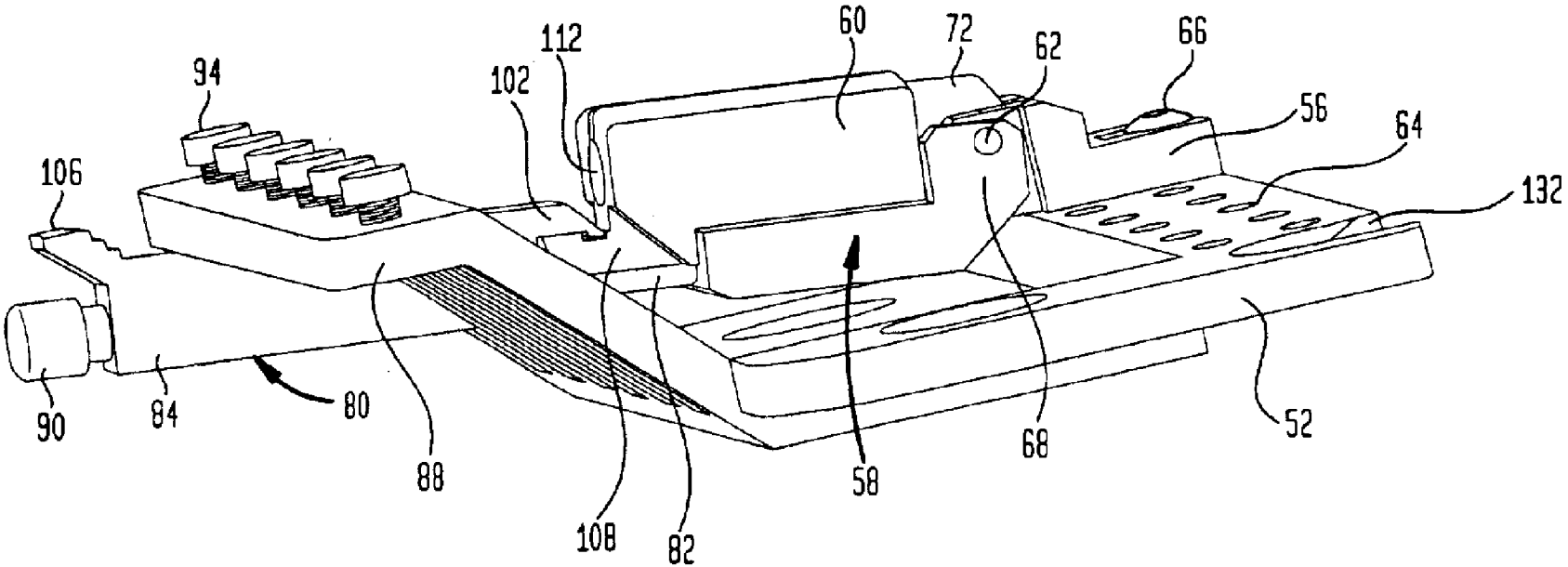
FIG. 19 is a side perspective view of the bridge assembly of FIG. 7, but from a different perspective, having a single string holding assembly shown in the locked position and with the other string holder assemblies removed for clarity and illustrative purposes.

In the event a string 12 cannot be properly tuned within the range offered by the screws 94 mounted on the rear flange 88, then further adjustments to the tension of a string 12 being retained by the string holder assembly 54 can be made using a range adjustment mechanism provided in the preferred embodiment of the string holder assemblies 54. Referring to FIGS. 17–18, each saddle pivot member 60 includes a threaded hole 120 in the front end thereof that is parallel to the axis of the cavity 112. An allen-head bolt 122 is inserted into the hole 120. The bullet 30 in the cavity 112 has a beveled end 31 (see FIG. 2) from which the string 12 extends. The bolt 122 may be screwed into the threaded hole 120 so that a beveled end of the bolt 122 contacts the beveled end 31 of the bullet 30 to control the position of the bullet 30 within the cavity 112 of the saddle pivot member 60. In particular, turning the bolt 122 further into the hole 120 will push the bullet 30 back in the cavity 112 away from the nut assembly 22, whereas turning the bolt 122 further out of the hole 120 will allow the bullet 30 to move further into the cavity 112 closer to the nut assembly 22. The position of the bolt 122 thus provides coarse tuning for the strings 12 and can be used to adjust the range of the tuning screws 94 to fine-tune each string 12.

Each of the string holder assemblies 54 includes the same structure, including the bolt 122 and the hole 120, to control the position of the bullet 30 being retained by the string holder assembly 54. This arrangement thus allows a further range of tuning of each of the strings 12 in the guitar 10. Thus, when the tuning screws 94 run out of range, so the guitar cannot be tuned, the bolt 122 (known as the range adjustment screw) and hole 120 arrangement on each saddle pivot member 60 can be utilized to provide additional tuning range.

As noted above, harmonic tuning of the guitar 10 may be achieved by adjusting the position of each of the string holder assemblies 54 in relation to the bridge base 52. It is understood that the string holder assembly 54 has a slotted intonation block 56 that is retained on the bridge base 52 by a suitable bolt 66 or other fastening devise. Harmonic tuning can be achieved, in accordance with well-known procedures, by chiming a string 12 at its half way point, and making any necessary adjustments by sliding the appropriate string holder assembly 54 along the bridge base 52 so that the slotted intonation block 56 moves in relation to the bolt 66, and then tightening the bolt 66. Generally, once the harmonic tuning is set, the guitar 10 remains in harmonic tune.

Figure 12:
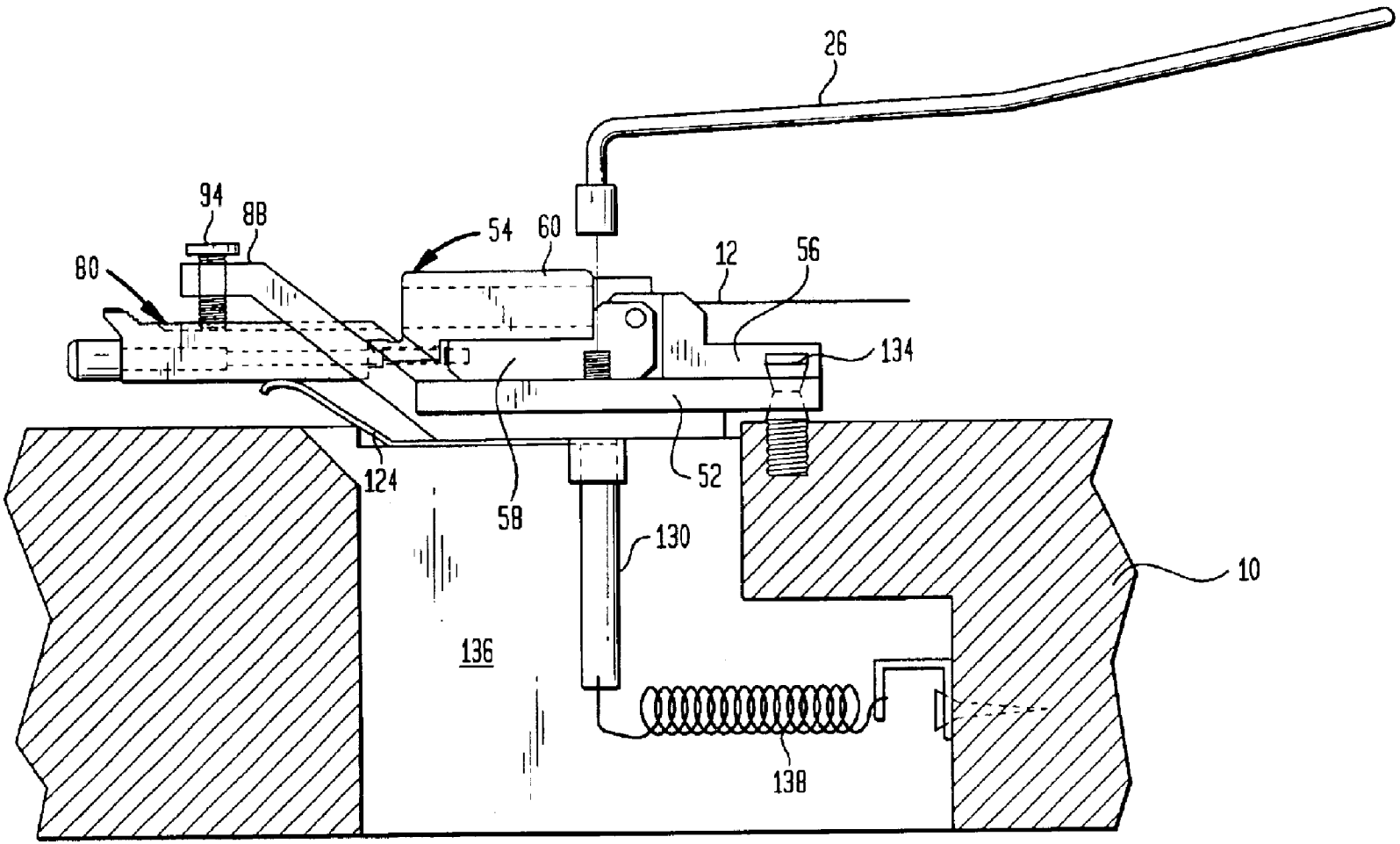
FIG. 12 is a partial side elevational view of the guitar of FIG. 1, showing the bridge assembly mounted on the guitar.
Figure 13:
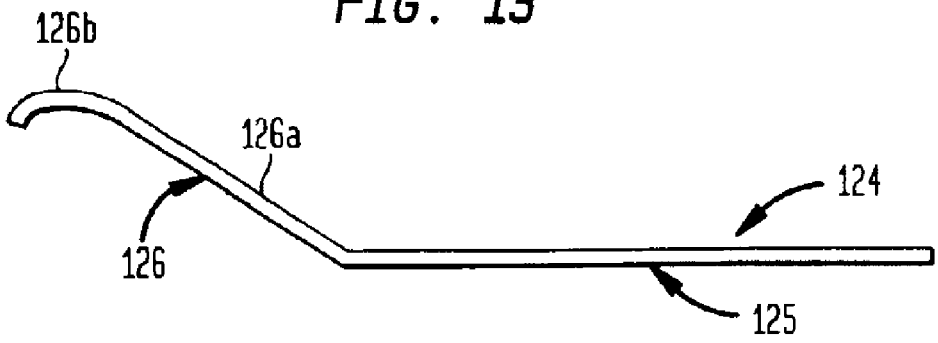
FIG. 13 illustrates a side view of the leaf spring assembly used in the bridge assembly shown in FIG. 12.
Figure 14:
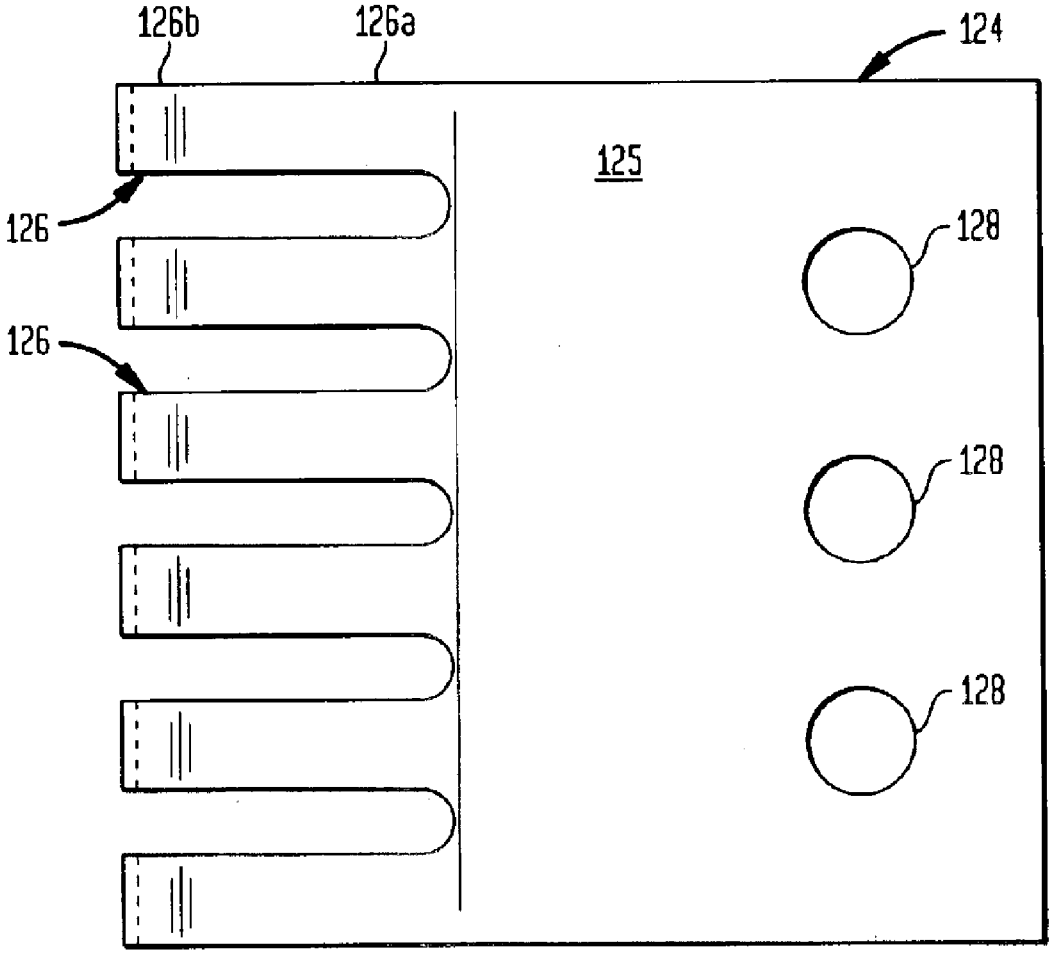
FIG. 14 is a plan view of the leaf spring assembly employed in the bridge assembly shown in FIG. 12.

Referring to FIGS. 12–14, the bridge assembly 24, in accordance with a preferred embodiment, includes a lower spring assembly 124 for urging the bottom of the latch mechanisms 80 upwardly, so that the tops of the latch members 84 remain in contact with the lower ends of the tuning screws 94. Thus, since the latch mechanisms 80 are secured to the end of the saddle base members 58, when the string tension is removed (which naturally urges the latch mechanisms 80 into contact with the tuning screws 94), the latch members 84 will stay in contact with the tuning screws 94 by virtue of the spring assembly 124.

Preferably, the spring assembly 124 comprises a leaf spring plate, which is shown in a side view in FIG. 13 and a top view in FIG. 14. The spring assembly 124 is preferably manufactured from a suitable metal sheet that retains flexibility so that it can function as a spring. By way of example only, a thin piece of sheet metal can be used. The spring assembly 124 includes a base section 125 and a plurality of spring sections 126. The side view of the spring section 126 of the spring assembly 124 is illustrative of the structure of each of the spring sections 126. The spring section 126 includes an upwardly extending section **126*a* and a curled section 126*b*. The base of the leaf spring assembly 124** includes holes 128 that are used for assembling the spring assembly 124 to the bridge assembly 24, between the lower surface of the bridge base 52 and a downwardly depending block member 130 which may be secured to the bridge base 52 by suitable fasteners. More particularly, the bridge base 52 is connected to the depending block member 130 with fasteners which are inserted through holes 129 provided in the bridge base 52 (see FIG. 7) and then through appropriate holes 128, respectively, in the spring assembly 124, and into respective threaded holes (not shown) in the block member 130.

Figure 15:
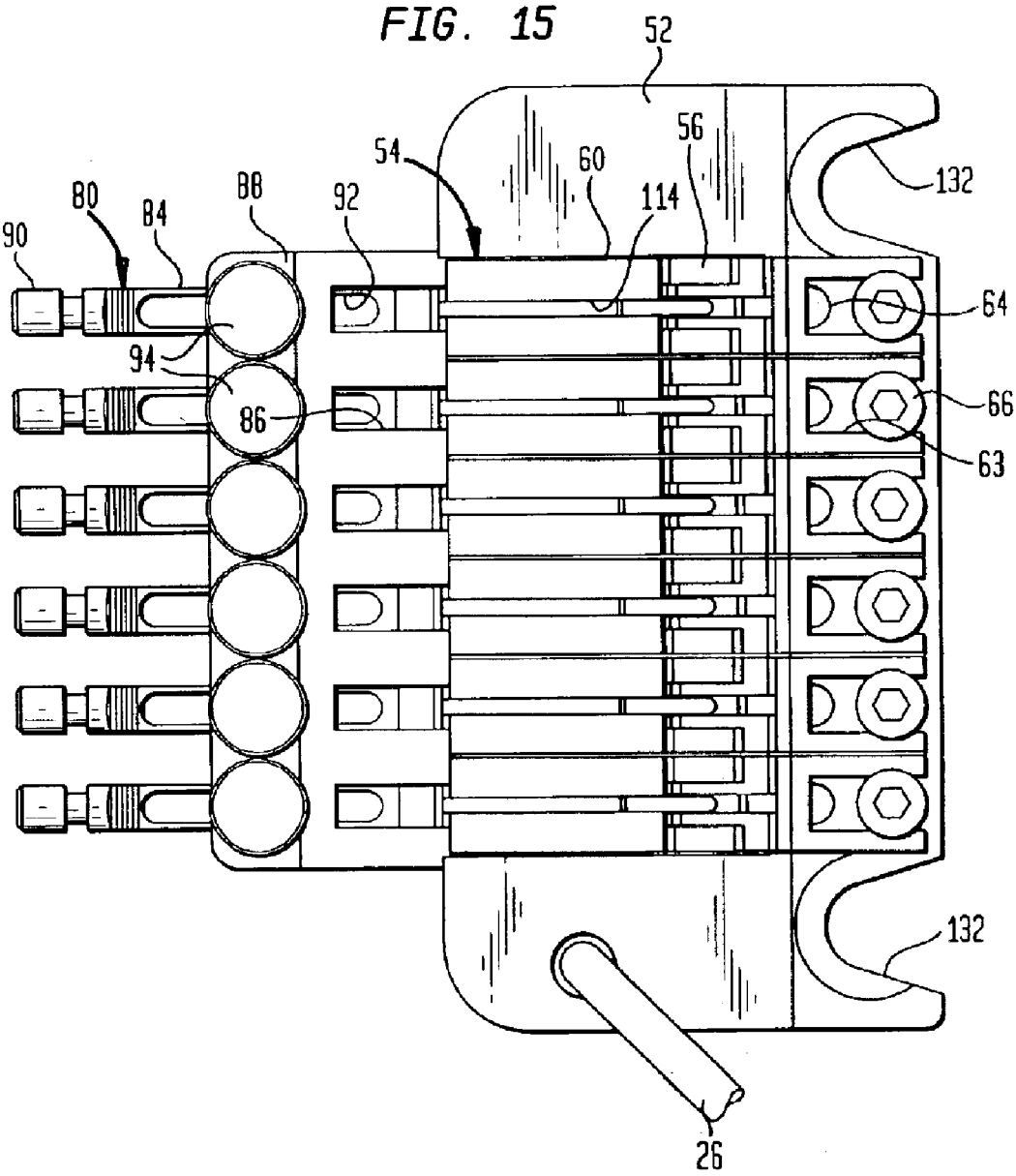
FIG. 15 is a plan view of the bridge assembly shown in FIG. 12, illustrating how the bridge base would be mounted to a guitar.

In a preferred embodiment, the bridge base 52 includes a pair of slots 132 at its forward end (see FIGS. 7 and 15) in the bridge base 52, which are adapted to rest on indented sections of upstanding posts 134 mounted to the guitar body 14. This is illustrated in FIGS. 12 and 15, which show the bridge assembly 24 attached to the guitar 10.

Figure 16:
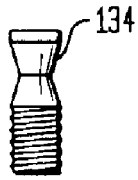
FIG. 16 is a side elevational view showing a mounting post employed for mounting the bridge assembly to the guitar as shown in FIGS. 12 and 15.

Also, in accordance with a preferred embodiment of the present invention, the bridge assembly 24 comprises a tremolo bridge assembly which may be used to simultaneously momentarily release the tension on all of the strings 12 to provide special sound effects. In accordance with this embodiment, the bridge assembly 24 is inserted into a cavity 136 provided in the body 14 of the guitar 10 such that the forward slots 132 in the bridge base 52 rest against the indented sections of the posts 134 secured in the instrument body 14. The two slots 132 and the posts 134 are both preferably beveled. The indented sections of the posts 34 guide the movement of the bridge base 52 when the tremolo bar 26 is depressed. One of the posts 134 is illustrated in FIG. 16.

In order to provide a tremolo action, a plurality of springs 138, one of which is illustrated in FIG. 12, are connected at one end to the lower part of the depending block 130, and on the other end to a metal bar that is secured to the guitar 10 within the cavity 136. By depressing the tremolo bar 26, the bridge assembly 24 is pivoted about the upstanding posts 134, against the action of the springs 138, and the tension on all of the strings 12 is momentarily and simultaneously released to provide special sound effects. When the tremolo bar 26 is released, the springs 138 serve to return the bridge base 52 to its normal equilibrium position in which the spring force is balanced against the string force.

Of course, the present invention can be used with other types of tremolo apparatus, including but not limited to those disclosed in U.S. Pat. Nos. 4,549,461, 4,497,236 and 4,967,631. Also, it should be appreciated that the string holder assemblies 54 and the associated structures as described above, can be used on bridge assemblies that do not include a tremolo apparatus.

Removal of the guitar strings 12 is accomplished one string 12 at a time from the nut assembly 22 and the bridge assembly 24. To remove a string 12, one would preferably press down with a finger on the string holder assembly 54 on the bridge assembly 24 and draw the respective sliding latch member 84 away from the saddle pivot member 60. When the pressure on the saddle pivot member 60 is released while the sliding latch member 84 is held back, the saddle pivot member 60 pops up, as shown in FIG. 10, due to the upward pressure exerted on the saddle pivot member 60 by the string 12. The bullet 30 being retained by the saddle pivot member 60 can then be pulled out of the cavity 112 in the saddle pivot member 60. Also, the bullet 30 being retained by the corresponding cavity 38 in the nut assembly 22 can also be removed, to completely remove the string 12. Then bullets 30 from a new string 12 can be inserted in the respective cavities 38, 112 in the nut assembly 22 and in the bridge assembly 24. Pressing down on the saddle pivot member 60 puts tension on the string 12 being retained. The saddle pivot member 60 continues to be pressed down until the saddle pivot member 60 is placed in its lower position relative to the saddle base member 58. When moved to this position, the associated latch member 84 is forced back to allow the ledge 108 to move past the lip 102, and then moves forward to its latched position with the lip 102 overlying the ledge 108. The saddle pivot member 60 is then held in place by virtue of the interface and interlocking of the forward lip 102 and the protruding ledge 108. Each of the string holder assemblies 54 and the respective sliding latch mechanisms 80 are operated similarly to replace all of the strings 12 in the guitar 10.

While the attachment of the bridge assembly 24, and the associated components, to the guitar 10 has been described where a tremolo apparatus is used, it should be appreciated that the various aspects of the present invention can easily be used on bridge assemblies where there is no tremolo apparatus. Thus, the connection of the bridge assembly 24 to the guitar 10 illustrated in FIGS. 12 and 15–16 is merely illustrative. The string retention components described herein can be used with a wide variety of bridge assemblies, and can also be provided as retrofit components for various bridge assemblies.

Also, the string retention components illustrated in the bridge assembly 24 can be incorporated in the nut assembly. Thus, the string holder assembly 54, the support bars 82 and the sliding latch members 84, along with the associated components that interface with these components, could be provided in the nut assembly. In this case, any bridge assembly could be used in connection with the nut assembly that incorporates the string retention components.

Turning now to FIGS. 20–31, there is shown another embodiment of an electric guitar type of stringed musical instrument 150 in accordance with another aspect of the present invention. As with the embodiment shown in FIGS. 1–19, this embodiment of the present invention can also be used with various other types of stringed musical instruments, including, but not limited to, acoustic guitars, violins, banjos and the like, wherein the associated strings need to be replaced at various times during the life of the instrument. Also, the electric guitar 150 shown in FIG. 20 would likewise typically include all of the normal accessories that can be found on an electric guitar, although not illustrated in FIG. 20.

In contrast to the bridge assembly 24 shown with reference to FIGS. 6–19, in which the individual string holder assemblies 54 are each provided with individual latch mechanisms 80 for releasing the tension on the string 12 held thereby, the bridge assembly 160 on the electric guitar 150, shown with reference to FIGS. 20–31, is a quick release-type bridge assembly which is operative to secure the ends of the strings 12 of the instrument 150 and allow them to be placed under tension to enable play of the instrument 150, but which is also adapted to quickly release the tension on all of the strings 12 to enable them to be easily and quickly replaced. Once the strings 12 are replaced, the bridge assembly can then be moved into position on the guitar body 152 so that the strings 12 are again placed under tension and then retuned to enable play. Moreover, in accordance with a preferred embodiment, the bridge assembly 160 itself may be easily and quickly removed from the instrument body 152, and also quickly and easily re-assembled on the instrument body 152 after replacement of the strings 12.

Also, in accordance with yet a further aspect of the present invention, the bridge assembly 160 shown with reference to FIGS. 20–31 includes a tuning apparatus for the plurality of the strings 12 of the instrument 150, which enables quick and easy tuning of the strings 12. Still further, advantageously, the tuning system employed on the bridge assembly shown with reference to FIGS. 20–31, may incorporate convergent tuning principles such as that shown and described in U.S. Pat. No. 5,717,150, by which both harmonic tuning and pitch tuning can be accomplished substantially simultaneously by the user of the guitar 150. In this regard, in order to achieve substantially simultaneous harmonic and pitch tuning of the strings 12, each of the guitar strings 12 is cut to a respective, predetermined length. When each of the strings 12 is cut to the proper length and then retained in place in the nut assembly 156 and the bridge assembly 160 on the guitar 150, harmonic and pitch tuning of each string 12 can be obtained substantially simultaneously by moving the string holding assemblies 164 on the bridge assembly 160 (or on the nut assembly 156), as described at length in the aforementioned U.S. Pat. No. 5,717,150. The particular manner of accomplishing such convergent tuning with the bridge assembly 160 shown in FIGS. 20–31 is discussed more fully hereinbelow.

Again, as with the embodiment of the present invention shown with reference to FIGS. 1–19, the guitar 150 includes an instrument body 152 and a neck 154, with a fretboard 155 arranged on the neck 154 and with a plurality of strings 12 mounted to extend between a nut assembly 156 at or adjacent to the head 158 of the guitar 150 and a bridge assembly 160 mounted on the body 152 of the guitar 150. Also, the strings 12 are the same type of strings 12 as illustrated in greater detail in FIG. 2, i.e., having bullets 30 or other string anchor members provided at each end of the strings 12. Preferably, the string anchors comprise bullet-shaped string anchors 30 attached to each of the guitar strings 12 at the two opposite ends.

Figure 20:
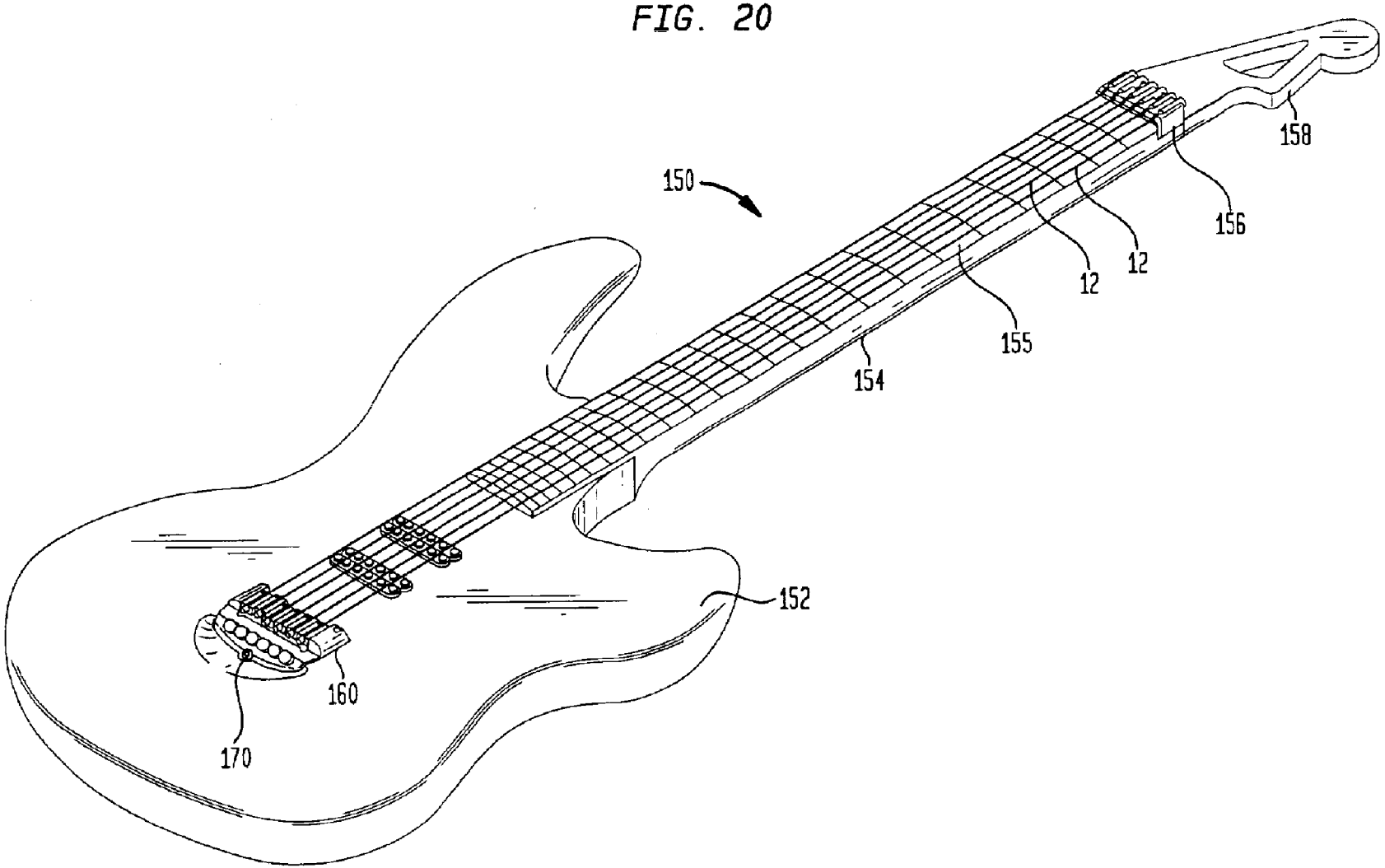
FIG. 20 is a perspective view of an electric guitar type of stringed musical instrument having another embodiment of a bridge assembly in accordance with another aspect of the present invention.

The guitar strings 12 are adapted to be retained in place on the guitar 150 by having the bullets 30 at one end of the guitar strings 12 held in a string holder assembly of the nut assembly 156 at the head 158 of the guitar 150 and in a series of string holder assemblies 164 provided on the bridge assembly 160 mounted on the body 152 of the guitar 150. The nut assembly 156 of the guitar shown in FIG. 20 is the same as the nut assembly 22 on the guitar 10 of FIG. 1 and as shown and described with reference to FIGS. 3–5, and reference should be made thereto accordingly.

The overall bridge assembly 160 is shown in FIGS. 21–25 and 28, and various components thereof or associated therewith are shown in FIGS. 26, 27, 29A, 29B and 30–31. As in the case of the bridge assembly 24 used on the guitar 10 of FIG. 1, the term "bridge assembly" is used to refer generally to the entire assembly having the critical contact points or surfaces for one end of the strings 12 and includes the tuning apparatus or system for tuning of the strings 12. Moreover, although the bridge assembly 160 is shown for use with a nut assembly 156 of the type illustrated in FIGS. 3–5 and for use with strings 12 such as those shown in FIG. 2, it should be appreciated that the bridge assembly 160 could be used with other types of nut assemblies and with strings having other types of anchor assemblies with suitable modification of certain of the string retention components, and could even be used with strings having no anchor or termination members thereon. Also, although the bridge assembly 160 comprises a generally fixed bridge assembly (to be distinguished from or contrasted with a tremolo type bridge assembly), it should be appreciated that the bridge assembly, with suitable modification, could be used as part of a tremolo bridge assembly for electric guitars. Still further, the bridge assembly 160 could also be used on acoustic guitars.

Figure 21:
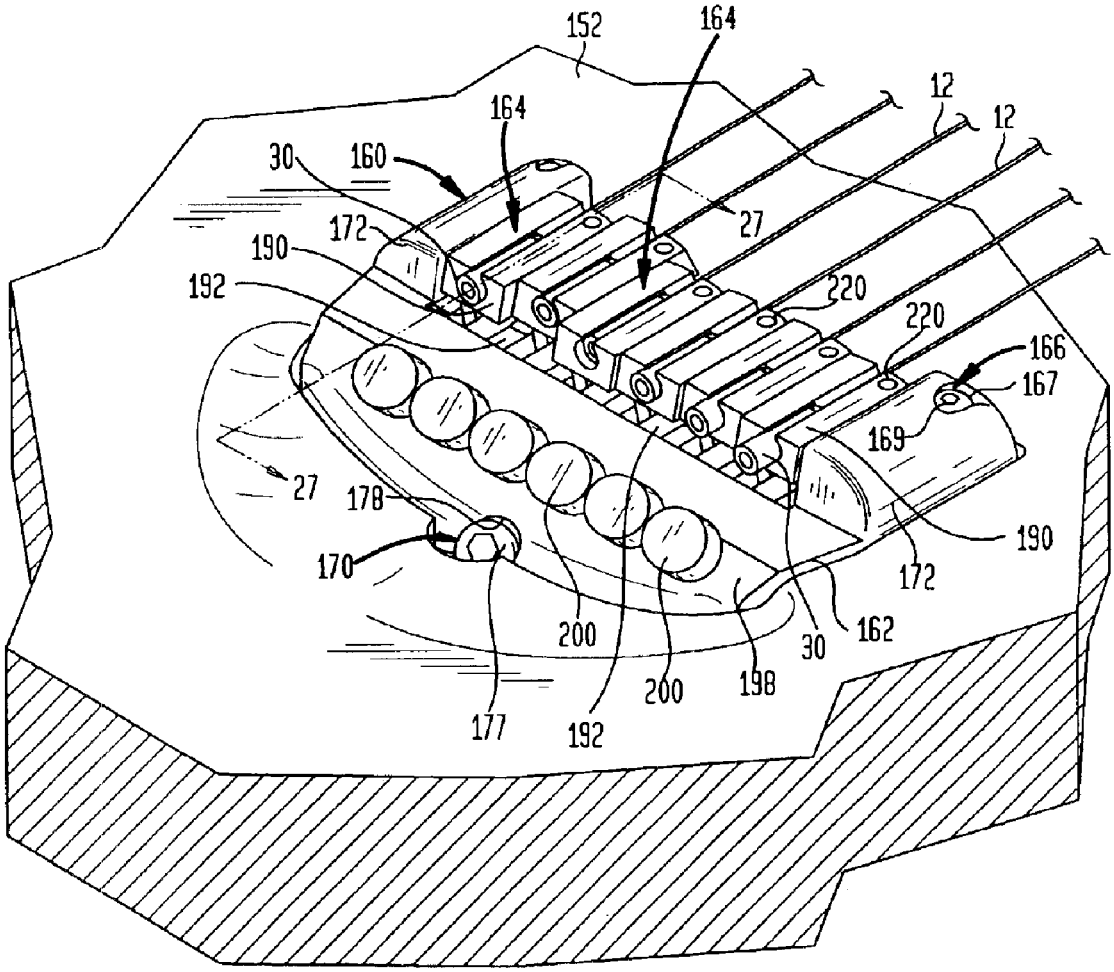
FIG. 21 is an enlarged perspective view of the bridge assembly mounted on the guitar of FIG. 20.

Referring to FIG. 21, the bridge assembly 160 includes a bridge base 162 having a plurality of individually adjustable string holder assemblies 164 for securing one end of the strings 12 of the instrument 150. In terms of the particular embodiment shown in FIG. 21, there are six string holder assemblies 164, each of which is identical to one another and which serve to hold one end of a string 12. The string holder assemblies 164 used on the bridge base 162 will be described more fully hereinbelow.

The bridge base 162 is adapted to be mounted to the guitar body 152, in a preferred embodiment, using a pair of upstanding support post assemblies 166 for supporting the front edge of the base 162 and a latch mechanism 170 at the rear back edge of the bridge base 162. The two forward support post assemblies 166 each include a bushing 165 secured in the guitar body 152 and an upstanding threaded post member 168 which may be threadably received within the bushing 165. The threaded post member 168 includes an upper spherical ball portion 167 having a hexagonally shaped recess 169 in the top end which is engageable by a suitable allen-wrench or other instrument for rotating the post member 168 within the support bushing 165 to adjust the height of the ball portion 167 above the surface of the instrument body, and thus, the height of the bridge assembly 160 supported thereby.

In a preferred embodiment, the bridge base 162 is provided with a pair of horizontally spaced side housings or shoulders 172 along the front portion thereof, with a support area 174 for the plurality of string holder assemblies 164 provided between the housings 172. The housings 172 are each provided with a recess 173, 175 along the front thereof for receipt of one of the upstanding support post assemblies 166. In this regard, the housings 172 preferably each include a spherically-shaped recess 173 for receipt of the ball portion 167 of one of the threaded post members 168, as well as a flared recess section 175 therebelow to enable the post members 168 to extend freely downward to be received in their respective support bushings 165.

The spherical recess and ball-type support serve to support the front of the bridge assembly 160 in a manner to allow the bridge assembly 160 to freely pivot about the spherical ball portions 167 about an axis that is generally transverse to the longitudinal extent of the strings 12, i.e. an axis that is transverse to the direction along which the strings 12 extend. The bridge assembly 160 is thus adapted to rotate or pivot in a manner similar to that of a tremolo bridge assembly, except that in the embodiment of the bridge assembly 160 shown with reference to FIGS. 21–25, the front edge of the bridge assembly 160 does not pivot along typical knife edge-type supports, but rather pivots about the spherical ball portions 167 provided on the post members 168. By virtue of having a ball-type support, it is not necessary for the post members 168 each be at the same height above the surface of the guitar body 152, or for the bridge assembly 160 to be supported so as to be generally parallel to the surface of the body 152; rather, the bridge assembly 160 may be canted so as to be lower along one side edge relative to the surface of the instrument body 152 in comparison to the height of the other side of the bridge assembly 164 relative to the body 152. This may be desired by some types of guitar players. At the same time, a stable support for the bridge assembly 160 is still provided.

A bridge latch mechanism 170 is provided for supporting the rear or back of the bridge assembly 160. In a preferred embodiment, the bridge latch mechanism 170 is comprised of a latching post member 176 secured in a bottom recess of the guitar body 152 and extending upwardly therefrom in a generally rearward direction so as to be received in a rear latching recess 178 provided on the back edge of the bridge base 162. Preferably, the latching post member 176 has a spherical head 177 thereon, and the recess 178 provided in the bridge base 162 is spherically shaped so that the head 177 may be matingly received in the recess 178.

In accordance with a preferred embodiment, the bottom of the latching post member 176 is supported on the instrument body 152 for pivotable movement about an axis extending transverse to the longitudinal extent or direction of the strings 12. It will be appreciated that this axis is generally parallel to the axis about which the front edge of the bridge assembly 160 is designed to pivot. This enables the post member 176 to pivot backwardly and downwardly away from the bridge assembly 160. Preferably, the latching post member 176 is threadably received within the lower pivotable support mechanism secured in the recess in the body 152 so that the height of the post member 176, and in particular the spherical head 177 thereof, relative to the surface of the instrument body 152 may be easily adjusted. This adjustability can be used to adjust the height of the rear edge of the bridge assembly, in a manner to be described hereinbelow.

Figure 25:
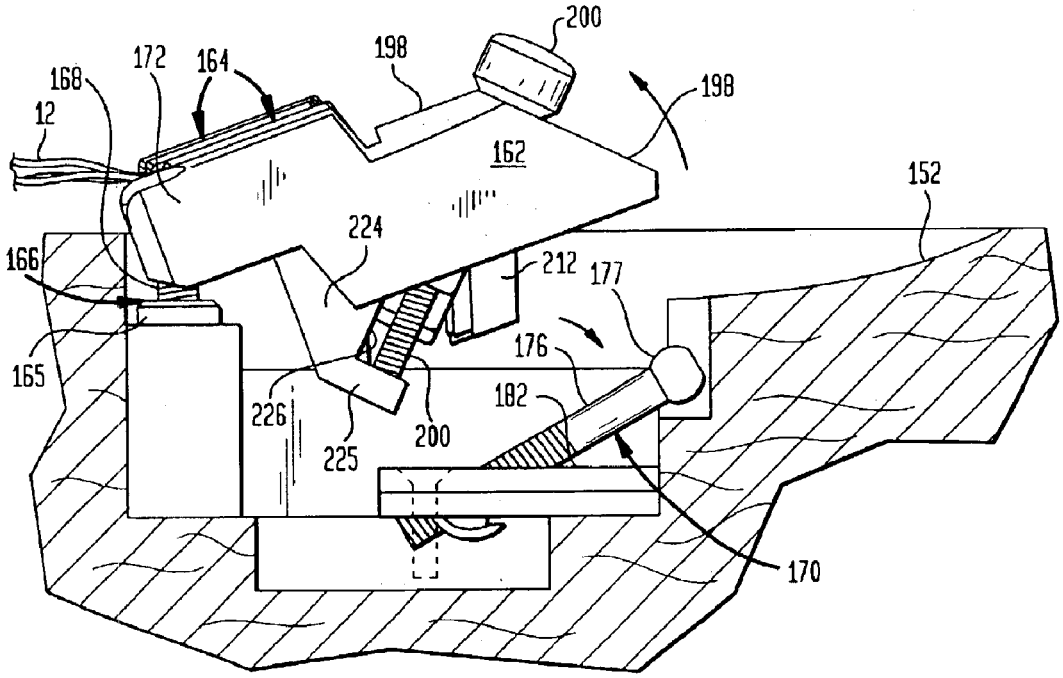
FIG. 25 is a side elevational view of the bridge assembly of FIG. 21 mounted on a guitar, similar to that shown in FIG. 24, but with the bridge assembly in a released position to release the tension on the strings.
Figure 26:
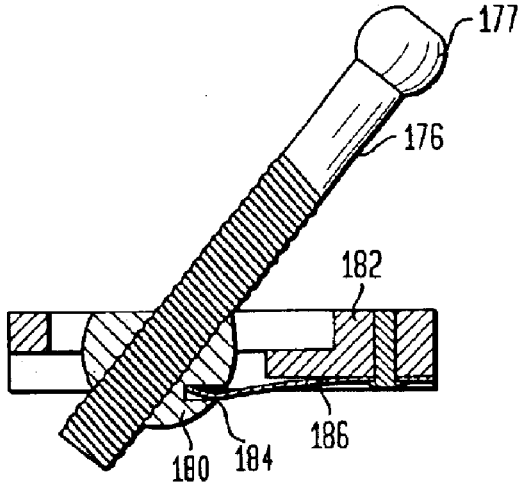
FIG. 26 is a side elevational view, taken along line 26—26 of FIG. 23, illustrating the latch mechanism employed with the bridge assembly shown in FIG. 21.

In order to support the latching post member 176 for both axial and pivotal movement, in a preferred embodiment, the end of the latching post member 176 is threadably received in a pivotable ball member 180 which is journaled in a bottom support bracket 182 for rotation or pivoting motion about a transverse axis. The pivotable ball member 180 has a slot 184 therein to receive an end of a leaf spring 186 secured to the bottom of the support bracket 182. By virtue of the leaf spring 186 being arranged at one end in the slot 184 and being secured at the other end to the support bracket 182, the leaf spring 186 acts as a stop to prevent forward rotation of the pivotable ball member 180, and thus the latching post member 176, beyond a certain desired fixed position (i.e., to prevent further counterclockwise rotation past the position shown in FIG. 26). The leaf spring 186 allows pivoting of the post member 176 downwardly (i.e., it permits clockwise rotation as viewed in FIG. 26), and then acts as a spring to return the latching post member 176 to its rest position. That is, when the latching post member 176 is pivoted downwardly, as shown in FIG. 25, the leaf spring 186 is deflected from its rest position so that when the force moving the latching post member 176 downwardly is released, the leaf spring 186 will return the latching post member 176 to its raised position (i.e., to the position shown in FIG. 26).

Figure 24:
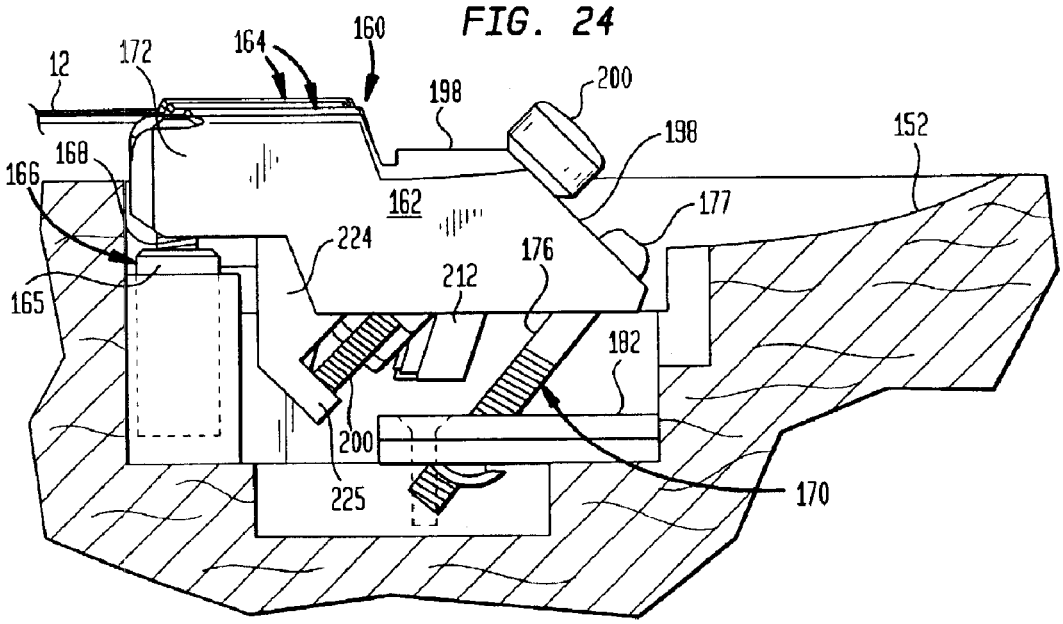
FIG. 24 is a side elevational view of the bridge assembly of FIG. 21 mounted on a guitar, with the bridge assembly in a latched position for play of the instrument.

As best seen in FIGS. 21, 24, 25 and 28, the bridge latch mechanism 170 is mounted in the bottom of a recess provided in the instrument body 152, and arranged to have the spherical head 177 of the latching post member 176 received in the rear recess 178 of the bridge base 162. When the bridge assembly 160 is mounted to the instrument body 152 and the strings 12 are secured in the string holder assemblies 164 on the bridge base 167, and placed under tension, the strings 12 exert a force on the bridge assembly 160 that would cause the bridge assembly 160, if it were not held, to pivot about the front support post assemblies 166 with the rear end being raised (i.e., in the counterclockwise direction in FIGS. 24–25). The bridge latch mechanism 170 is designed to hold the rear end of the bridge assembly 160 down, and thus maintain the tension on the strings 12. This position is shown in FIGS. 21 and 24. The exact position of the rear of the bridge base 162, and thus the orientation of the bridge assembly 160 on the instrument body 152, can be controlled by the extent that the latching post member 176 extends out of the pivotable ball member 180. In this regard, the spherical ball head 177 of the latching post member 176 preferably includes a suitable recess, such as a hex-shaped recess, to receive an allen-wrench or other tool to effect such adjustment.

It will thus be appreciated that the bridge assembly 160 is maintained in the desired position by virtue of the tension placed on the bridge assembly 160 by the strings 12 as resisted by the bridge latch mechanism 170. However, the rear portion of the bridge assembly 160 may be pushed downwardly to a small extent, thus increasing the tension on the strings 12 slightly, to allow release of the ball head 177 of the latching post member 176 from the spherical recess 178 in the rear or back edge of the bridge base 162. In other words, the rear of the bridge base 162 can be depressed slightly and the latching post member 176 then pivoted rearwardly to allow the bridge assembly 160 to raise, thus clearing the head 177 on the latching post member 176. This is illustrated in FIG. 25. When this occurs, the bridge assembly 160 is free to pivot about the forward support post assemblies 166, thereby releasing the tension on the strings 12 as will be described hereinbelow. When the bridge assembly 160 is in its raised position and the tension on the strings 12 is released, replacement of the individual strings 12 in the string holder assemblies 164 may be easily accomplished simply by sliding out the string anchors 30 from the string holder assemblies 164. Indeed, the bridge assembly 160 itself can be completely removed from the instrument 150 once it has been pivoted upwardly by simply lifting or removing the bridge base 162 from engagement with the spherical heads 167 on the support post assemblies 166.

All of this is accomplished in a very quick, simple operation by initially depressing the rear of the bridge base 162 downwardly, pivoting the latching post member 176 downwardly away from the rear of the bridge base 162 and allowing the rear of the bridge base 162 to raise. This action serves to release the tension on all of the strings 12, to thereby permit easy removal and replacement of the strings 12 and/or removal of the bridge assembly 160 from the instrument 150. When it is desired to again place the bridge assembly 160 in position for play (for example, after the strings 12 have been replaced), all that is necessary is to place the string anchors 30 on the ends of the strings 12 in the string holder assemblies 164, place the forward edge of the bridge assembly 160 on the spherical heads 167 of the support post assemblies 166 (if the bridge assembly 160 has been removed), and then pivot the rear of the bridge assembly 160 downwardly.

By virtue of the angled position of the latching post member 176 and the spring-biased support arrangement, pushing the rear edge of the bridge base 162 downwardly will cause the latching post member 176 to pivot rearwardly out of the way until the edges of the bridge base 162 adjacent to the spherical recess 178 clear the head 177 of the latching post member 176. Once the rear of the bridge base 162 clears the head 177 of the latching post member 176, the spring-biased latching post member 176 returns to its raised or rest position and is received in the recess 178. Release of the rear of the bridge base 167 then firmly seats the head 177 in the spherical recess 178 and returns the bridge base 162 to its desired support position for tuning of the strings 12 and play of the instrument 150.

It will thus be appreciated that there is provided a bridge support mechanism for mounting of a bridge assembly 160 to the instrument body 152 in which the support mechanism includes bridge engagement portions 166 for engagement with the bridge base 162 of the bridge assembly 160 to support the bridge base 167 in a desired position on the instrument body 152. A latch mechanism 170 is carried by either the bridge base 167 or the body 152 of the instrument 150 and is releasably engageable with the other of the bridge base 162 or instrument body 152 to thereby support the bridge assembly 160 on the instrument body 152. The latch mechanism 170 is operative to be positioned in a latching position and a release position. When in the latching position, the latch mechanism 170 secures the bridge base 162 in mating engagement with the bridge support mechanism 166 so that the strings 12 secured in the string holder assemblies 164 on the bridge assembly 160 are under tension on the instrument body 152 to permit play of the instrument 150. When the latch mechanism 170 is in its release position, it permits movement of the bridge base 167 relative to the bridge support mechanism 166 to release the tension on the strings 12, and thereby permit disengagement of the bridge base 162 from the bridge support mechanism 166.

It will also be appreciated that the position or orientation that the bridge assembly 160 is supported can be adjusted quite easily by adjusting the height of the forward bridge support posts 168 and/or the height of the rear latch mechanism 170 so as to enable positioning of the bridge assembly 160 in virtually any position that may be desired by the guitar player. The support area 174 for the string holder assemblies 164 can be arranged to be parallel to the surface of the guitar body 152, or can be canted side-to-side and/or front-to-back in virtually any position that may be desired. It should also be appreciated that with the support mechanism as shown in this embodiment, a three-point support arrangement for the bridge assembly 160 is provided. However, it will also be appreciated that additional support arrangements could be provided as well. For instance, a pair of rear latching posts could be provided if desired. Also, as will be described hereinbelow with reference to FIGS. 32–34, although the front edge of the bridge assembly 160 has been shown to be supported by means of a pair of upstanding post assemblies 166, the post assemblies 166 could be replaced simply by suitable side support mechanisms, with, the bridge assembly being secured to the instrument body by a single latch member which releasably secures the rear portion of the bridge assembly to the body. Still further, with suitable types of mechanical linkage systems, it is not even necessary that the latch mechanism secure the rear portion of the bridge assembly to the instrument body, but rather the latch mechanism could secure the side or even the front portions of the bridge assembly to the instrument.

Turning now to the string holder assemblies 164 for securing one end of each of the strings 12 to the bridge assembly 160, each of the string holder assemblies 164 is mounted so that its position on the bridge assembly 160 can be adjusted longitudinally (i.e., in the direction that the string extends) to adjust the tension on the string 12. More particularly, in accordance with a preferred embodiment, each of the string holder assemblies 164 includes a string saddle or retention member 190 which is pivotally mounted to a string slide or saddle pull member 192, which in turn is slideably supported on the support area 174 of the bridge base 162 intermediate the side housings 172. As explained more fully hereinbelow, it is the string slide member 192 whose position is adjusted to adjust the tension of the string 12 held by its string retention member 190 to thus tune the string 12.

Figure 22:
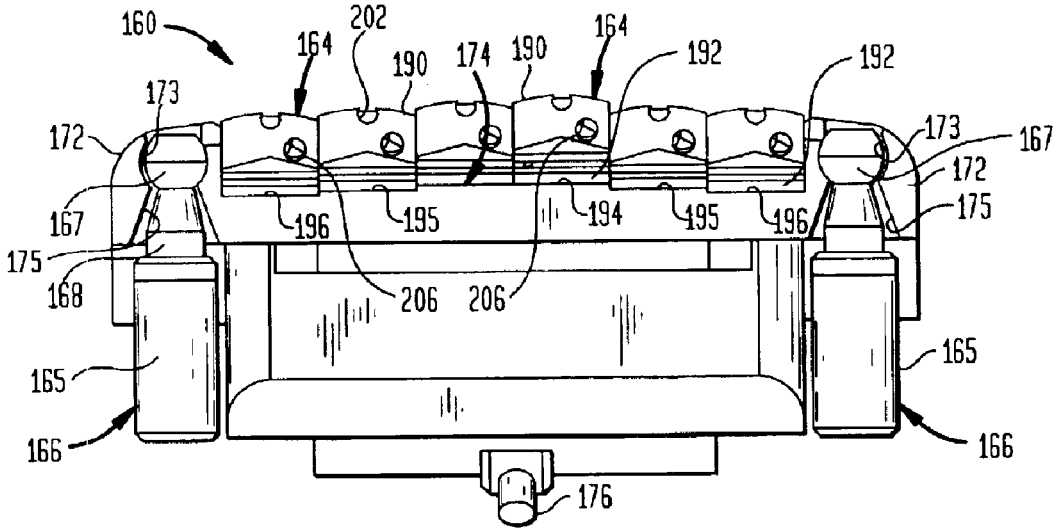
FIG. 22 is an enlarged front elevational view of the bridge assembly of FIG. 21.
Figure 23:
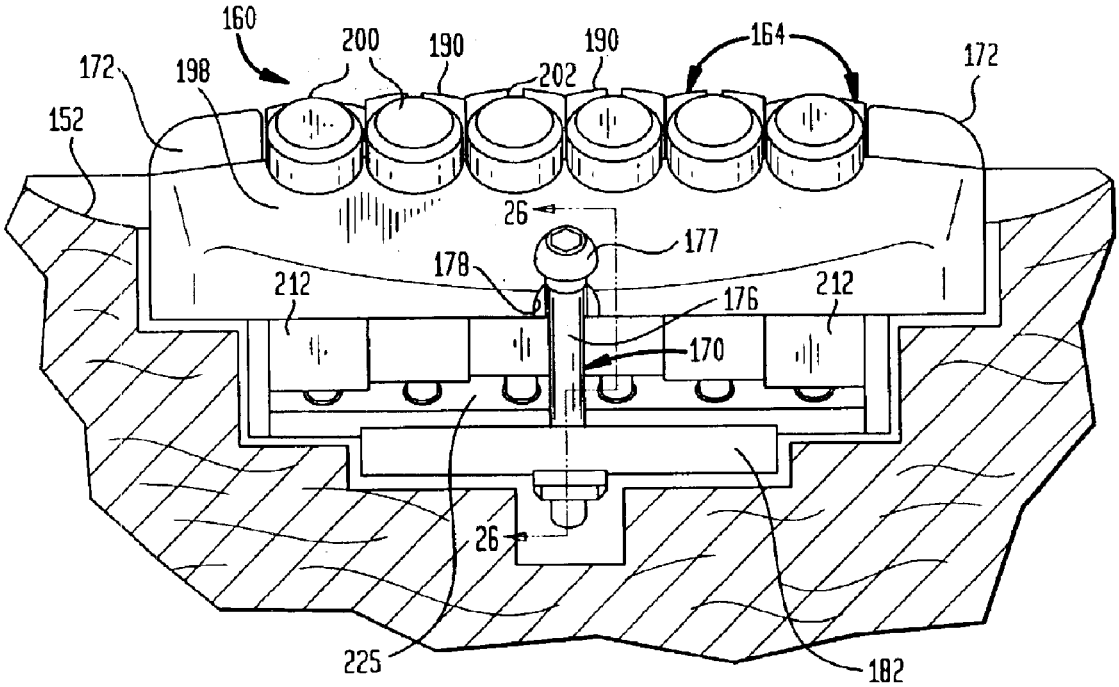
FIG. 23 is an enlarged rear elevational view of the bridge assembly of FIG. 21 mounted on a guitar.

In accordance with a preferred embodiment, the bridge base 162 includes a support area 174 comprised of a laterally extending shelf system between the side housings 172 which includes three sets of shelf segments 194, 195, 196, at different elevations, which serve as the support surfaces for the individual string holder assemblies 164. This is best seen in FIG. 22. The highest shelf segment 194 is provided in the lateral center and has a width corresponding to the width of two string holder assemblies 164. The next lower shelf segments 195 are on either side of the center or highest shelf segment 194, and the lowest shelf segments 196 are on the outer lateral sides of the lateral shelf segment 195. This arrangement of shelf segments for the individual string holders assemblies 164 provides an approximation of the shape of the fretboard 155, which typically has a curved upper surface along its entire longitudinal extent, with the center of the fretboard 155 being at the highest elevation and the lateral sides of the fretboard 155 being at the lowest elevation. The shelf segments 194, 195, 196 on the bridge assembly 160 are intended to approximate that type of profile.

Behind the lateral shelf system, the bridge base 162 is open to allow the rear portions of the string holder assemblies 164 to extend downwardly therethrough, where downwardly extending members or legs of the string holder assemblies 164 are adapted to be engaged by tuning adjustment members 200 to adjust the relative position of the string holder assemblies 164 on the bridge base 162. Finally, the bridge base 162 includes a rear, upwardly extending flange 198 which supports the plurality of individual tuning adjustment screws 200 for tuning of the strings 12 for proper harmonic and pitch tuning in accordance with the preferred embodiment.

Figure 30:
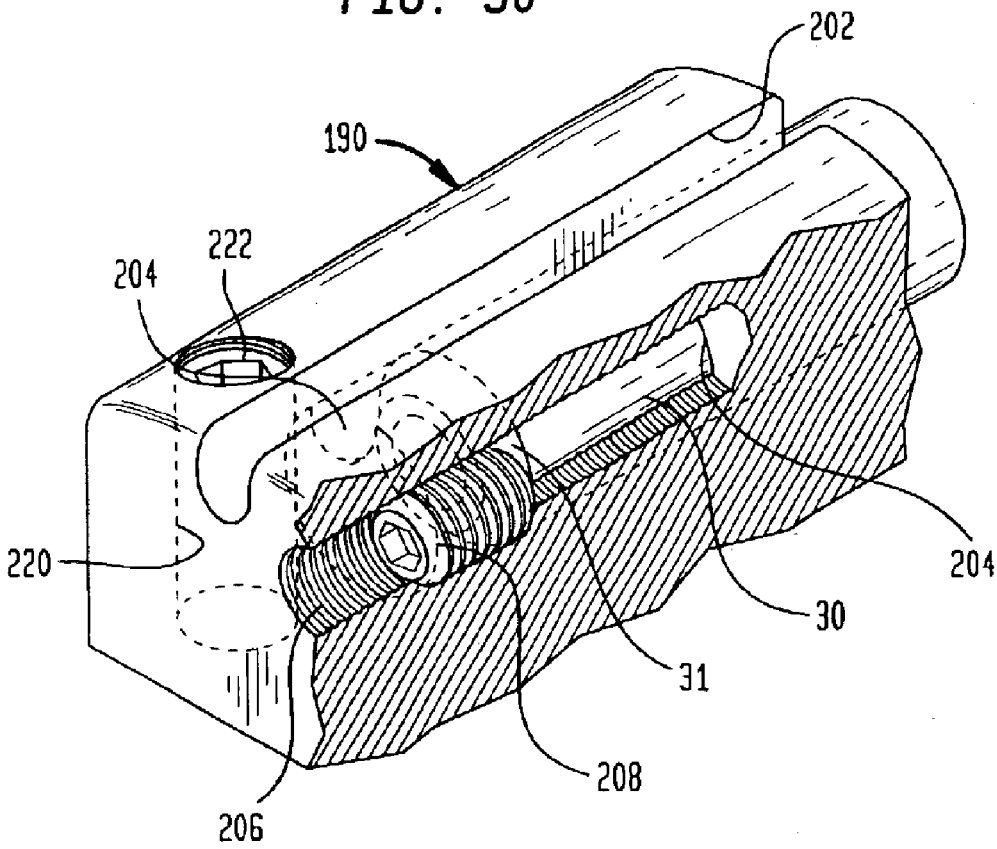
FIG. 30 is an enlarged perspective view, partially broken away, of the string retention component of the string holder assembly of the bridge assembly shown in FIG. 21.
Figure 31:
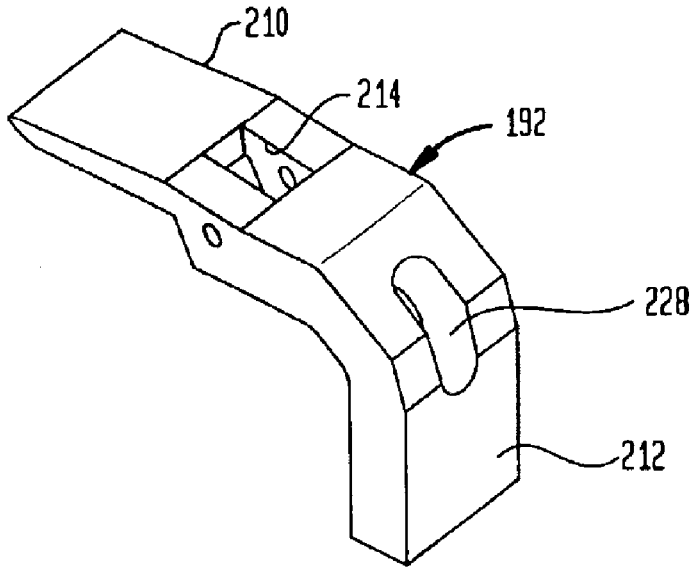
FIG. 31 is an enlarged perspective view of the saddle slide component employed in the string holder assembly of the bridge assembly of FIG. 21.

One of the string retention members 190 is more fully shown in FIG. 30, and its associated string slide member 192 is shown in FIG. 31. Each of the string retention members 190 includes a forward slot or channel 202 for the strings 12 and a rearwardly extending cylindrical chamber or cavity 204 for receiving the end of the bullet-shaped anchor 30, with the string 12 extending forwardly to pass through the slot or channel 202. As in the case of the string retention members 60 in the embodiment shown with reference to FIGS. 1 to 19, a threaded hole 206 is provided in the front end of each string retention member 190 that runs parallel to the bullet-shaped cylindrical chamber 204. An allen-head bolt or screw 208 is inserted into the hole 206, and includes a beveled end which is adapted to extend partially into the cylindrical chamber 204 to serve as an end stop for the bullet-shaped anchor 30 when placed in the cavity or chamber 204. In this manner, the position of the bullet 30 within the cavity 204 of the string retention member 190 can be precisely controlled.

As best seen in FIG. 31, the string slide member 192, in a preferred embodiment, is generally "L" shaped and includes an upper leg 210 and a lower, downwardly extending leg 212. The upper leg 210 is provided with a central recess 214 for pivotably mounting the string retention member 190. More particularly, as can best be seen in FIGS. 29A and 29B, the string retention member 190 includes a downwardly extending tab or ear 216 which is adapted to be received in the central recess 214 of the string slide member 192. A pin 218 extends transversely through the string slide member 192 and the tab or ear 216 so that the string retention member 190 can pivot about an axis that extends transversely to the longitudinal extent of the strings 12. It will thus be appreciated that the string retention member 190 can pivot about the pin 218 so that the front portion can be raised off of the front end of the surface of the upper leg 210 of the string slide member 192.

In this regard, each of the string retention members 190 at its forward end includes a threaded recess 220 having an allen-head bolt 222 received therein which extends vertically through the extent of the string retention member 190 so as to rest against the upper surface of the string slide member 192. Turning of the allen-head bolt 222 serves to raise or lower the forward edge of the string retention member 190 relative to the string slide member 192 (as shown, for example, in FIG. 29A; see also FIGS. 21, 22 and 30). The allen-head bolt 222 thus can be used to raise the elevation of the string over the fretboard 155, and thus adjust the "action" of the string 12. Typically, the smaller sized strings 12 will be positioned by a player so as to be closer to the fretboard than the larger sized strings 12. However, in some instances, some players may wish to adjust all of the strings 12 either to be closer to the fretboard 155, or farther away from the fretboard 155, and use of the adjustment bolts 222 can be used for that purpose.

As noted hereinabove, the string slide members 192 are adapted to be moved longitudinally forward or backward relative to the front of the bridge assembly 160 to adjust both the harmonic position of the strings 12 (defined by the string contact surface provided on the front of the slot 202 in the string retention or saddle members 190) and the tension on the strings 12 for pitch tuning. Movement of the string slide members 192 is accomplished by means of the tuning adjustment screws 200 carried on the rear flange 198 of the bridge base 162.

Figure 27:
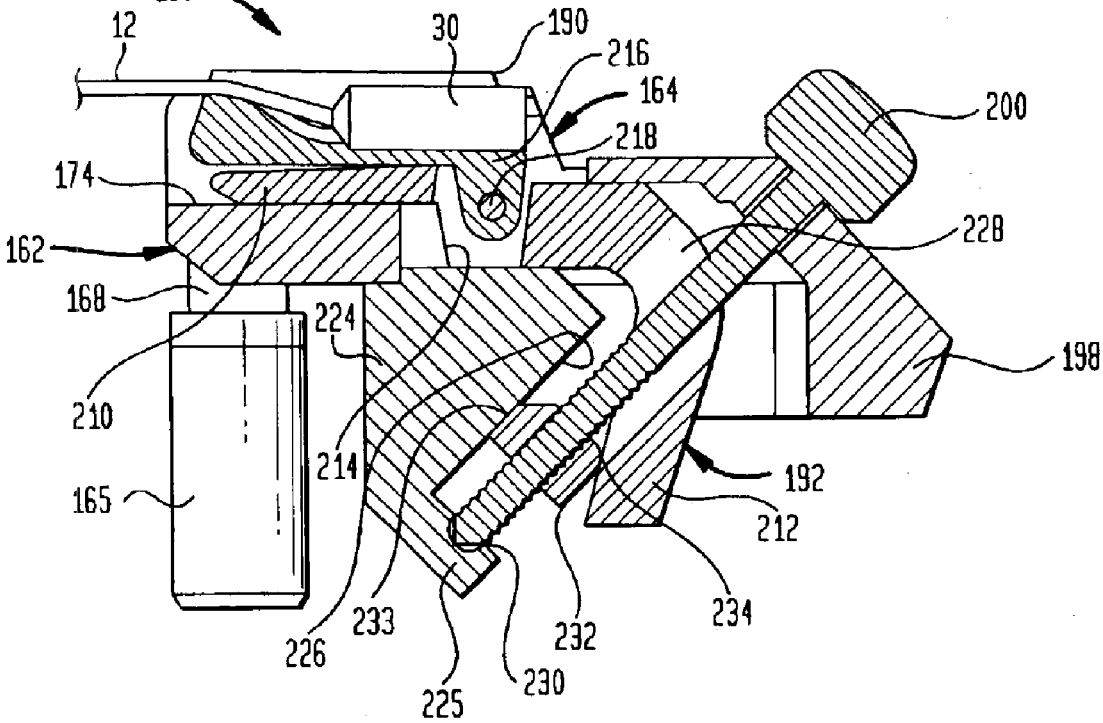
FIG. 27 is an enlarged side sectional view, taken along line 27—27 of FIG. 21.
Figure 28:
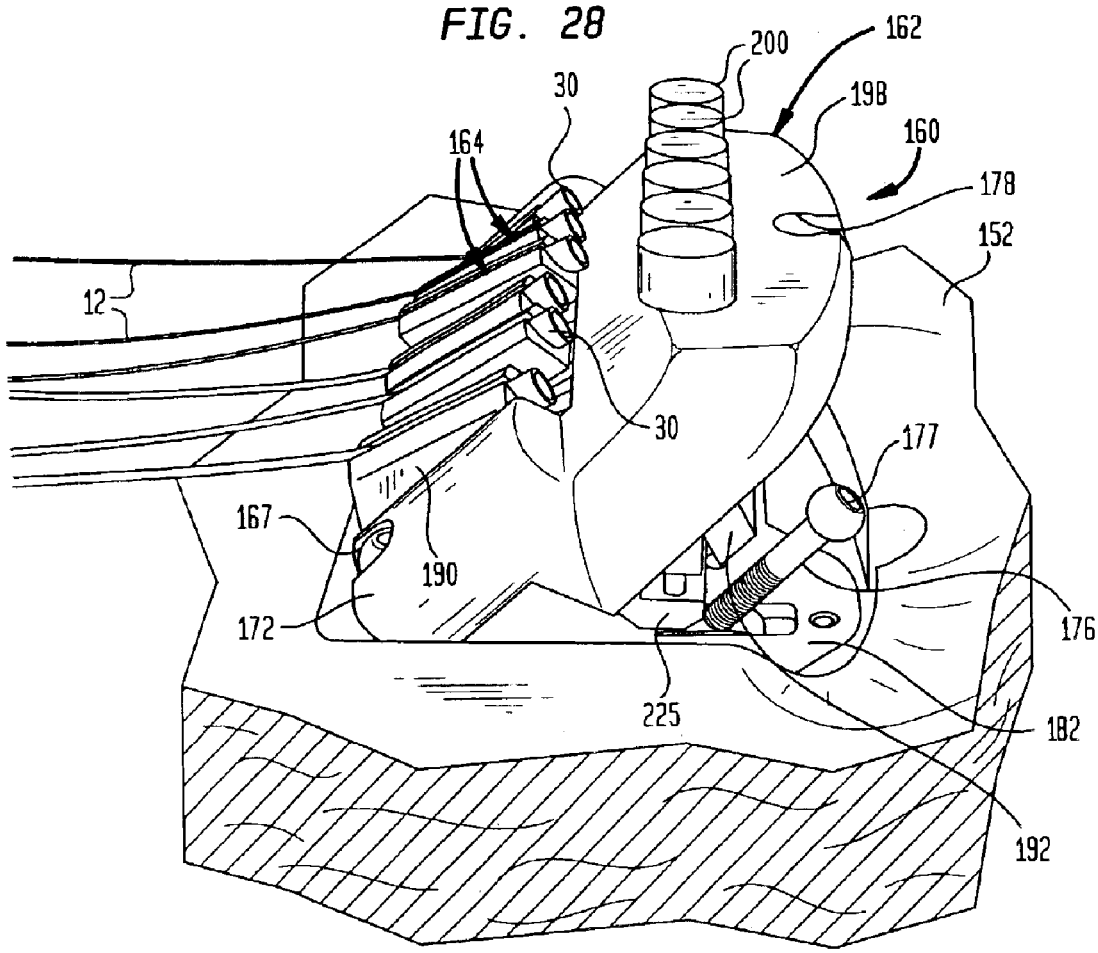
FIG. 28 is an enlarged perspective view of the bridge assembly mounted on the guitar of FIG. 20, showing the bridge assembly in a released position to release the tension on the strings.

As noted above, each of the string slide members 192 includes a downwardly extending member or leg 212. In accordance with a preferred embodiment, the downwardly extending leg 212 is not perpendicular to the upper leg 210, but rather is itself forwardly extending. This is best seen in FIG. 27. Preferably, the angle between the upper leg 210 and the downwardly extending leg 212 is in the range of 15°–90°, although other angles can also be used. The bridge base 167 includes a lower block 224, which has an inclined wall 226 that extends transversely across the bridge base 162 (see FIGS. 22 and 23). In a preferred embodiment, the angle of inclination of the inclined wall 226 is approximately 45 degrees; however, it can range between 15° and 60° relative to the top surface of the bridge base 162.

As best seen in FIGS. 27, 29A, 29B and 31, the string slide members 192 also include a central opening 228 through which its associated tuning adjustment screw 200 extends. In this regard, the adjustment screws 200 are journaled in openings on the rear flange 198 of the bridge base 162 and secured by a lock washer (not shown) or other suitable member so as to be freely rotatable in the openings in the flange 198, but still held in place so as to not be readily removable therefrom. The lower ends of the adjustment screws 200 are received in suitable indentations 230 provided in a lower extension 225 of the block 224. This is best seen, for example, in FIG. 27.

The tuning adjustment screws 200 are threaded along their length and carry a riser block 232 which is adapted to move therealong by rotation of the adjustment screws 200. The riser blocks 232 each include a slide surface 233 which is adapted to slide along the inclined wall 226 of the block 224, as well as a rounded edge surface 234 which is adapted to slide along the surface of the lower extension leg 212 of the associated string slide member 192. In this manner, each of the riser blocks 232 is arranged between the inclined wall 226 and an extension leg 212, and rotation of the associated tuning adjustment screw 200 serves to move the riser block 232 in sliding movement along both the inclined wall 226 and the downwardly extending leg 212 of the associated string slide member 192.

Figure 29A:
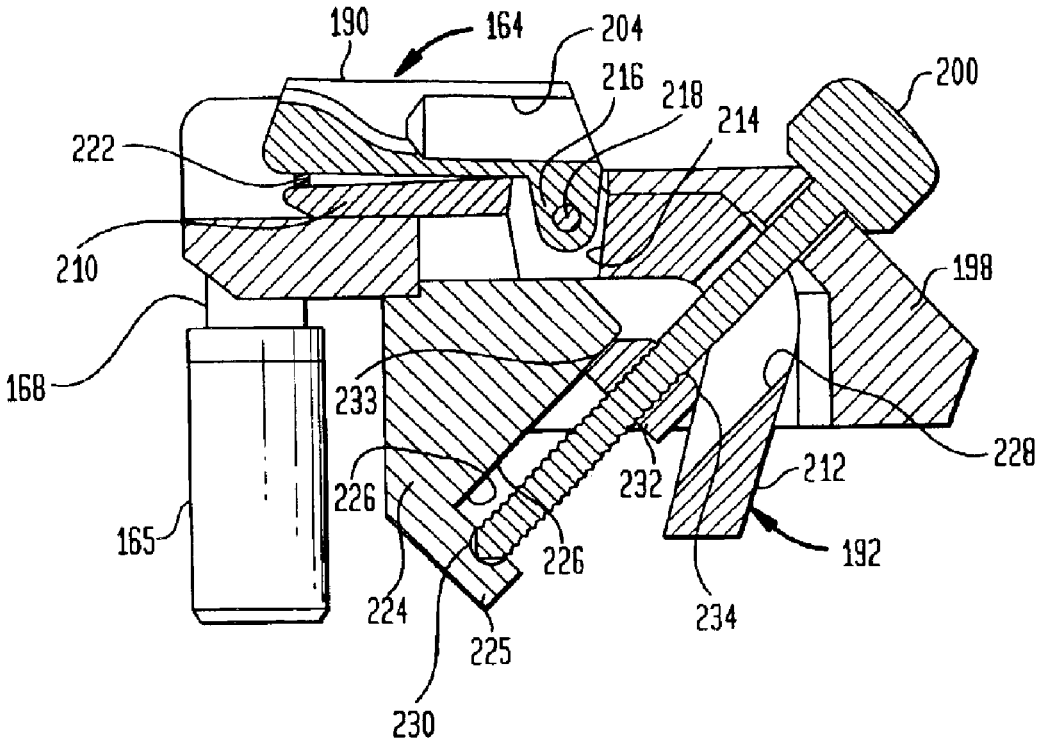
FIG. 29A is a side sectional view, similar to FIG. 27, but illustrating a string holder assembly in its rearwardmost position.
Figure 29B:
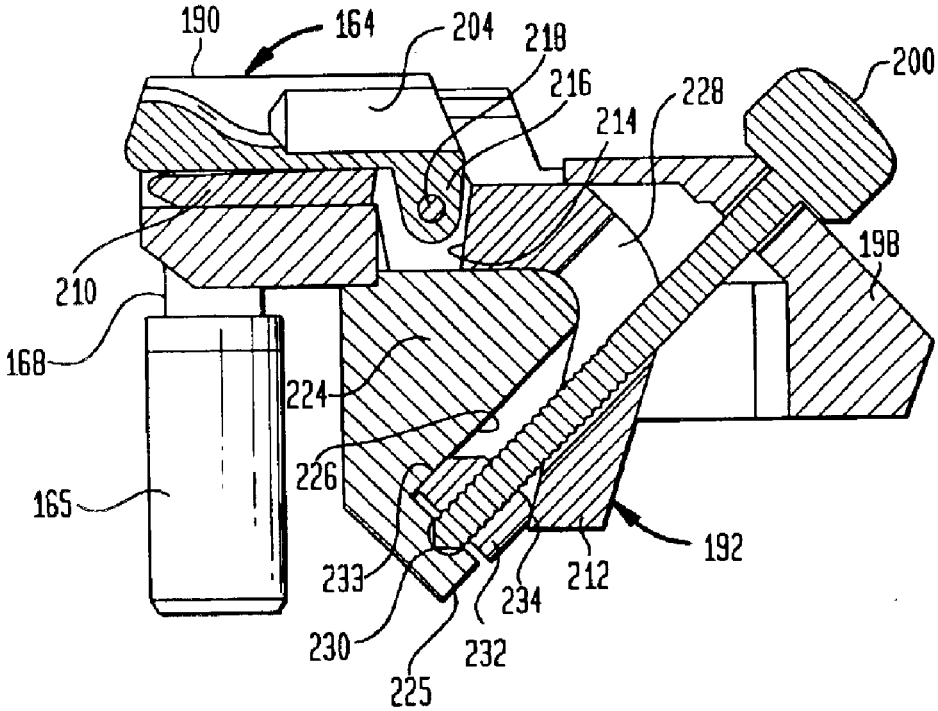
FIG. 29B is a side sectional view, illustrating a string holder assembly in its forwardmost position.

Rotation of each of the adjustment screws 200 in a clockwise direction serves to move the associated riser block 232 upwardly along the adjustment screw 200 which in turn moves its associated string slide member 192 rearwardly. The rearwardmost position of the string slide member 192 is illustrated in FIG. 29A. Rotation of the tuning adjustment screw 200 in a counterclockwise direction serves to move the riser block 232 downwardly along the adjustment screw 200 toward the lower extension 225 of the block 224. This allows the associated string slide member 192 to move forwardly by virtue of the tension on the strings 12, which tends to pull the string slide member 192 to the left in FIG. 27. The forwardmost position of the string slide member 192, and thus the forwardmost position of the string retention or saddle members 190, is shown in FIG. 29B.

This arrangement of moving the string slide members 192 and associated string retention members 190 is advantageous in preventing any binding of the adjustment mechanism or components. More particularly, since the lower end of the adjustment screw 200 is held in place in the indentation 230 in the bottom of the lower extension 225 of the block 224, the slide surface 233 of the riser block 232 which is engageable with the inclined wall 226 serves to maintain the axis of the adjustment screw 200 in a fixed position, thus preventing any binding which might otherwise be caused by the forces placed on the string slide members 192 by the strings 12, which urge the string slide members 192 toward the left in FIG. 27.

Also, by virtue of the inclination of the surface 226 along which the riser block 232 moves and the incline of the lower leg 212 of the string slide member 192, a relatively fine tuning of the string tension can be accomplished. In other words, relatively large amounts of rotation of the tuning adjustment screw 200 serves to provide relatively small adjustments in the position of the string slide member 192, and thus of the position of the string retention member 190. This thus results in small but significant adjustments in the string tension.

In accordance with a preferred embodiment of the present invention, the string holder assemblies 164 on the bridge assembly 160 advantageously may accomplish convergent tuning of the strings 12, by properly choosing the length of the strings 12 and the placement of the bullets 30 thereon, so that movement of the string slide members 192 to position the critical contact surfaces in position for precise harmonic tuning of the various particular string 12 also serves to substantially simultaneously accomplish pitch tuning thereof as well, in accordance with the principles disclosed in U.S. Pat. No. 5,717,150. In other words, during tuning of the strings 12 using the tuning adjustment screws 200, each of the string slide members 192 is moved away relative to the nut assembly 156 such that the tension on the associated string 12 is increased until a convergently tuned state is obtained (i.e. when harmonic and pitch tuning are substantially simultaneously achieved).

The bridge assembly 160 as shown with reference to FIGS. 21–31 is a fixed, non-tremolo type bridge assembly for use on an electric guitar. The principles employed therein, both with respect to the tuning mechanism and with respect to the quick release features, could be employed with respect to a tremolo mechanism as well. For instance, a separate tremolo support plate could be provided on which the bridge assembly could be supported, with the tremolo plate itself being mounted in a conventional manner to provide a tremolo action, i.e., mounted for pivotable movement and including a balancing spring system to counterbalance the forces exerted by the strings. In such an arrangement, the tremolo plate would carry suitable bushings for mounting of the upstanding support post assemblies 166 and latch mechanism 170 thereon, and the bridge assembly 160 would itself be mounted on the tremolo plate by being engaged with the forward support posts and held in place by the pivotable latch member 176. Operation of the bridge base 162 to release string tension and permit removal thereof would be precisely as described above, except that the bridge base 162 itself would be removable from the tremolo plate to thus remove it from the body of the guitar.

Preferably, the bridge base 162 is made of a suitable metal, such as aluminum, although it may also be made of steel or potted metal zinc alloy (ZMAC). In this regard, aluminum is suitable since the string holder assemblies 164 are adapted to simply slide along the shelf segments 194, 195 or 196. Since the height adjustment screws 222 on the string retention or saddle members 190 engage the top surface of the string slide members 192 but do not slide relative thereto during tuning, there is no problem with the use of an aluminum material for the various components.

Figure 32:
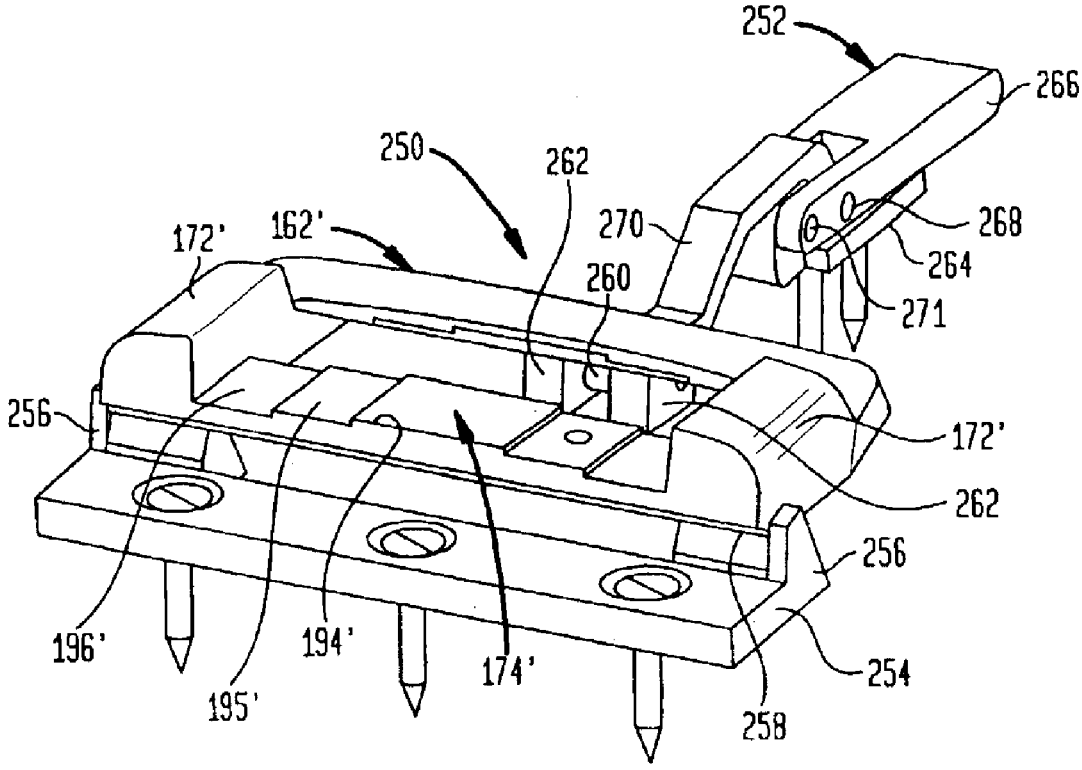
FIG. 32 is a perspective view of a further embodiment of a bridge assembly for use on a stringed musical instrument, with the string holder assemblies and other components removed for illustrative purposes.
Figure 33:
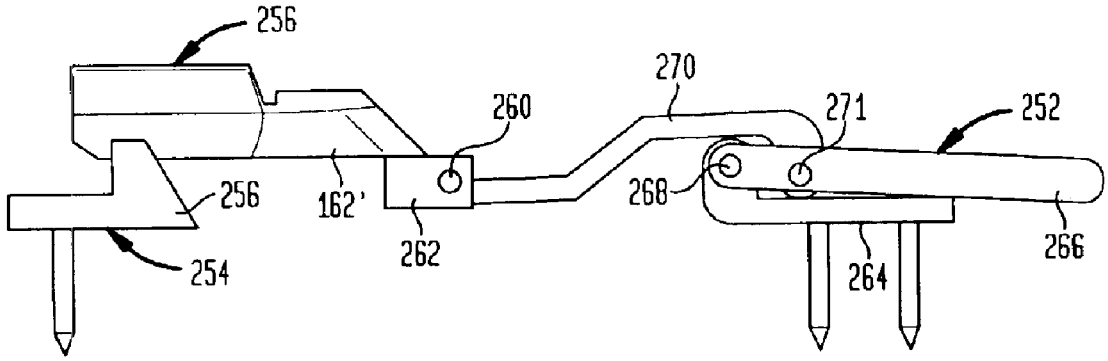
FIG. 33 is a side elevational view of the bridge assembly of FIG. 32, shown in a latched position.
Figure 34:
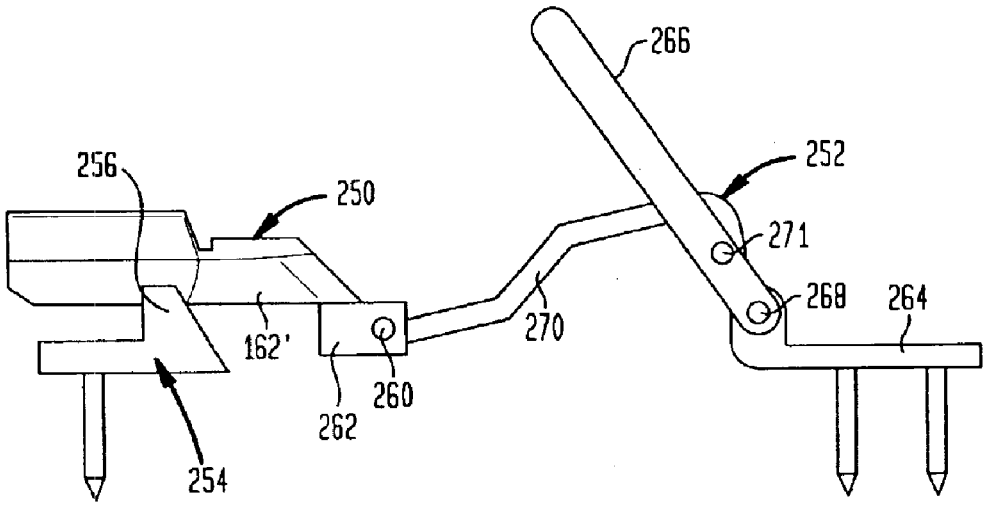
FIG. 34 is a side elevational view of the bridge assembly of FIG. 32, shown in an unlatched or released position.

Turning now to a further aspect of the present invention, there is shown in FIGS. 32–34 an alternative bridge assembly 250 in which the entire bridge assembly may be supported on a musical instrument body (not shown) by means of a single latch assembly 252, which may simply be moved into its latched position in a relatively quick, efficient and easy manner in order to place the bridge assembly 250 in the desired position to allow final tuning of the strings and play of the instrument. In this regard, the bridge assembly 250 shown in FIG. 32, with the exception of the latching components to be described hereinbelow, has the same type of bridge base member 162' as that illustrated in FIGS. 21–25. However, in FIG. 32, the individual string holder assemblies have been removed for clarity, as have the tuning adjustment screws. As with the bridge base 162 of the assembly 160 shown in FIGS. 21–25, the bridge base 162' includes a pair of laterally spaced side housings 172', and a central, laterally extending shelf system 174'. However, unlike in the bridge assembly 160 shown in FIGS. 21–25, the side housings 172' do not include a recessed area for engagement with upstanding post assemblies, but rather are simply flush with the front of the bridge base 162'. The laterally extending shelf system 174' may include raised shelf segments 194', 195', 196' for the individual string holder assemblies, as in the case of the bridge assembly 160 shown in FIGS. 21–25.

In place of the forward post assemblies 166 used for supporting the front of the bridge assembly 160 shown in FIGS. 21–25, in the bridge assembly 250 of FIG. 32, there is instead provided a support bracket 254 which is adapted to be mounted to the instrument body, preferably in a suitable recess, by suitable fasteners 255. The support bracket 254 has upstanding, laterally spaced sides 256 having a raised ledge 258 for supporting the bridge base 162'. The lateral sides 256 of the support bracket 254 are raised above the support ledge 258 in order to prevent side-to-side motion of the bridge base 162' relative to the support bracket 254, and thus relative to the instrument body. However, the bridge assembly 250 is freely slideable on the support ledge 258 in a generally longitudinal direction (i.e., to the left or right in FIGS. 33–34) corresponding to the longitudinal direction that the strings extend.

The rear of the bridge assembly 250 includes a pair of downwardly extending flanges 262, spaced apart and having a rod or pin 260 extending therebetween (see FIG. 32). The latch mechanism 252 for securing the bridge assembly 250 to the body of the instrument preferably comprises an overcenter toggle latch mechanism, having a base portion 264 adapted to be secured to the body of the instrument with suitable fasteners 265 and pivotably supporting a lever arm 266 adapted to pivot about a transversely extending pin 268. The lever arm 266 also pivotably supports a latch member 270 by means of pin 271, which preferably includes a forward hook portion (not shown) adapted to be hooked over the pin 260 provided on the rear of the bridge assembly 250. The lever arm 270 is adapted to be moveable between a latched position (as shown in FIG. 33) and a released position (as shown in FIG. 34).

When placed in the latched position, the forward hook portion of the lever arm 266 engages the pin 260 on the bridge assembly 250 and urges the bridge assembly 250 rearward (to the right as shown in FIG. 33) to place the strings carried by the individual string holder assemblies (not shown) under tension. The strings can be tuned using tuning adjustment members (not shown) in the manner described with reference to the bridge assembly 160 shown in FIGS. 20–31. Here it should be noted that the only manner by which the bridge assembly 250 is secured to the instrument body is by virtue of the latch system 252. In particular, the forward end of the bridge assembly 250 only rests on the ledge 258 of the support bracket 254 and is not held down by any device. However, because of the tension of the strings urging the bridge assembly 250 toward the nut assembly (to the left in FIG. 33), the strings serve to maintain the bridge assembly 250 seated against the ledge 258 on the support bracket 254.

In order to release the tension on the strings to permit changing of strings and/or removal of the bridge assembly 250, all that is necessary is to lift the lever arm 266 and move it to its released position (FIG. 34). This allows the bridge assembly 250 to move relative to the support bracket 254 (i.e., to the left in FIG. 34) by virtue of the tension on the strings. When the bridge assembly 250 moves to the left, the tension on all of the strings is released and the bridge assembly 250 may then simply be lifted off of the support bracket 254. In this regard, the bridge assembly 250 may be easily removed from the guitar by lifting of the forward hook portion on the latch member 270 off of the pin 260. Although not shown in FIGS. 32–34, the hook-shaped end of the latch member 270 may be similar to that shown in FIGS. 38 and 41, discussed more fully hereinbelow.

Accordingly, it will be appreciated that the bridge support mechanism illustrated with reference to FIGS. 32–34 provides yet another variation on a bridge assembly 250 for a stringed musical instrument to provide a secure, straight forward bridge support system which can provide for quick release of string tension to permit changing of the strings and/or removal of bridge assembly 250 from the instrument.

Figure 35:
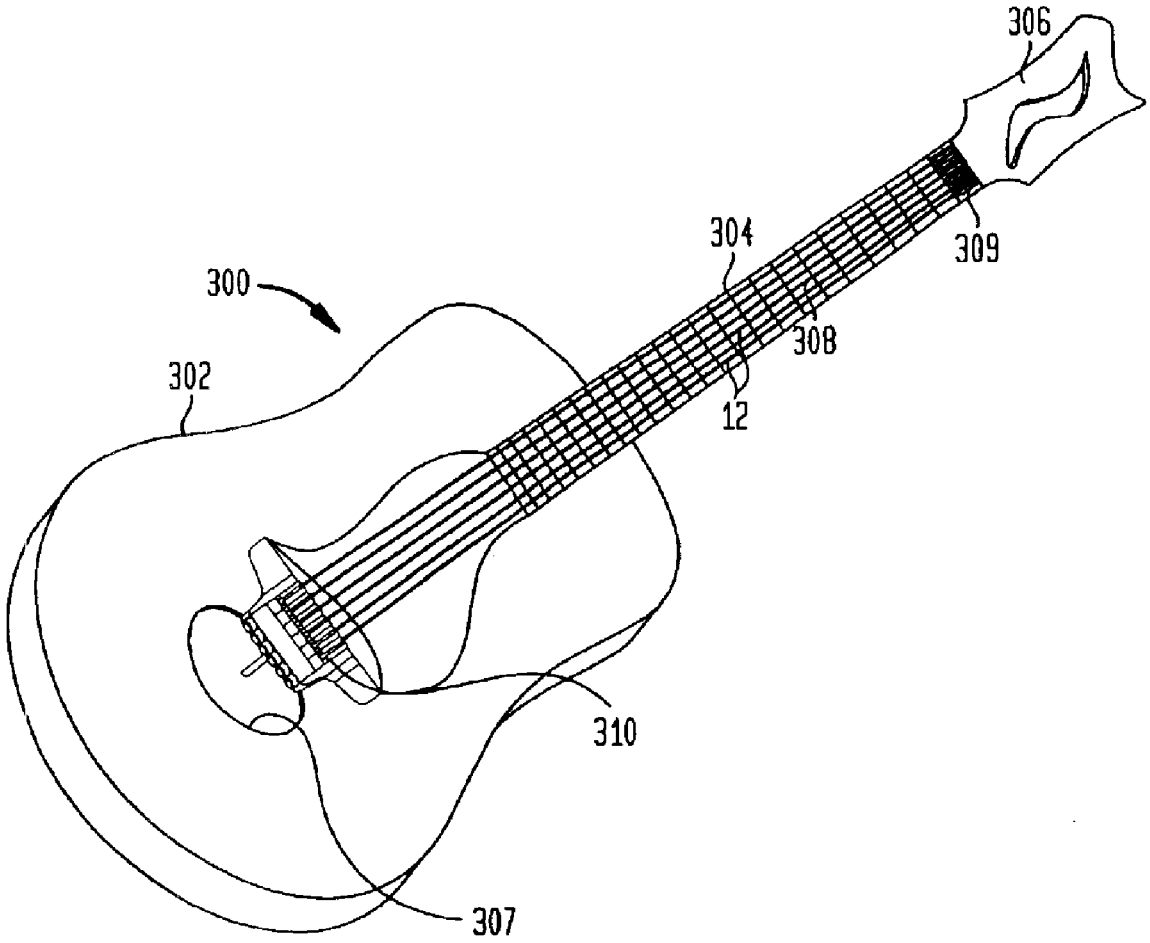
FIG. 35 is a perspective view of an acoustic guitar type of stringed musical instrument, employing a further embodiment of a bridge assembly in accordance with a further aspect of the present invention.
Figure 36:
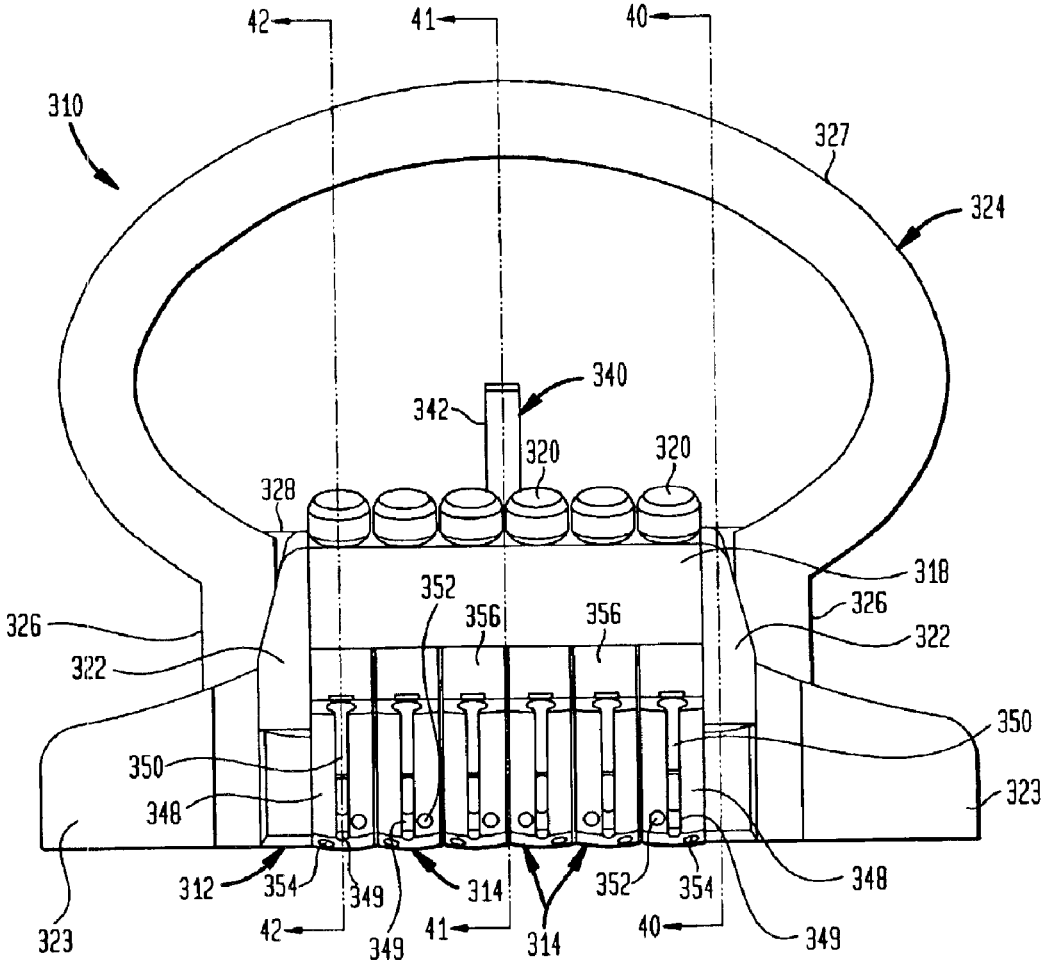
FIG. 36 is a plan view of the bridge assembly of the guitar of FIG. 35.

FIGS. 35–42 illustrate a further embodiment of a bridge assembly and string tuning apparatus for a stringed musical instrument in accordance with the present invention. However, unlike the embodiments of FIGS. 1–19 and 20–31, the stringed musical instrument 300 shown in FIG. 35 is an acoustic type guitar assembly having a quick release bridge assembly and employing further variations of the string tuning apparatus in accordance with the present invention.

The acoustic guitar 300 shown in FIG. 35 includes a guitar body 302, and a neck 304 secured thereto and extending away therefrom toward a head 306. There is provided a fretboard 308 along the neck 304, and a plurality of strings 12 are provided which extend from the head 306 to a bridge assembly 310 mounted on the body 302. In this regard, the acoustic guitar 300 of FIG. 35 is typical of acoustic instruments in that the instrument body 302 is generally hollow and includes a sound hole 307 provided in the face thereof. However, unlike conventional acoustic stringed musical instruments, there are no tuning keys provided at the head 306.

As with the musical instruments 10, 150 shown in the prior embodiments, all of the strings 12 of the guitar 300 include bullet-shaped anchors 30 thereon, such as those shown in FIG. 2. At the head 306 of the guitar 300, the ends of the strings 12 are secured in a nut assembly 309, such as the nut assembly shown and described with reference to FIGS. 3–5. At the bridge assembly 310, the other ends of the strings 12 are secured in individual string holder assemblies 314. The string holder assemblies 314 are adapted to be mounted on the bridge base 312 for sliding movement in the longitudinal direction, i.e. the direction that the strings 12 extend along the neck 304. The bridge base 312 also supports a plurality of tuning adjustments members 320 along the rear flange 318 thereof. The structure of the string holder assemblies 314 and the manner in which tuning is accomplished will be described more fully hereinbelow.

Considering first the bridge assembly 310 and the manner in which it is supported on the acoustic guitar 300, the bridge assembly 310 is best seen with reference to FIGS. 36–39. As shown therein, the bridge base 312 includes a plate-like structure having a pair of spaced side rails 322 extending rearwardly along the lateral sides from the front of the bridge base 312 toward the rear of the bridge base 312 and terminating adjacent a rear support flange 318 which extends therebetween. The bridge base 312 is adapted to be supported for pivotable movement on a lower support frame 324, which in turn is adapted to be supported in the hollow sound chamber of the acoustic guitar 300.

Figure 37:
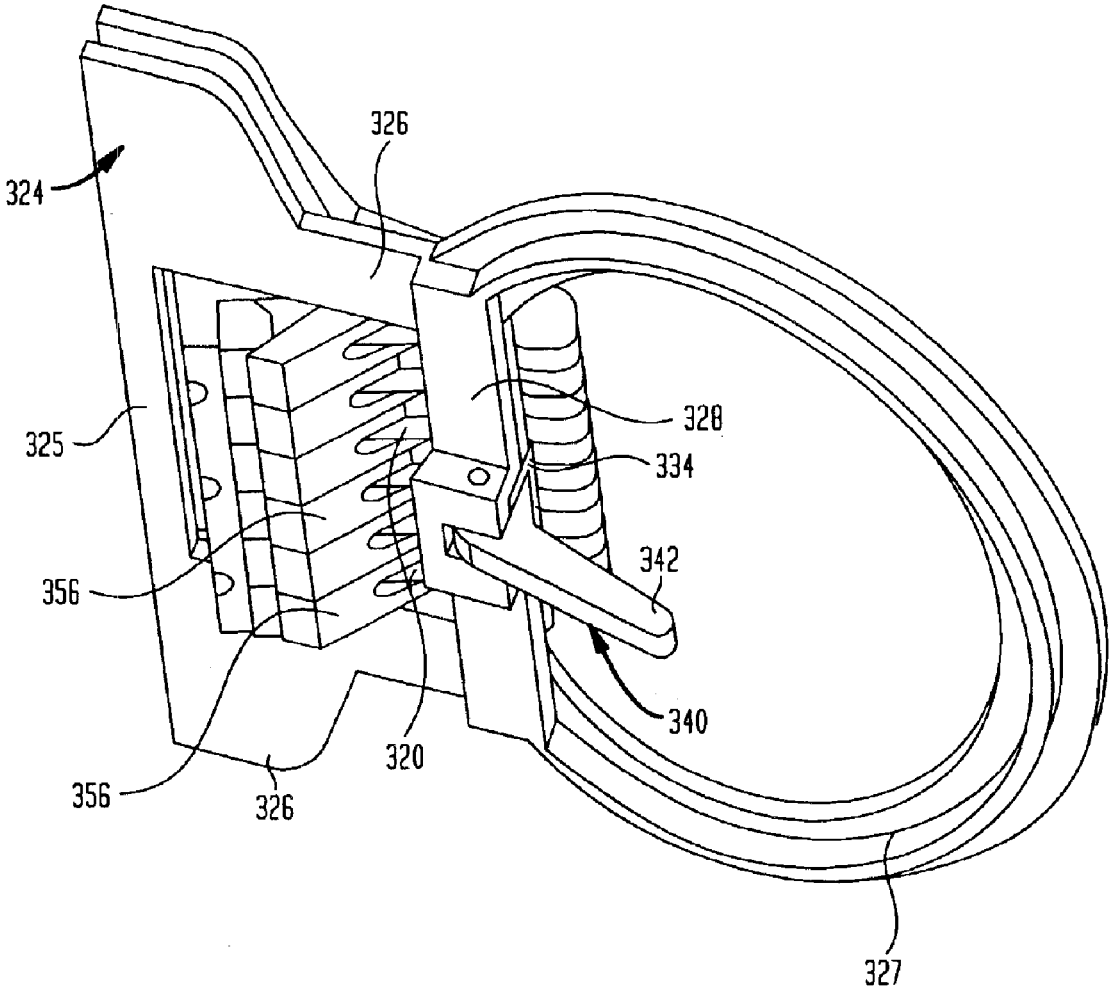
FIG. 37 is a bottom perspective view of the bridge assembly of the guitar of FIG. 35.

The structure of the support frame 324 is best shown in FIG. 37, which is a bottom perspective view of the bridge assembly 310. The support frame 324 includes a generally U-shaped structure having a forward reinforcing section 325 and a pair of laterally extending wings or wing sections 326 which define a rectangular opening for the bridge base 312. The support frame 324 also includes a generally circular shaped ring member 327, arranged to be supported on the underside of the top face of the guitar body 302 about the sound hole 307, and a laterally extending latch support member 328. In this regard, the shape of the rear support ring 327 coincides with the shape of the sound hole 307 provided in the face of the body 302. From FIGS. 36 and 37, it will be seen that. the lateral latch support member 328 is arranged beneath the rear flange 318 of the bridge base 312, and the U-shaped structure 324 is arranged to immediately underlie the front and side rails 322 of the bridge base 312. Also, upper side wing sections 323, which are for decorative purposes only, are provided adjacent the side rails 322 of the bridge base 312.

Figure 39:
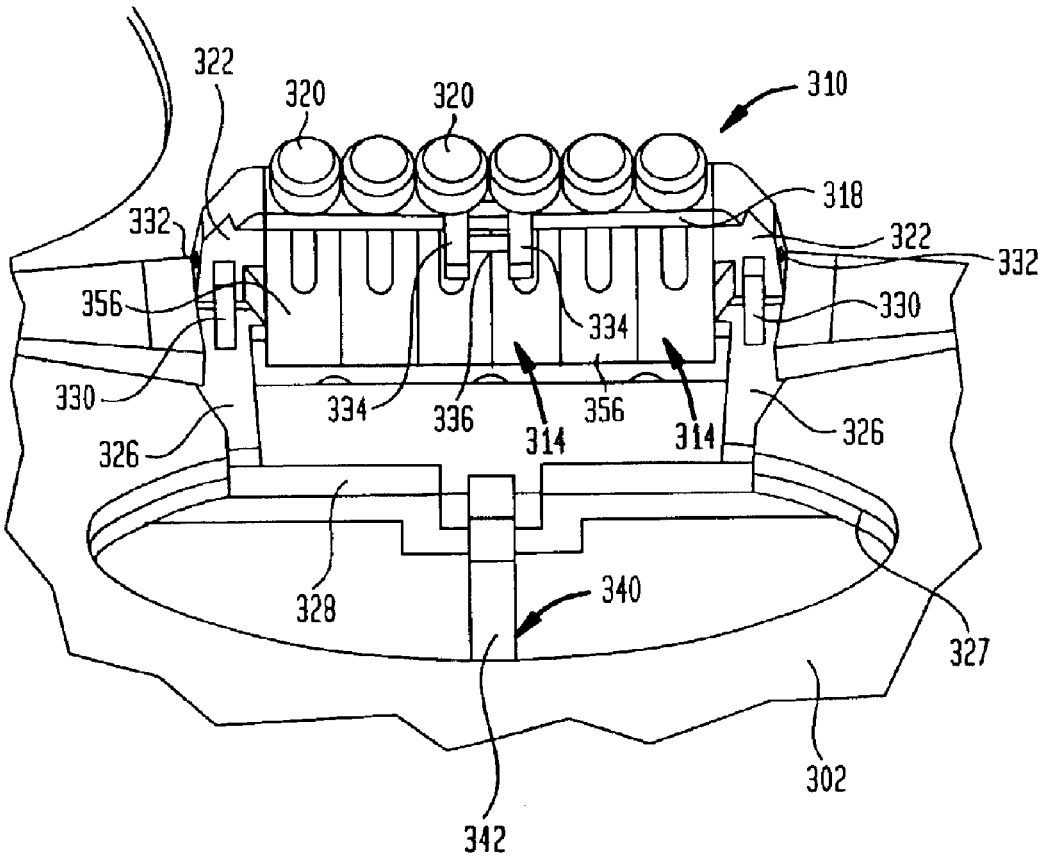
FIG. 39 is a rear perspective view of the bridge assembly of FIG. 36 in a released position mounted on a guitar.
Figure 40:
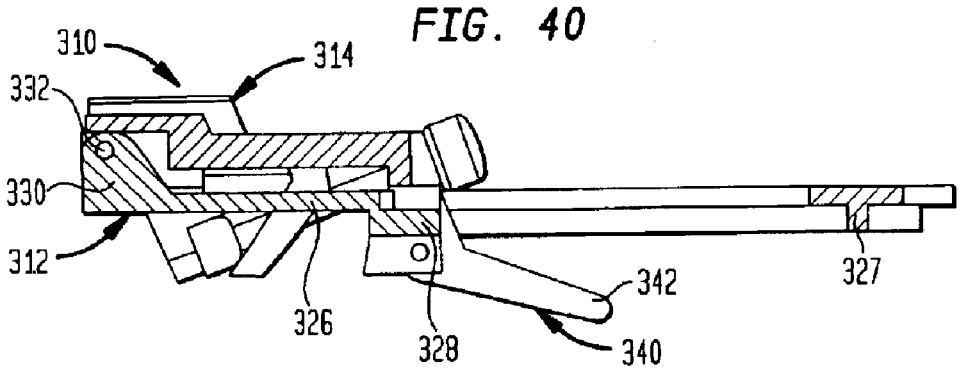
FIG. 40 is a side sectional view, taken along line 40—40 of FIG. 36.

As best seen in FIG. 39 (a rear perspective view showing the bridge assembly 310 supported in the guitar body 302) and FIG. 40 (a sectional view taken along line 40—40 of FIG. 36), each of the laterally extending wings 326 of the U-shaped structure of the support frame 324 includes an upstanding ear or flange 330 for mounting of the bridge base 312 for pivotable movement relative to the support frame 324. Each of the ears or flanges 330 are adapted to be received in suitable recesses in the side rails 322 of the bridge base 312. A pin 332 is adapted to be inserted through each of the forward side rails 322 into a pivot hole provided in the upstanding flanges 330 so that the bridge base 312 may pivot forwardly about the pair of pins 332 on opposite sides of the bridge base 312.

Figure 38:
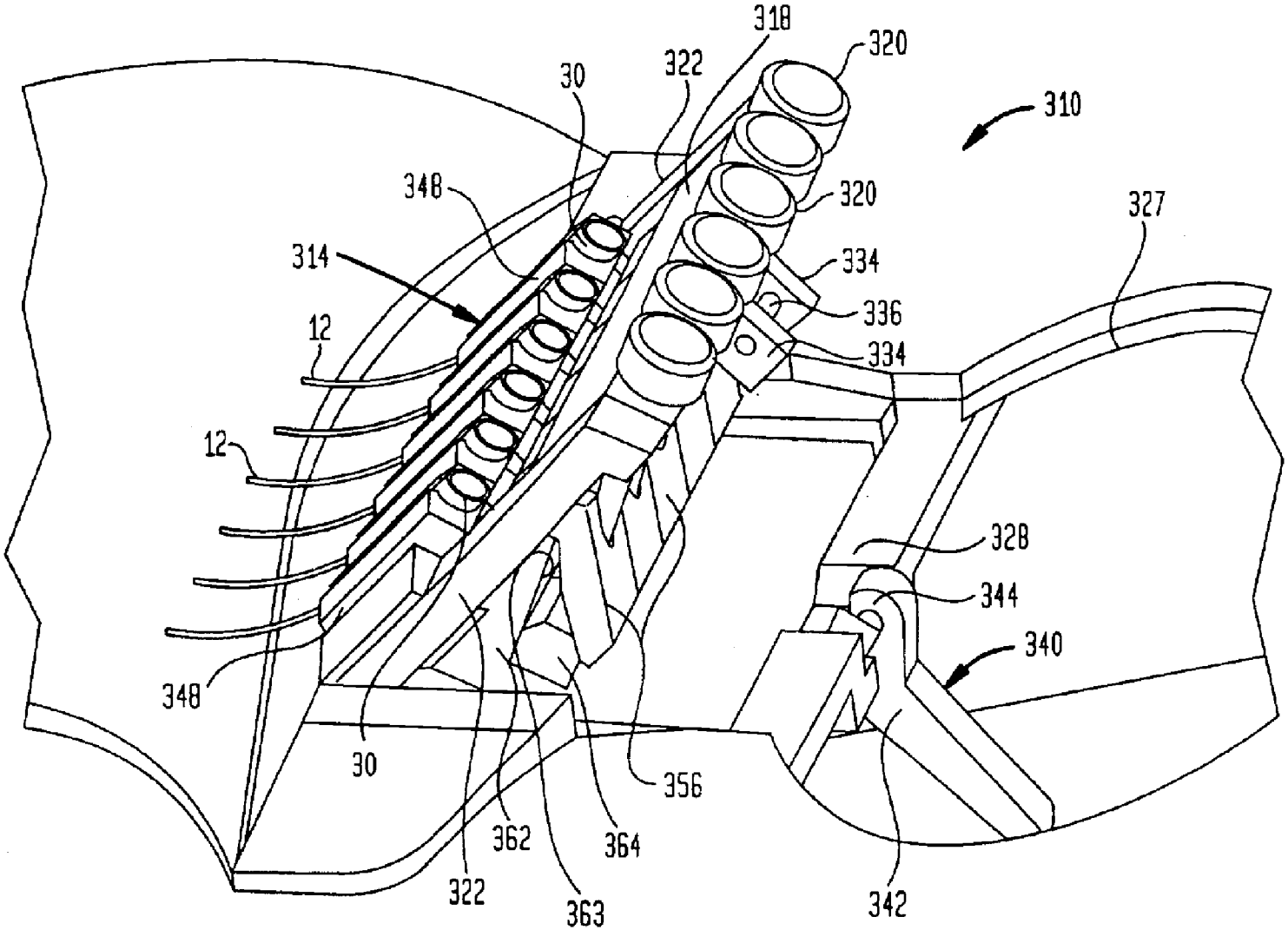
FIG. 38 is a side perspective view of the bridge assembly of FIG. 36, but arranged in a released position to remove the tension on the strings to permit changing of the strings.
Figure 41:
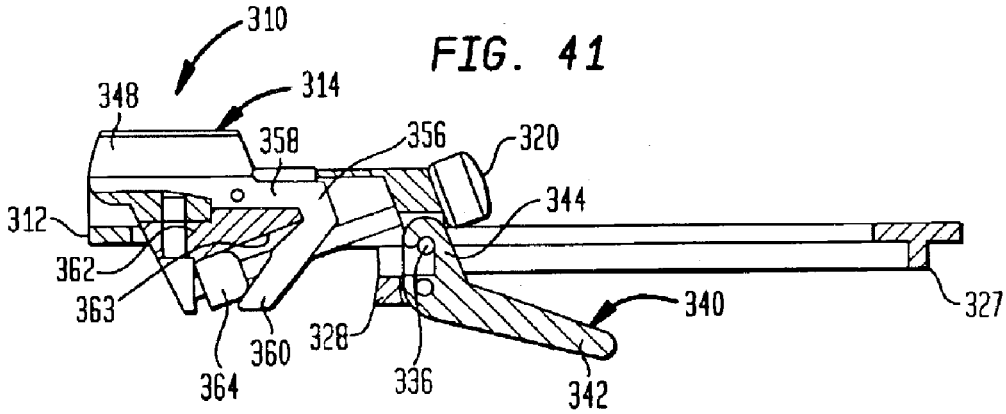
FIG. 41 is a side sectional view, taken along line 41—41 of FIG. 36.
Figure 42:
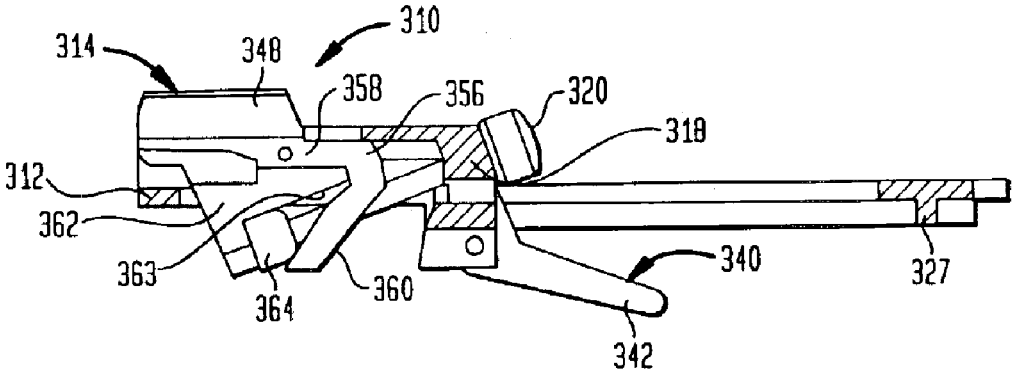
FIG. 42 is a side sectional view, taken along line 42—42 of FIG. 36.

As best seen in FIG. 37, the rear flange 318 of the bridge base 312 includes a pair of depending flanges 334 which support a pin 336 therebetween. The pin 336 is to be used in conjunction with the latching mechanism 340 mounted on the latch support member 328 for holding the bridge assembly 310 in its lower, string-tensioning position (see FIGS. 38 and 39). The depending flanges 334 are adapted to be received in a recess 338 provided in the laterally extending latching support member 328. As best seen in FIGS. 38 and 41, the latching mechanism 340 comprises a pivotably mounted latch lever 342 having a raised hook section 344 which is adapted to engage the pin 336 supported between the depending flanges 334 on the bridge base 312.

As in the case of the bridge assembly 160 shown in FIGS. 20–31, the ends of the strings 12 of the musical instrument, in this case an acoustic guitar 300, are received in individual string holder assemblies 314 mounted on the bridge base 312. The bridge base 312 is adapted to be placed in its lower, string-tensioning position by pivoting motion of the bridge base 312 downwardly against the tension or force exerted by the strings 12. In other words, the strings 12 tend to pull or urge the bridge base 312 to pivot upwardly about the pivot pins 332, as shown in FIG. 38. However, the bridge base 312 may be pivoted downwardly by pushing on the rear of the bridge base 312 to place the strings 12 under tension. The bridge base 312 may continue to be pushed downwardly until the pin 336 is below the hook member 344 of the latch lever 342. The latch lever 342 may then be pivoted upwardly over the pin 336 and the bridge base 312 released to move the pin 336 into the recess provided in the hook section 344, which then serves to hold the bridge base 312 in its lower, string-tensioning position.

In order to release the tension on the strings 12, to permit the strings to be changed, the rear of the bridge base 312 is pushed downwardly to move the pin 336 thereon out of the latching recess in the hook section 344, and the latch lever 342 is then pivoted downwardly by pushing on the rear of the latch lever 342. The bridge base 312 is then allowed to pivot upwardly by virtue of the tension on the strings 12, until all of the tension is relieved, so that the strings 12 may then be easily removed from the string holder assemblies 314 and replaced.

The string holder assemblies 314 of the bridge assembly 310 shown in FIGS. 35–42 are based on the same principles as employed in the string holder assemblies 164 for the electric guitar 150 shown in FIGS. 20–31, but have a different orientation for the lower legs 360 of the string slide members 356 and for the inclined support surface 362 along which the riser blocks 364 move to adjust the position of the string holder assemblies 314. More particularly, as best seen with reference to FIGS. 36 and 38, and partially with reference to FIGS. 40–42, each of the string holder assemblies 314 includes a pivotally mounted string retention or saddle member 348 which includes a forward slot or channel 349 for the string 12 to provide a critical contact surface and a rearwardly extending cylindrical cavity or chamber 350 for receiving the bullet-shaped anchors 30 of the strings 12. As with the string retention or saddle members 190 of the bridge assembly 164 shown with reference to FIGS. 20–31, the string retention members 348 each include a threaded bore 352 and bolt (not shown) extending vertically through the extent thereof for adjusting the height of the critical contact surface, and thus the height of the strings 12 relative to the fretboard 308 of the instrument 300, as well as a longitudinally extending bore 354 and bolt (not shown) that extends from the front face of the string retention members 348 rearwardly to adjust the position of the string bullet 30 within the cavity 350 provided in the string retention member 348. These bores 352, 354 and the manner in which they function are precisely the same as with the string retention members 190 as shown with reference to FIGS. 20–31. Also, the string retention members 348 are each pivotally mounted on a string slide member 356 which is mounted for sliding movement on the front of the bridge base 312 between the side rails 322 of the bridge assembly 310. In this regard, unlike the bridge assembly 160 shown in FIG. 21, the front support area has a constant height for all of the string holder assemblies 314 in the embodiment shown in FIG. 36.

The string slide members 356 each have a different shape from those employed with the embodiment shown with reference to FIGS. 20–31, in that the lower leg portion 360 extends forwardly to a greater extent, approximately at an angle of 45 degrees, relative to the top leg 358 of the string slide member 356. Also, the inclined wall 363 of the block 362 attached to the bottom of the bridge assembly 310 extends at an angle of approximately 20° relative to the horizontal support surface of the bridge base 312. As such, the tuning adjustment screws 320 mounted on the rear support flange 318 of the bridge assembly 310 also extend at an angle of approximately 20 degrees, and support a riser block 364 arranged between the inclined wall 363 and the lower leg 360 of the string slide members 356. As noted above, other orientations of the legs 360 and inclined wall 363 are also possible in accordance with the present invention.

The forwardmost tip of the tuning adjustment screws 320 are received in suitable recesses (not shown) provided in the lower extension 366 of the slide block 367. As with the arrangement of the string holder assemblies 164 described with reference to FIGS. 20–31, rotation of the tuning adjustment screws 320 serves to cause the riser blocks 364 to slide along the inclined surface 363 of the block 362 and against the lower leg 360 of the string slide members 356 to cause the string slide members 356 to slide relative to the front of the bridge base 312 to thereby adjust the position of the string slide members 356, and thus the position of the string retention members 348 to adjust the tension on the strings 12.

Advantageously, with this type of arrangement it is possible to convergently tune the individual strings 12 (i.e. accomplish both harmonic and pitch tuning of the strings 12 substantially simultaneously). However, it will also be appreciated that it is not necessary that the convergent tuning principles be employed with the individual tuning apparatus shown and described with reference to this embodiment. As with the tuning apparatus and mechanisms employed with the electric guitar 150 shown with reference to FIGS. 20 through 31, the arrangement of the riser block 364, as well as the arrangement of the string retention or saddle members 348 and string slide members 356, provides a convenient and efficient manner for tuning of each string 12 and adjusting the tension thereof in a relatively quick manner without causing any binding of the various components, which might otherwise occur by virtue of the string tension and various forces applied to the components.

Figure 43:
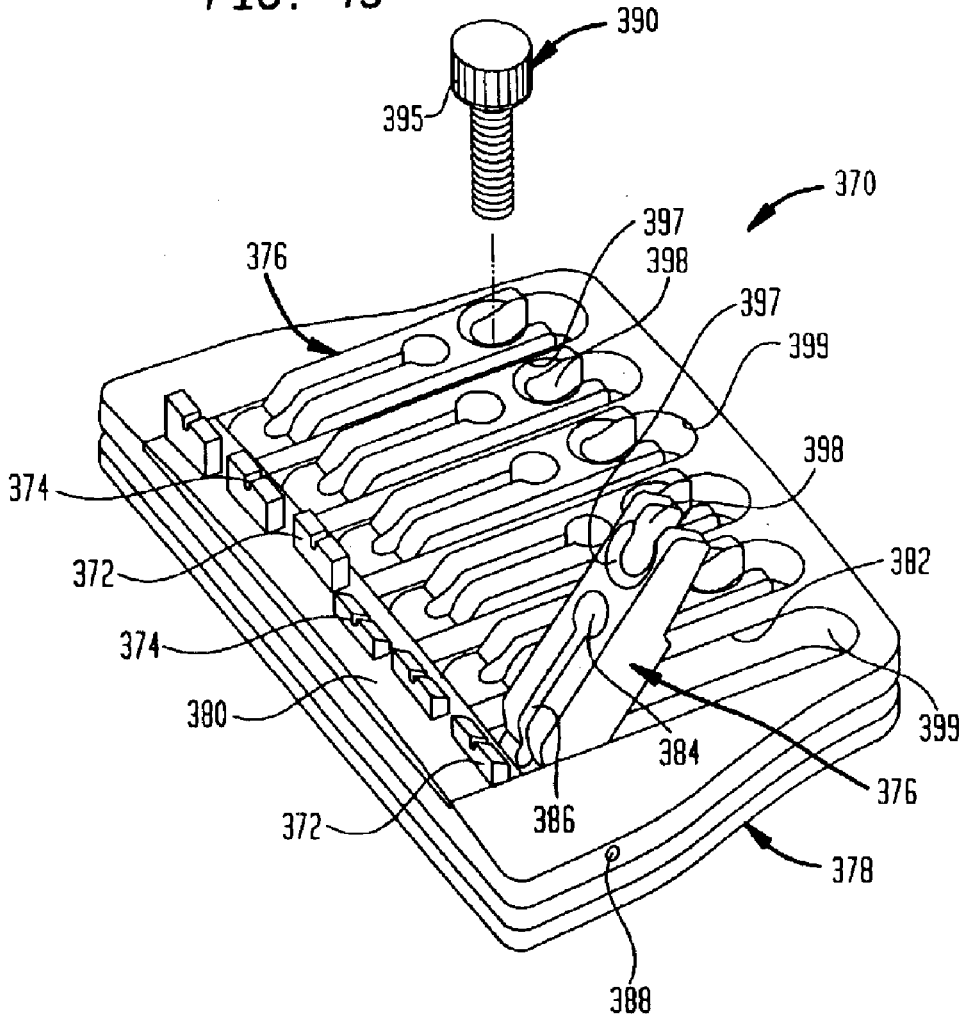
FIG. 43 is a perspective view of a further embodiment of a bridge assembly for use with an acoustic guitar type of string musical instrument, in accordance with a further aspect of the present invention.
Figure 44:
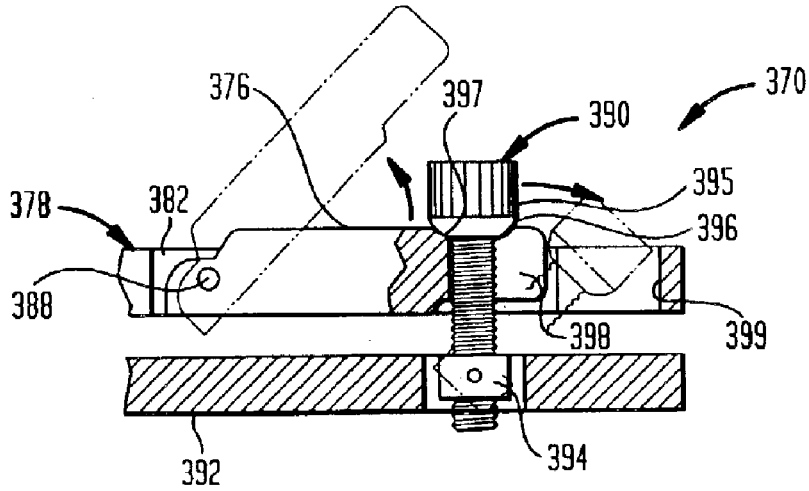
FIG. 44 is a side sectional view of the bridge assembly of FIG. 43.
Figure 45:
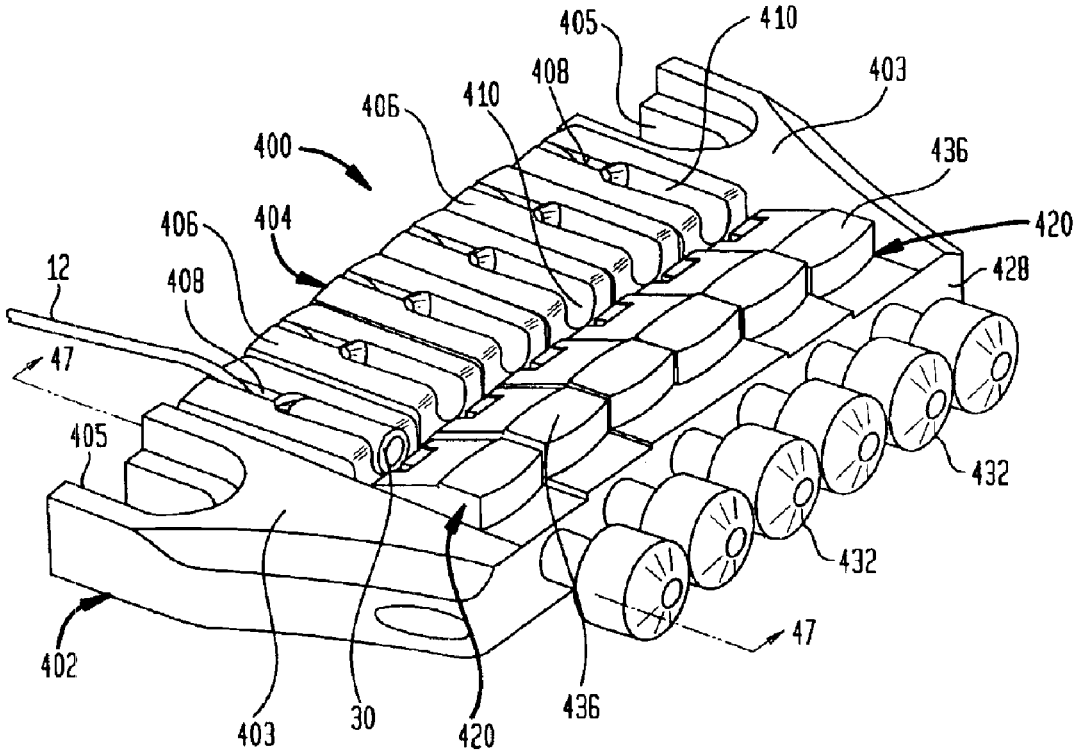
FIG. 45 is a perspective view of a further embodiment of a bridge assembly for use on a stringed musical instrument, in accordance with a still further aspect of the present invention.

FIGS. 43 and 44 show a further example of a bridge assembly 370 for an acoustic guitar type of musical instrument in accordance with a further aspect of the present invention. More particularly, the bridge assembly 370 shown in FIGS. 43 and 44 is a bridge assembly for acoustic guitars which has stationary contact points or surfaces for each of the strings comprised of raised contact blocks 372 on the bridge base 378, each having a groove 374 therein for the strings. The bridge assembly 370 is adapted to be stationarily mounted on the face of the guitar body, with the strings extending from the nut end of the guitar along the fretboard, and passing over the contact blocks 372, and then secured in pivotally mounted string holder assemblies 376 arranged behind the contact blocks 372.

The bridge assembly 370 includes a bridge base 378 having a forward frame section 380 on which the contact blocks 372 are positioned. Preferably, the forward frame section 380 has a curved surface generally matching the curved surface of the fretboard. Each of the contact blocks 377 are positioned on and fixedly mounted to the forward frame section 380 so as to be in the desired harmonic position when the bridge assembly 370 is mounted to the guitar body. As the bridge assembly 370 is fixedly mounted to the guitar body, and as the contact blocks 372 are in a fixed position, it will be appreciated that the bridge assembly 370 sets the harmonic position for each of the individual strings. That harmonic position cannot be changed except by movement of the bridge assembly 370.

The bridge assembly 370 also includes a series of rectangular slots 382 behind each of the contact blocks 372 into which the individual string retention or holding members 376 are to be mounted. Each of the string holding members 376 comprises a rotatable holding block having an enlarged opening 384 for receipt of a string anchor or bullet 30 and a slotted portion 386 for the string to extend through. Although not shown, the string anchors 30 are adapted to be inserted through the enlarged opening 384 and then retained in the bottom of the rotatable holding block 376, with the string 12 then passing upwardly and forwardly through the slotted portion 386. Each of the rotatable holding blocks 376 for the strings includes a transversely extending pivot bore at its front end through which a pin or rod 388 is to be inserted from the side of the bridge assembly 370. In this regard, the rod 388 preferably extends across the full width of the bridge assembly 370 and passes through the pivot bore in each of the string holding blocks 376 so that each of the string holding blocks 376 will pivot about a common axis.

In order to adjust the tension of the strings 12 held by the string holding blocks 376, there are provided a plurality of tuning adjustment screws 390 which are arranged to be received in the rear of the string holding blocks 376 and adapted to adjust the rotational position of the string holding blocks 376 in the bridge assembly 370. Each tuning adjustment screw 390 is supported by the bridge base 378 for both pivotable movement and axial movement relative to the bridge base 378. One manner of accomplishing this is shown in FIG. 44. The bridge base 378 includes a lower support plate or block. 395 which includes a plurality of individual pivot block members 394 journaled therein for pivotable movement about axes extending transverse to the longitudinal extent of the strings 12, i.e. parallel to the pivot axis for the string holding blocks 376. Each of the pivot block members 394 includes an internally threaded bore adapted to receive one of the tuning adjustment screws 390. and to mount same for individual pivotable movement with respect to the support plate 392.

The tuning adjustment screws 390 each include an enlarged head 395 having a spherical bottom surface 396, and are threaded into the respective pivot block members 394 carried by the lower support plate 392 of the bridge base 378. Each of the string holding blocks 376 includes a slotted section 398 at its rear end which includes a spherical shaped recess 397 on the top surface for receipt of the tuning adjustment screws 390. The pivotable block members 394 and tuning adjustment screws 390 are arranged relative to the string holding blocks 376 so that the spherical bottom 396 of the enlarged head 395 is received in the spherical shaped recess 397 on the top surface of the string holding blocks 376. Clockwise rotation of each tuning adjustment screw 390 moves the screw 390 further into the respective pivot block member 394 and serves to lower the rear end of the respective string holding block 376, and thus increase the tension on the strings 12, whereas counterclockwise rotation of each tuning adjustment screw 390 allows the rear of the respective string holding block 376 to be moved upward to release or lower the tension on the string 12 held thereby.

In order to release the tension on each of the strings 12 so as to permit replacement of the string 12, all that is necessary is to push the rear end of the respective string holding blocks 376 downwardly and pivot the associated tuning adjustment screws 390 out of the way. In this regard, the rear of the bridge base 378 is provided with a rearwardly extending slot 399 for each screw 390 to permit the tuning adjustment screws 390 to pivot out of the way, as illustrated in FIG. 44.

It will thus be appreciated that the bridge assembly 370 shown in FIGS. 43 and 44 provides another example of a string tuning apparatus in which a string tensioning mechanism is provided which is operative to quickly and easily release the tension on the strings 12, and yet is also operative to adjust the tension on the strings 12 to tune same for play. In particular, there is provided a latching mechanism 390, 394 for each of the string retention members 376 which is operative to hold the respective string retention member 376 against movement about its transverse axis in a first direction as a result of tension on the string 12 held thereby, and yet operative to quickly release the string retention member 376 to permit free rotation of the string retention member 376 in the first direction.

FIGS. 45–48 show another embodiment for a bridge assembly 400 in accordance with the present invention, which is usable with electric guitar-type musical instruments as well as acoustic guitar-type musical instruments. The bridge assembly 400 is adapted to be fixedly mounted on the guitar and includes a tuning system, preferably capable of providing convergent tuning of the guitar strings 12. Unlike the bridge assembly 160 used with respect to the guitar 150 shown in FIGS. 20–31, in which the bridge assembly 160 itself is mounted to be moveable to release the string tension, the bridge assembly 400 shown in FIG. 45 employs individual string holder assemblies 404 which each include a latching mechanism 420 which is operative to release the string holder member 406 or components from the string-tensioning position and allow it to move in a manner so as to release string tension. As such, the bridge assembly 400 is more analogous to the bridge assembly 24 shown mounted on the guitar 10 of FIG. 1, except that the bridge assembly 400 does not include a tremolo mounting mechanism for allowing release of the tension of all of the strings 12 during play of the instrument. Also, the bridge assembly 400 is operative to convergently tune the strings 12, although it is not necessary that it be so operative.

The bridge assembly 400 includes a bridge base 402 adapted to be fixedly mounted to the guitar body. In this regard, it includes two lateral extensions 403 on the sides of the bridge assembly having U-shaped recesses 405 for receipt of suitable mounting members, such as bolts or screws, which may be secured to the body and serve to fixedly secure the bridge base 402 to the body of the instrument. Between the pair of U-shaped recesses 405, the bridge base 407 includes a recessed area for receipt of individual, pivotally mounted, string holder assemblies 404. The top surface of the recess area includes a plurality of raised slide surfaces 407 which in a preferred embodiment each comprise a pair of surfaces 407 forming a generally shallow "V" shape along which a string holder assembly 404 is adapted to slide forwardly and backwardly during tuning. In this regard, each pair of slide surfaces 407 is for a similar purpose to that of the sets of slide segments 194, 195, 196 employed in the bridge assemblies 160, 250 of FIGS. 21–31 and 32–34, and whose individual heights are such as to generally correspond to the curvature of the fretboard; however, each pair of slide surfaces 407 structurally are different in terms of providing a separate recess for each individual string holder assembly 404.

Figure 46:
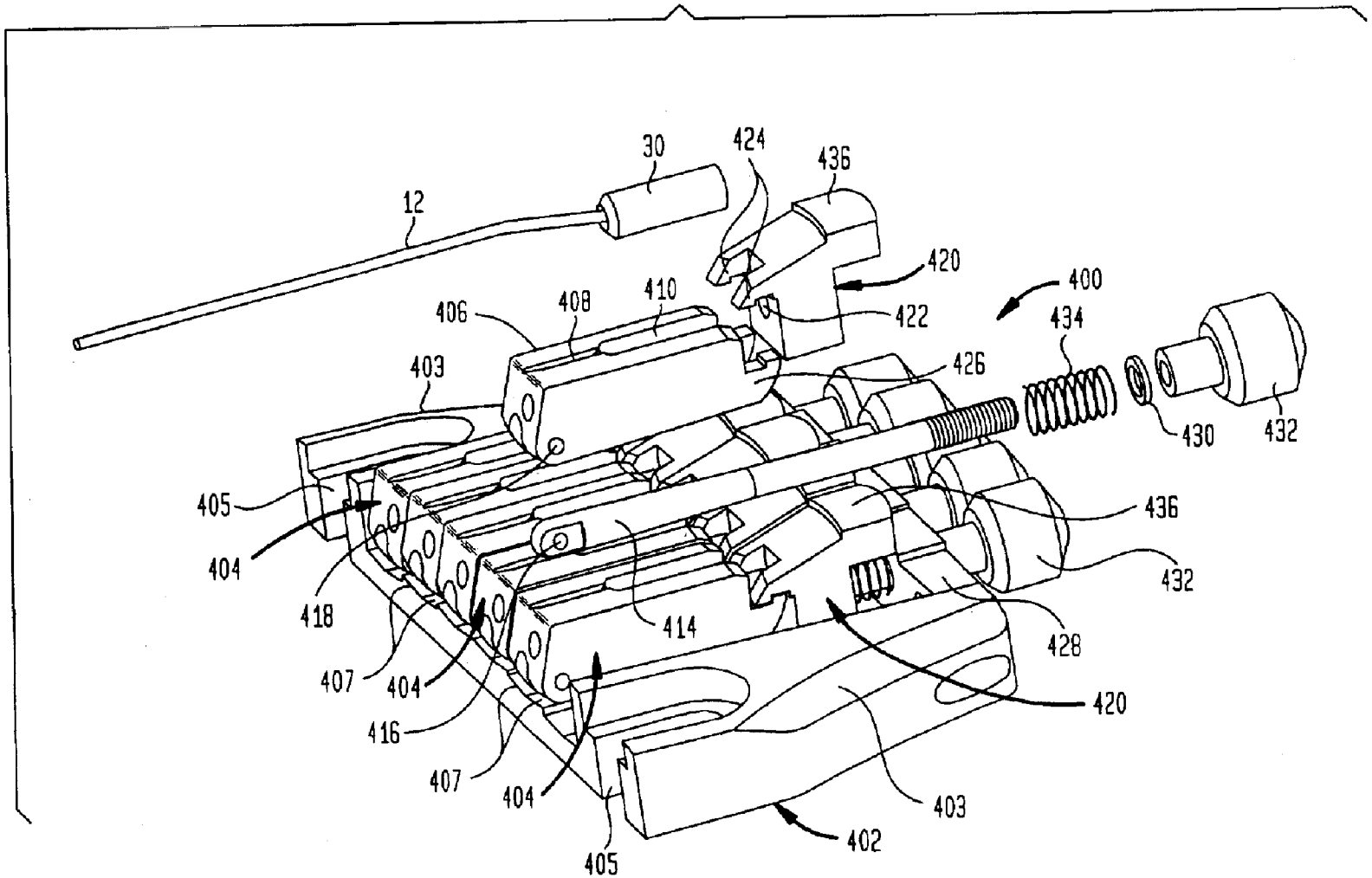
FIG. 46 is an exploded perspective view of the bridge assembly shown in FIG. 45.
Figure 47:
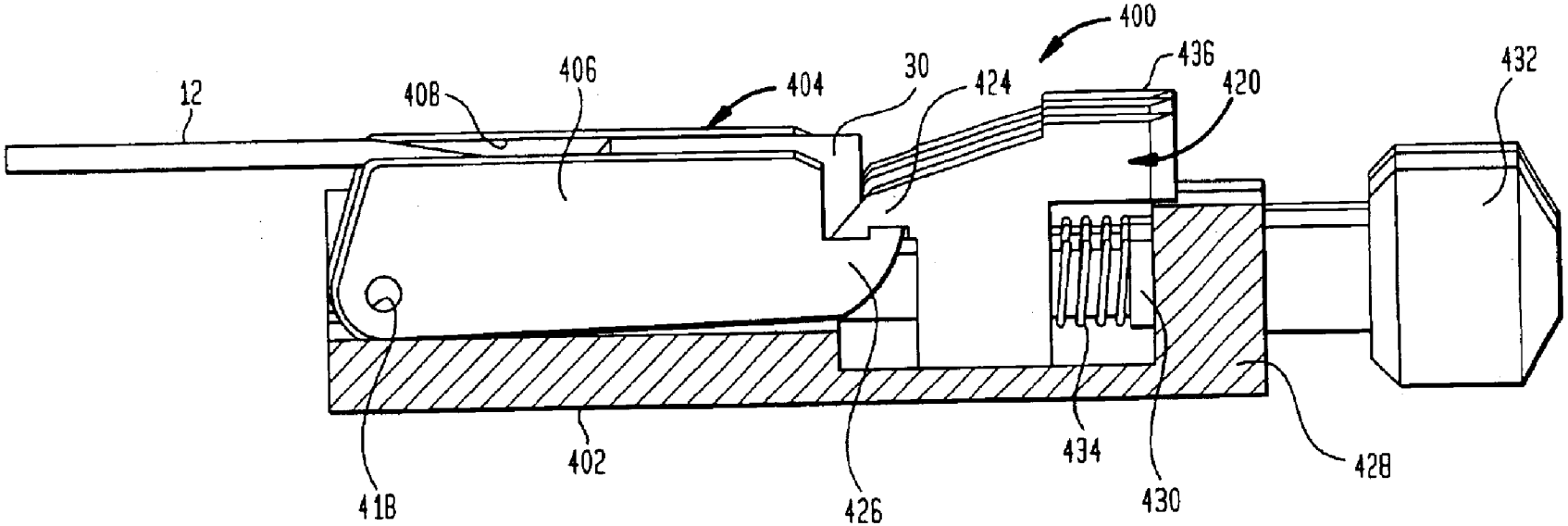
FIG. 47 is a side sectional view of the bridge assembly of FIG. 45, taken along line 47—47 of FIG. 45.
Figure 4B:
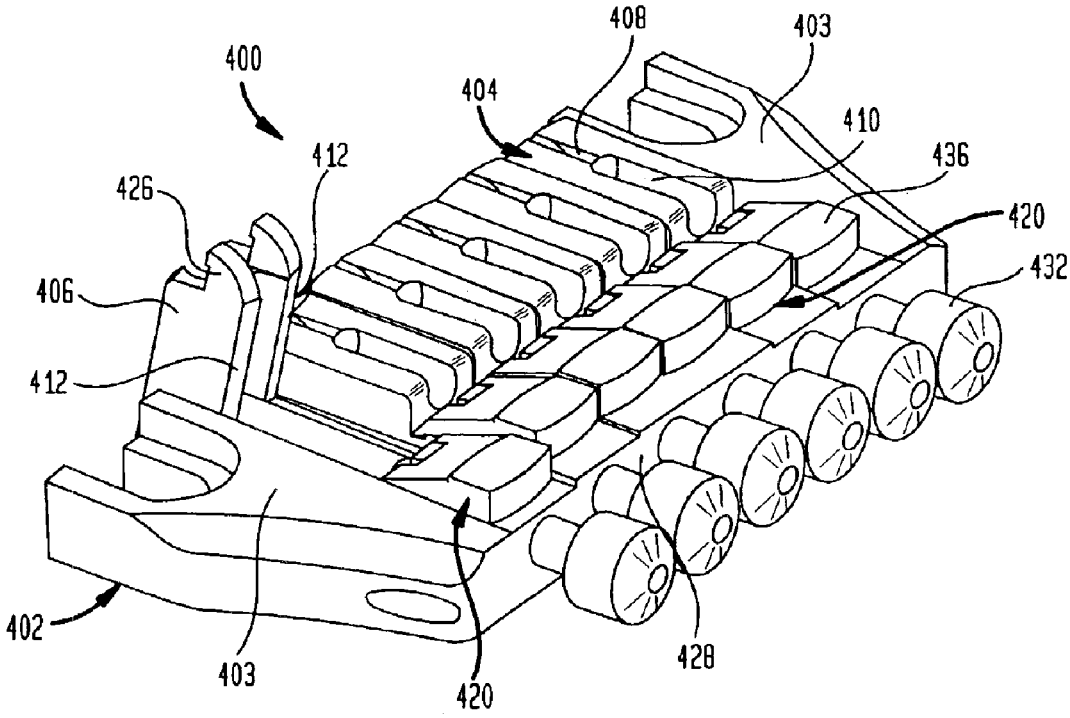

Each of the string holder assemblies 404 comprises a string holder member 406 having a top slot or channel 408 for receipt of a string and a generally cylindrically-shaped cavity 410 therebehind, into which the bullet 30 or other anchor attached to the end of a string 12 is adapted to be received and retained in place. The cavity 410 and slot 408 are generally similar to those in the string retention members 190, 348 shown with reference to the bridge assemblies 160, 310 shown in FIGS. 20–31 and 35–42. As best seen in FIG. 48, the lower portion of each string holder member 406 includes a pair of spaced rails or slide bars 412 which are adapted to rest on the slide surfaces 407 of the bridge base 402. As best seen in FIGS. 46–47, a support rod 414 is adapted to be received between the spaced rails 412 on the bottom of each of the string holder members 406. The forward end of each of the rods 414 includes an aperture 416 therein which is adapted to be aligned with a transverse aperture 418 provided at the forward end of the string holder member 406 and which is adapted to receive a pin to allow the string holder member 406 to rotate upwardly relative to the support rod 414. This is best illustrated in FIG. 48.

A slideable latch member 420 is adapted to be mounted on each of the support rods 414 rearwardly of its respective string holder member 406. Each. of the latch members 420 includes a central opening 422 therethrough which is adapted to receive its associated support rod 414 so as to be capable of being slideable thereon. A pair of latch fingers 424 extends forwardly on each slidable latch member 420. The latch fingers 424 are adapted to overlie rearwardly extending fingers 426 provided on the rear top portion of the side rails 412 of the associated string holder member 406. In this regard, the fingers 424, 426 on each latch member 420 and its associated string holder member 406 include mating extensions and indentations. In particular, the rearwardly extending fingers 426 on each string holder member 406 include a recess to receive the end extensions 426 of the fingers 424 on the associated latch member 420, with the fingers 426 on the string holder member 406 having raised ends adapted to be received in mating indentations 420 in the latch fingers 424. In this manner, when the latch member 420 is in its forward position and the fingers 424 engage the rearwardly extending fingers 426 of the associated string holder member 406, the string holder member 406 is locked into position and cannot rotate upwardly about the transverse pins in the apertures 416, 418. This latched position is best seen in FIG. 47.

The rear ends of the support rods 414 are each adapted to pass through suitable recesses or openings provided in the rear flange 428 on the bridge base 402, with a washer 430 and tuning adjustment knob 432 adapted to be placed thereon. A spring 434 is also placed on the rod 414 between the latch member 420 and the flange 428 of the bridge base 402. Rotation of the tuning adjustment knobs 432 serves to draw the support rod 414 rearwardly, or to allow it to move forwardly relative to the rear flange 428, to thereby adjust the position of the string holder member 406 vis-a-vis the bridge base 402 fixedly mounted on the instrument, and thus relative to the nut assembly (not shown). In other words, when the bridge assembly 400 is mounted on a guitar body, the tension on the strings 12 may be increased by rotation of the knobs 432 to pull the support rods 414, and thus the string holder members 406, rearwardly. Alternatively, the string holder members 406 can move forwardly toward the nut assembly by rotation of the knobs 432 in the opposite direction, thereby reducing the tension on the strings 12. Advantageously, since the string holder members 406 themselves move during the tuning, it is possible to convergently tune the strings 12, in accordance with the principles of U.S. Pat. No. 5,717,150, in which harmonic tuning (based on the distance between the critical contact surfaces on the nut and on the string holder members are adjusted) and pitch tuning (i.e. the tension on the strings) are accomplished substantially simultaneously.

In order to quickly and easily replace a string 12, all that is necessary is to push downwardly on the rear of the string holder members 406 to disengage the interlocking fingers 424, 426, and to then pull the latch members 420 rearwardly against the spring 434, so that the latch member fingers 424 no longer overlie the string holder member fingers 426, and allow the string holder members 406 to then pivot upwardly, as shown for one of the string holder members 406 in FIG. 48. In this regard, the latch members 420, as best seen in FIG. 47, are mounted in a recessed area provided in the bridge base 402, between the end of the slide surfaces 402 and the rear flange 428. Also, the top of the rear flange 428 may include raised or stepped surfaces corresponding to the shape of the fretboard, similar to the shelf segments 194, 195 and 196 of the bridge assembly 160 shown with reference to FIGS. 20–31. Pulling back on the latch members 420 allows the latch members 420 to slide rearwardly along the respective support rods 414. Conveniently, the movement of the latch members 420 to their release position is facilitated by the raised thumb pads 436 on the latch members 420.

Once a string 12 is replaced, with the bullet 30 placed in the cylindrical recess 410 of the string holder member 406, the string holder member 406 can simply be rotated downwardly. By virtue of the inclined surfaces on the lower back edges of each string holder member 406 adjacent the fingers 426 and on the upper top edges of the fingers 424 on the associated latch member 420, pushing down on the string holder member 406 will push the respective latch member 420 rearwardly, against the biasing force of the springs 434. Once the string holder member 406 is positioned on the slide surfaces 407 of the bridge base 402, and the top edges of the fingers 426 are below the fingers 424 on the associated latch member 420, the spring 434 will urge the latch member 420 forwardly to overlie the fingers 426. The string holder member 406 may then be released when the latch member 420 is in position to hold the string holder member 406 against rotation.

FIGS. 49–52 show a further embodiment of a bridge assembly 450 for use with an electric guitar and having a tremolo mechanism, similar to the bridge assembly 24 shown in FIGS. 6–19. However, unlike the bridge assembly 24 shown in FIGS. 6–19, the bridge assembly 450 shown with reference to FIGS. 49–52 is adapted for convergent tuning of the strings 12, i.e. substantially simultaneous harmonic and pitch tuning.

The bridge assembly 450 includes a bridge base 452 having side flanges 453 and a central recessed area 454 for individual saddle assemblies 456. The bottom of the bridge base 452 has a tremolo block 458 depending therefrom to which the balancing springs (not shown) of the tremolo are adapted to be attached. The forward ends of the side flanges 453 include recesses 455 for mating engagement with support posts (not shown) secured to the instrument body and about which the bridge base 452 will rotate during play in order to exhibit tremolo action. In this regard, one of the side flanges 453 includes a tremolo arm 457 attached thereto for rotating the bridge base 452 about the support posts to simultaneously release the tension of the strings 12 during play, as is known in the art.

Figure 49:
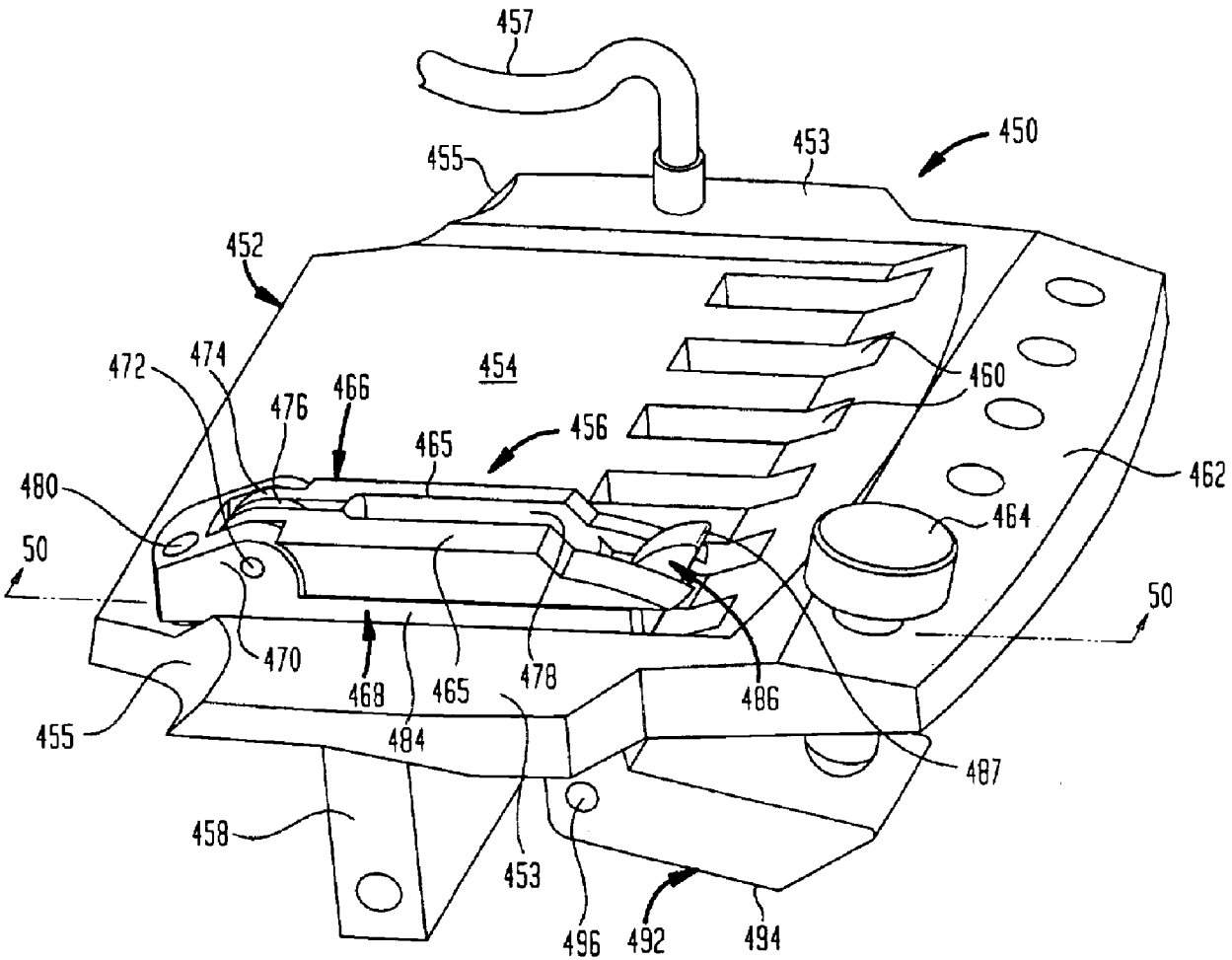
FIG. 49 is a side perspective view of a further embodiment of a bridge assembly for use on a stringed musical instrument, in accordance with a further aspect of the present invention, showing a single string retention mechanism in a locked or latched position, and with the other string retention mechanisms removed for illustrative purposes.

As best seen in FIG. 49, the bridge base 452 includes six slotted openings 460 in its rear, as well as a rear support flange 462 for supporting tuning screws 464, one of which is shown in FIG. 49. The individual saddle assemblies 456 are each adapted to be mounted in the central recessed area 454 for sliding movement in the longitudinal direction, i.e., in the direction that the strings 12 extend. Although not shown, the central recessed area 454 may include raised slide surfaces, similar to those provided with reference to the bridge assembly 24 of FIGS. 6–19.

Each of the individual saddle assemblies 456 includes a rotatable string retaining element 466 and a slide base member 468. The slide base member 468 includes raised flanges 470 at the forward end, having a transverse opening therethrough for receipt of a pin 472. The rotatable string retaining element 466 includes a forward nose 474 which is adapted to be pivotably supported between the upstanding flanges 470 of the slide base member 468 and mounted for rotation about the pin 472 extending therethrough. The string retaining element 466 includes a groove 476 in the top of the nose for receiving the instrument string 12 and providing a central contact surface therefor, and a cylindrical cavity 478 therebehind for receiving the bullet 30 or other anchor secured to the string 12.

Figure 50:
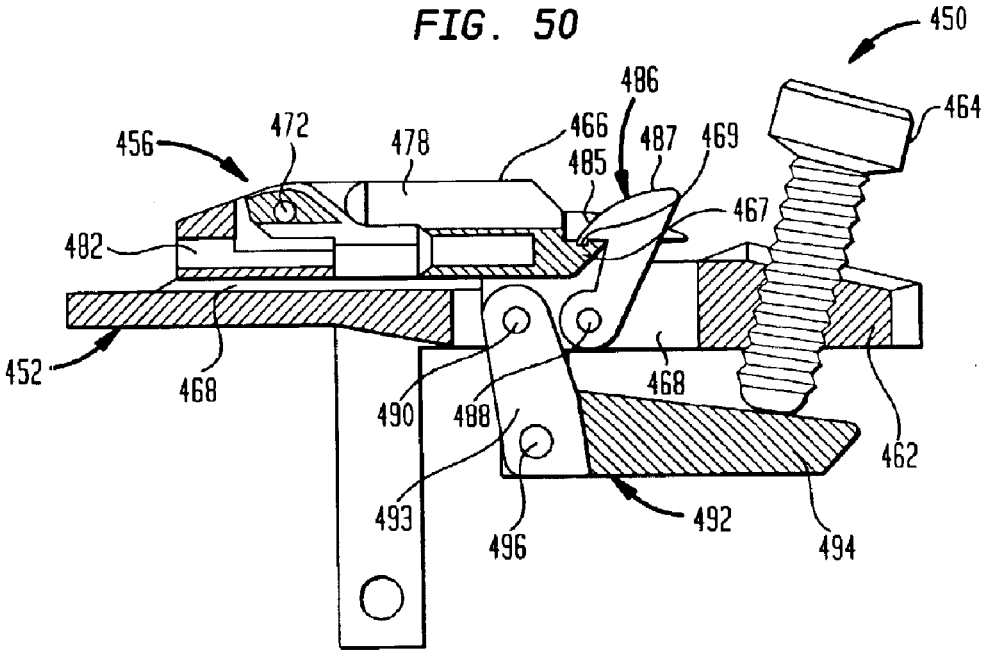
FIG. 50 is a side sectional view, taken along line 50—50 of FIG. 49.
Figure 51:
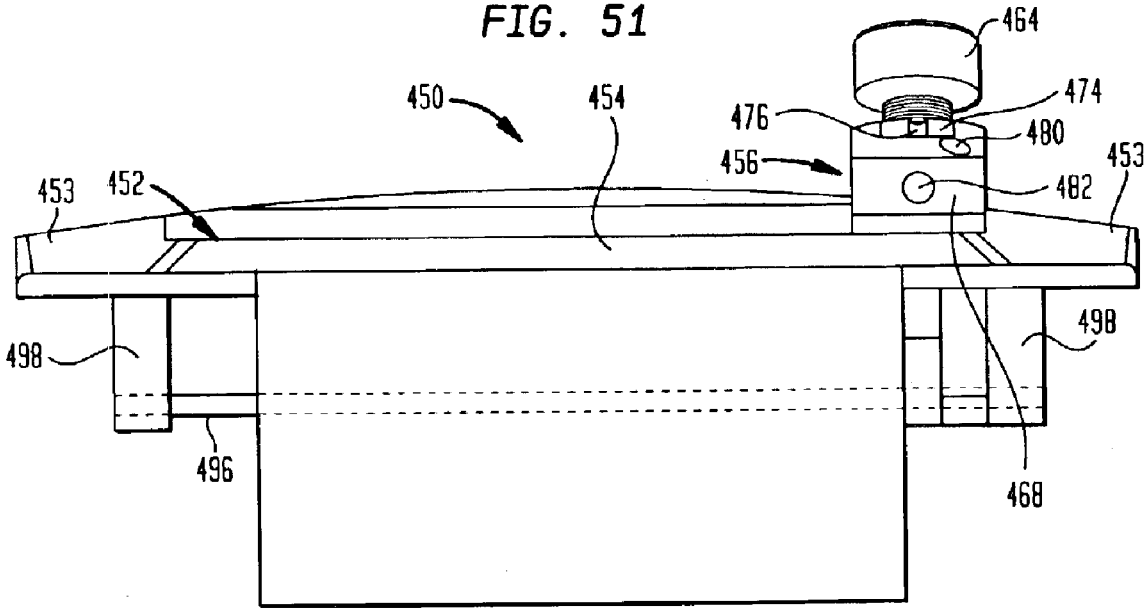
FIG. 51 is a front elevational view of the bridge assembly of FIG. 49.

The slide base member 468 includes a vertically extending threaded opening 480 having a allen-head screw or other threaded member (not shown) therein for adjusting the height of the saddle assembly 456 at the forward end, and thus the height of the string contact surface provided on the rotatable string retaining element 466. Also, the front face of the slide base member 468 includes a longitudinally extending threaded bore 482 adapted to receive a range adjustment bolt (not shown) therein for adjusting the position of the bullet 30 within the cavity 478 in the rotatable string retaining element 466. As best seen in FIG. 50, this is accomplished by having the bore 482 for the range adjustment bolt arranged below the elevation of the pin 472 and passing through lower portions of the slide base member 468 and the rotatable string retaining element 466. In other words, the recess 482 and the bolt therefor are at an elevation below that of the pin 472. As with the range adjustment bolts in the bridge assemblies 24, 160 shown in FIGS. 6–19 and in FIGS. 21–31, the bolt in the recess 482 serves to engage the beveled face 31 of the bullet 30, and thus adjust the relative position of the bullet 30 in the string retaining element 466.

Figure 52:
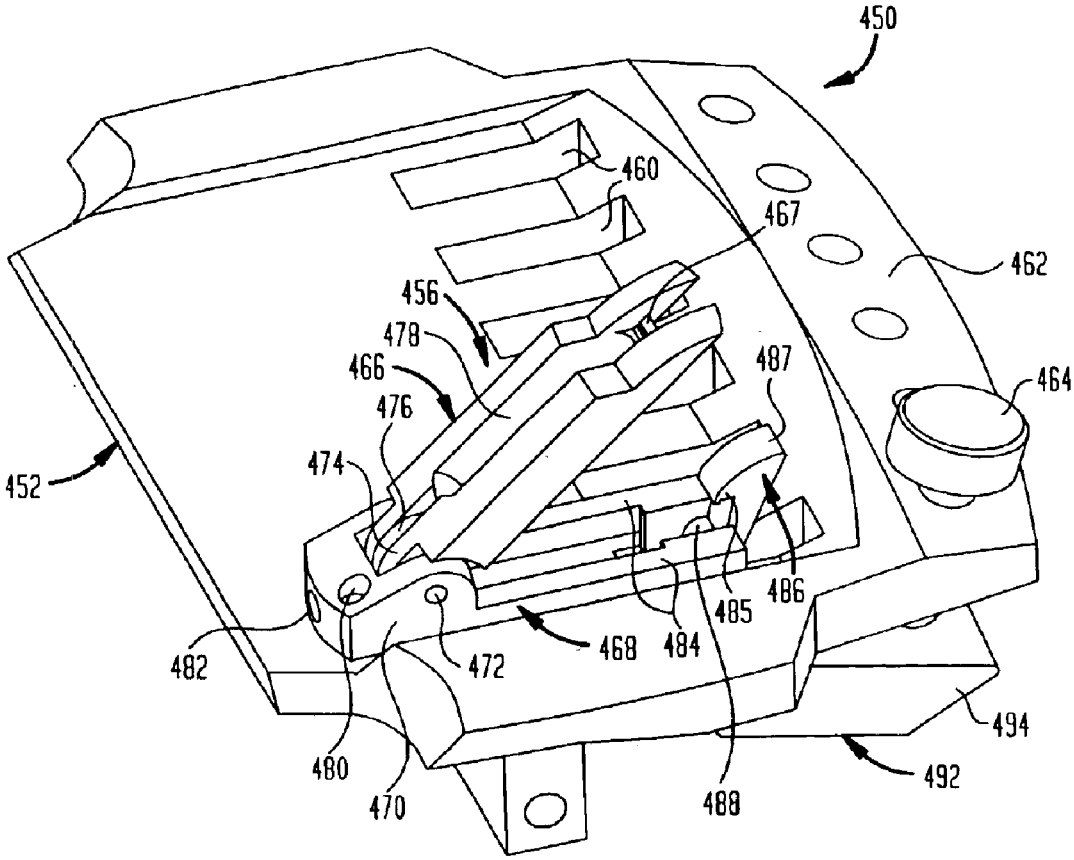
FIG. 52 is a side perspective view of the bridge assembly of FIG. 49, showing the single string retention component in a released position.

As best seen in FIG. 52, each slide base member 468 includes a pair of rearwardly extending rails 484 which are spaced from one another and which serve to support a latch mechanism 486 for releasably latching the string retaining element 466 and slide base member 468 together. In a preferred embodiment, the latch mechanism 486 comprises a thumb latch element which is pivotably mounted between the side rails 484 by means of a pin 488. Also, a dog leg lever 492 is provided for each of the slide base members 468. Each of the dog leg levers 492 includes an upper leg 493 which is pivotally connected to its respective saddle base member 468 by means of a pin 490 which is located on the side rails 484 forward of the pin 488. Each dog leg lever 492 is also pivotally mounted on a laterally extending rod 496 supported between a pair of spaced lower support flanges 498 extending beneath the side flanges 453 of the bridge base 452. The lateral extending rod bar 496 thus supports all of the dog leg levers 492 for rotation thereabout. The dog leg levers 492 also each include a rearwardly extending leg 494 which is adapted to be engaged by the respective tuning adjustment screws 464 carried by the rear flange 462 of the bridge base 452. Thus, all of the dog leg levers 492 for the individual string saddle assemblies 456 are supported for pivoting movement about a common rod or bar 496, with the lower rearwardly extending legs 494 being adapted to be engaged by the respective adjustment screws 464 and the upper legs 493 being pivotally connected to the respective slide base members 468.

With this type of arrangement, clockwise rotation (as viewed in FIG. 50) of a dog leg lever 492 about the rod 496 (as when the respective tuning adjustment screw 464 moves downwardly relative to the flange 462) serves to move the lower leg 494 downwardly, and thus move the upper leg 493 rearwardly. This in turn serves to move the slide base member 468 rearwardly. On the other hand, counterclockwise rotation of the dog leg lever 492 about the rod 496 (as when the tuning adjustment screw 464 is rotated to move upwardly relative to the flange 462) serves to pivot the upper leg 493 counterclockwise to move the slide base member 468 forward. Accordingly, it will be appreciated that the rotation of the tuning adjustment screws 464 serves to cause the slide base members 468 to move forwardly or rearwardly, depending upon the direction of rotation.

As noted above, the latch mechanism 486 for each of the saddle assemblies 456 comprises a thumb latch element 486 pivotally connected to the slide base member 468 in the recess provided between the side rails 484 at the rear end of the slide base member 468. The latch element 486 includes a forwardly extending latch finger 485 which is adapted to engage a rear ledge 467 provided on the rear of the rotatable string retaining element 466. Preferably, the tip of the latch finger 485 is adapted to be received in a corresponding recess 469 in the rear ledge 467. This is best shown with reference to FIGS. 50 and 52. The rear ledge 467 is conveniently arranged between the rearwardly extending side flanges 465 of the string retaining elements 466. The latch element 486 also includes a raised head or protrusion 487 above the latch finger 485 which extends above the side flanges 465 of its string retaining element 466 when the latch finger 485 engages the ledge 467. Conveniently, this raised head 487 is engageable by a thumb of a user to pivot the latch element 486 out of the way to allow release of the string retaining element 466 to rotate to release the tension on the string 12. Preferably, a tension spring (not shown) is provided to urge or bias the latch element 486 toward its latching position as shown in FIG. 50.

As with the other embodiments of the present invention, the rotatable string retaining element 466 is initially pushed downwardly to relieve the pressure on the latch element 486, and the latch element 486 then pivoted rearwardly with a user's thumb engaging the head 487. The string retaining element 466 is then allowed to rotate upwardly to release the tension on the string 12.

As noted above, the string saddle assemblies 456 as shown in the embodiment of FIGS. 49–52 are conveniently operative to convergently tune the strings 12. This is accomplished by rotation of the tuning adjustment screws 464 mounted on the rear flange 462 of the bridge base 452. In each instance, the lower end of each of the tuning adjustment screws 464 engages the rearwardly extending leg 494 of the associated dog leg lever 492, which serves to rotate the dog leg lever 492, either clockwise or counterclockwise as viewed in FIG. 50, and thus cause the associated slide base member 468 to slide either toward the nut assembly or away from the nut assembly depending on the direction of rotation of the tuning adjustment screws 464. As the slide base member 468 moves, the tension of the string 12 is adjusted. With properly manufactured strings, harmonic and pitch tuning is achieved substantially simultaneously.

During this tuning of the strings 12 by adjustment of the position of the saddle base member 468 and string pitch, the latch element 486 remains latched to the rotatable string retaining element 466. When it is desired to change a string 12, quick and easy release of the string tension is accomplished simply by pushing the rotatable string retaining element 466 downwardly and moving the latch element 486 to a release position to allow the string retaining element 466 to pivot upwardly by virtue of the string tension. When the string retaining element 466 is in its raised position, and the string tension completely released, the string 12 may simply be replaced by removing the string bullet 30 from the cavity 478 of the string retaining element 466 and a new string bullet 30 inserted therein. In this regard, the strings 12 typically would be inserted with the bullet-shaped anchor 30 at the nut end inserted first into the string holder at the nut and the bullet-shaped anchor 30 at the bridge end then inserted in the raised string retaining element 466. The string retaining element 466 would then be rotated downwardly into engagement with the latch element 486. The tension placed on the string 12 during this operation will serve to maintain the latch element 486 in its latching position with the latch finger 485 in engagement with the ledge 467 on the string retaining element 466. The string may then be retuned.

FIGS. 53–56 illustrate a still further embodiment of a bridge assembly 512 and string tuning apparatus for a stringed musical instrument 510 in accordance with the present invention. In particular, the bridge assembly 512 shown in FIGS. 53–56 includes a modified form of bridge latch mechanism 540 for releasably mounting the bridge assembly 512 to the musical instrument 510, which is different from the bridge latch mechanism 170 employed with the bridge assembly 160 shown and described with reference to FIGS. 20–31. Further, the bridge assembly 512 includes a plurality of modified string holder assemblies 514 for the plurality of strings 12 of the instrument 510, which enable quick and easy tuning of the strings 12. Advantageously, the string holder assemblies 514 employed on the bridge assembly 512 may incorporate convergent tuning principles such as disclosed in U.S. Pat. No. 5,717,150 by which both harmonic tuning and pitch tuning can be accomplished substantially simultaneously by the user of the instrument 510.

Figure 53:
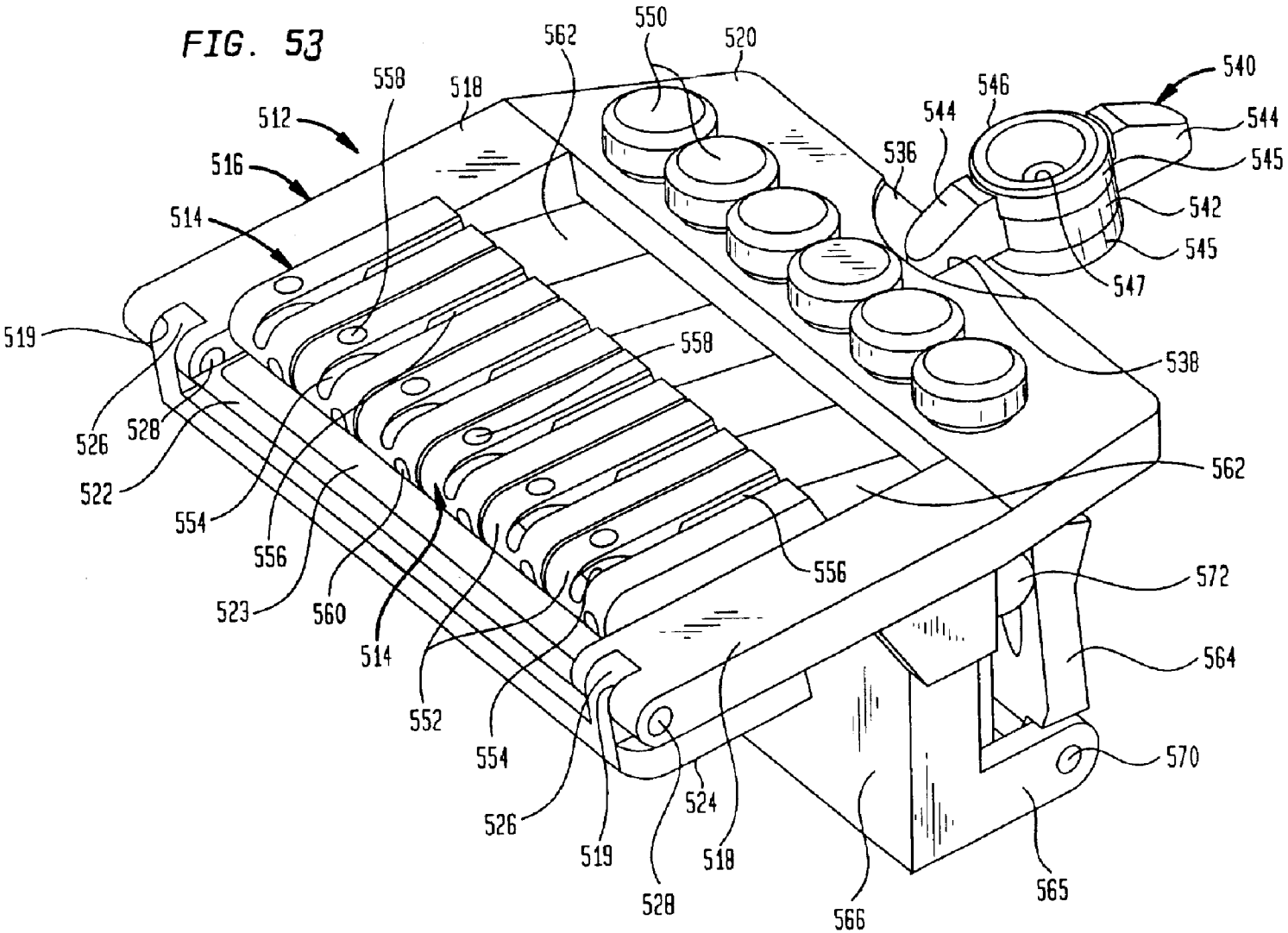
FIG. 53 is a side perspective view of a still further embodiment of a bridge assembly for use on a stringed musical instrument, in accordance with a further aspect of the present invention.
Figure 54:
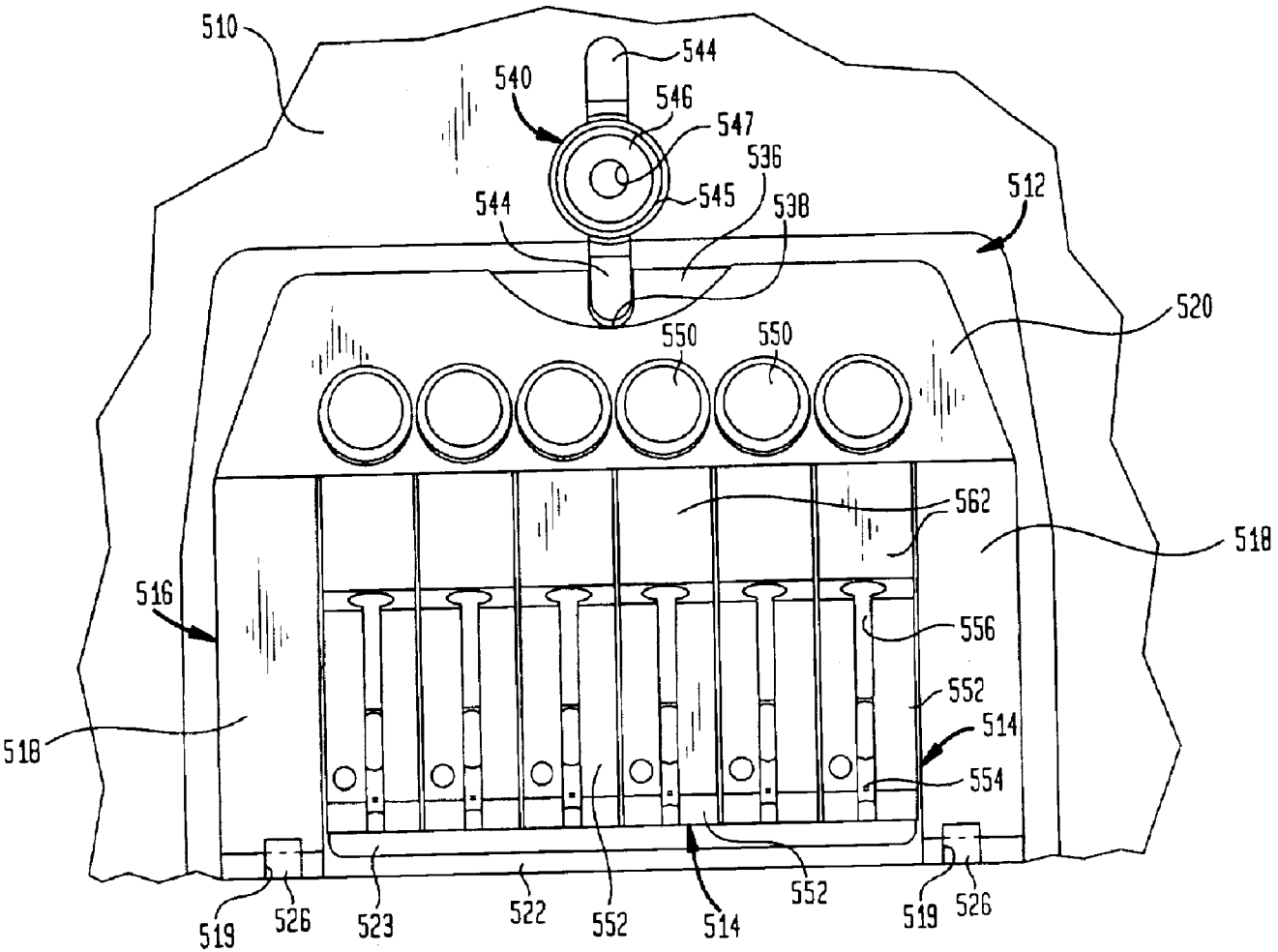
FIG. 54 is a top plan view of the bridge assembly of FIG. 53 shown mounted on a body of a stringed musical instrument.

The bridge assembly 512 shown in FIG. 53 may be used with either an electric guitar or an acoustic guitar, or any other type of stringed musical instrument. In this regard, the bridge assembly 512 is shown in FIG. 54 in plan view mounted to the body of a stringed musical instrument 510 such as an electric guitar. The bridge assembly 512 includes a bridge base 516 having a pair of laterally spaced side rails 518 which terminate at the rear end in a rear flange 520. A laterally extending support member 522 is provided at the front of the bridge base 516 between the side rails 518 for providing a support surface for the plurality of string holder assemblies 514 which hold one end of the strings 12. The support member 522 includes, in a preferred embodiment, an inset plate 523 of hardened metal to provide a hardened metal support surface on which the string holder assemblies 514 may be moved or slid toward and away from the nut assembly (not shown) of the stringed musical instrument 510, in a manner to be described more fully hereinbelow. Preferably, the insert plate 523 comprises a hardened steel plate, although other types of materials could be employed.

Figure 56:
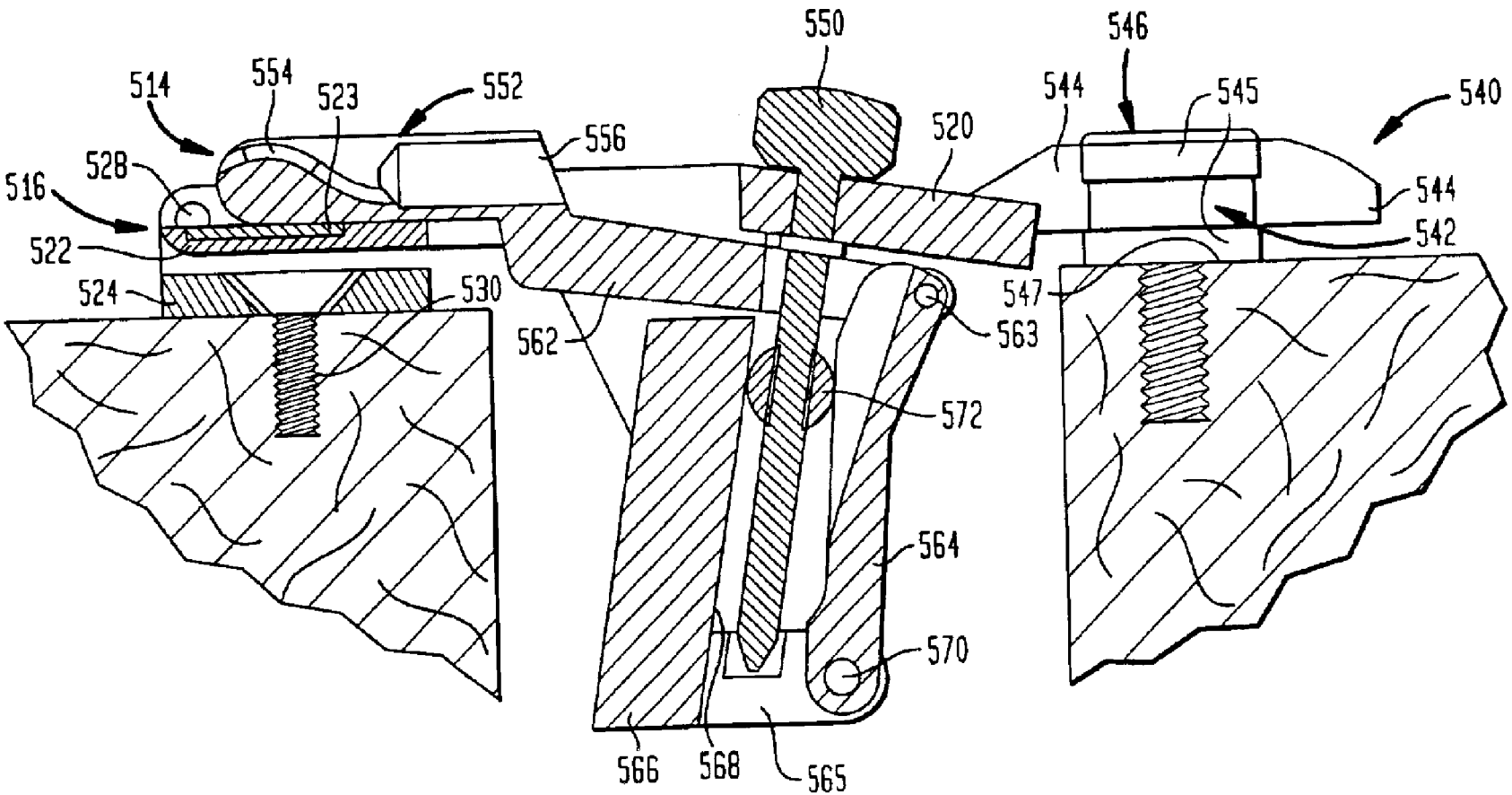
FIG. 56 is a side sectional view of the bridge assembly shown in FIG. 54, taken along line 56—56 of FIG. 54.

In a preferred embodiment, the bridge base 516 is adapted to be pivotally mounted on a lower support plate 524 which in turn is adapted to be secured to the body of the musical instrument 510. As best seen in FIGS. 53 and 56, the lower support plate 524 includes a pair of laterally spaced, upstanding flanges 526. Each of the side rails 518 includes a recess 519 in its forward edge to receive the upstanding flanges 526. Each of the upstanding flanges 526 and the front ends of the side rails 518 include a suitable transverse recess therein which may be aligned with one another for receipt of transversely extending pins or rods 528 which extend through the aligned recesses on each side of the bridge base 516. With this type of support arrangement, the bridge base 516 is adapted to pivot about the rods 528. As shown in FIG. 56, the lower support plate 524 may be mounted and secured to the body of the instrument in a suitable manner, such as by means of screws 530 or other fasteners.

The rear flange 520 of the bridge base 516 includes a recessed area 536 which is adapted to receive a latching finger 544 of the bridge latch mechanism 540. In this regard, the bridge latch mechanism 540 includes a latch ring 542 and a pair of laterally extending latch fingers 544 thereon, one of which serves to engage the bridge base 516 when in the latching position and the other of which may be used to assist in moving the latch ring 542 between the latching and release positions. The latch ring 542 is rotatably supported on a latch body 546 having a central opening 547 and spaced collars 545 for holding the latch ring 542 thereon. The latch ring 542 is mounted for rotation on the latch body 546 between the collars 545. The latch body 546 in turn is adapted to be secured to the body of the musical instrument 510 with a suitable screw or other fastener which extends through the central opening 547, while permitting the latch ring 542 to freely rotate thereabout.

In a preferred embodiment, the recess 536 in the rear of the bridge base 516 comprises a sector-shaped recess to allow one of the latch fingers 544 to swing therethrough, and includes a second, deeper recessed portion 538 centrally located in the recess 536 for receipt of the latch finger 544 in relatively close fitting relationship. The second, deeper recess 538 in which the latch finger 544 fits serves to prevent accidental movement of the latch ring 542 to a release position, as will be described more fully hereinbelow.

When the bridge assembly 512 is mounted to the body of the instrument 510 and the strings 12 are secured in the string holder assemblies 514 on the bridge base 516, and placed under tension, the strings 12 exert a force on the bridge assembly 512 that tends to cause the bridge assembly 512, if it were not held, to pivot upwardly about the rods or pins 528 at the front edge of the bridge base 516 (i.e., in a generally counterclockwise direction as viewed in FIGS. 53 and 56). The bridge latch mechanism 540 is operative to hold the rear end of the bridge base 516 down, and thus maintain the tension on the strings 12. This is the position shown in FIGS. 53–56. In this position, the latch finger 544 is received in the second, deeper recess 538 (see FIG. 55).

When it is desired to move the bridge assembly 512 to release the tension on all of the strings 12 to permit changing of the strings 12, the rear portion of the bridge base 516 is pushed downwardly to move the latch finger 544 out of the deeper, recessed portion 538, and the latch ring 542 is then rotated on the latch body 546 to move the latch finger 544 out of both recessed portions 536, 538, and thus out of interfering relationship with the bridge base 516. In this regard, the rear finger 544 on the latch ring 542 may be used to facilitate or assist in rotation of the latch ring 542 to move the forward latch finger 544 to a release position. Once the forward latch finger 544 is out of interfering relationship, the bridge base 516 may then be pivoted upwardly under the tension of the strings 12 until all of the tension is released. The strings 12 can then be removed from the string holder assemblies 514, as described more fully hereinbelow.

Since the bridge assembly 512 shown in FIGS. 53–56 is pivotally mounted to the lower support plate 524, it accordingly is not removable from the instrument 510 without removal of the pins 528. However, if desired, the bridge assembly 512 could be made to be easily and readily removable simply by removing or eliminating a segment of the upstanding flanges 526 on the lower support plate 524 between the outer edges thereof and the transverse recess therein. This "opening" or slot would provide access to the transverse recesses in the flanges 526 to allow the rods 528 to be lifted out of the flanges 526 and thus off the plate 524 once the bridge base 516 has been moved to its upper, rotated position to release the tension on the strings 12. Advantageously, this removal or elimination of a segment or portion of each of the upstanding flanges 526 (i.e., providing slots) could be accomplished by locating such slots away from the front edge of the flanges 526, or even possibly providing the slots in the upper extent in the flanges 526.

Turning now to the string holder assemblies 514 provided on the bridge assembly 512 for receiving the ends of the strings 12, the string holder assemblies 514 are generally similar to the string holder assemblies 164, 314 employed with the bridge assemblies 160 and 310 shown and described with reference to FIGS. 20–31 and 35–42, in that the string holder assemblies 514 are operative to be moved forwardly and rearwardly on the bridge base 516 by rotation of tuning adjustment members 550 mounted on the rear flange 520. However, unlike the string holder assemblies 164, 314 employed in the bridges 160 and 310, which are each comprised of a string retention element 190, 348 carried by a string slide member 192, 356 which is adapted and operative to slide along the bridge base 162, 312, each string holder assembly 514 for use on the bridge assembly 512 shown in FIGS. 53–56 does not include a separate string slide member. Instead, each string holder assembly 514 includes a string retention element 552 which is itself adapted and operative to slide directly on the bridge base 516, as described more fully hereinbelow.

Each of the string retention elements 552 includes a slot or channel 554 provided in its top surface for receipt of a string and a rear cavity or chamber 556 for receipt of a string bullet 30. Also, each string retention element 552 includes in its upper surface a threaded height adjustment bore 558 into which a threaded bolt or screw member (not shown) is provided for adjusting the height of the string retention element 552 at its forward end relative to the hardened metal plate insert 523 on which the string retention element 552 is adapted to slide or move. Still further, as with the string retention elements 190, 348 in the string holder assemblies 164 and 314, there is also provided at the front of each string retention element 552 a longitudinally extending, range adjustment bore 560 for receipt of a threaded range adjustment screw or bolt (not shown). The threaded bore 560 extends partially into the chamber 556 so that the end of the range adjustment bolt may engage the end of the string bullet 30 and adjust the position of the string bullet 30 within the string retention element 552, in a manner similar to that for the string retention elements 190, 348.

Figure 55:
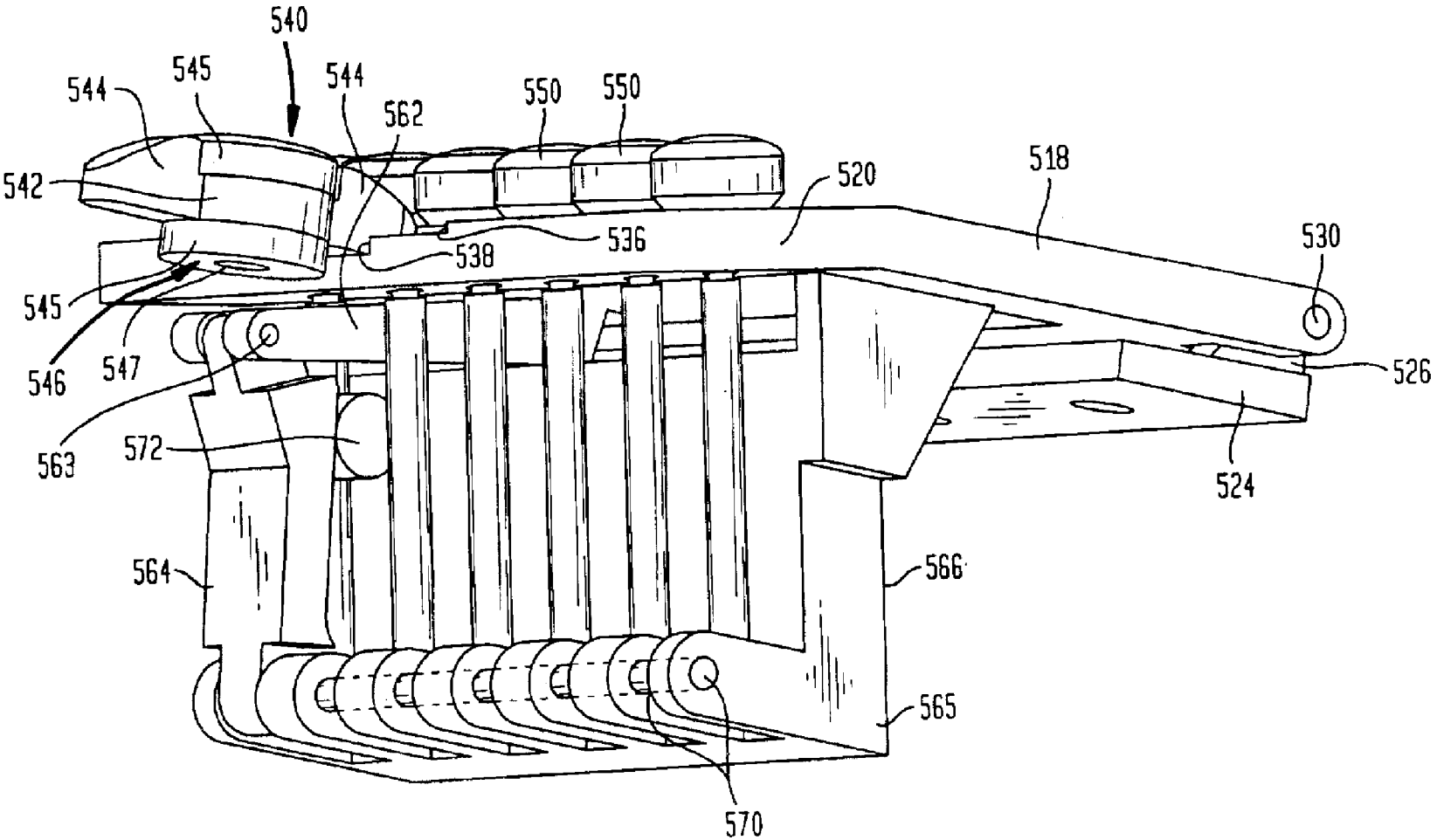
FIG. 55 is a rear perspective view of the bridge assembly shown in FIG. 53, with certain of the components removed for clarity.

Each of the string retention elements 552 also includes a rearwardly extending, depending leg 562 which extends rearwardly below the support 522 of the bridge base 516, as best seen in FIGS. 55–56. Each of the rearwardly extending legs 562 is slotted at its back end, and has pivotally mounted thereto (by means of a pin 563) a downwardly extending member or leg 564, one of which is shown in FIG. 55, which is used for adjusting the position of the string retention element 552 to which it is pivotably secured. The downwardly extending adjustment member or leg 564 is in turn pivotally mounted at its lower end to an extension 565 of a lower block member 566 secured to the bridge base 516.

As best seen in FIGS. 55–56, the lower block member 566 includes an inclined wall 568 and a lower lateral extension 565 to which the lower end of the legs 564 are attached by means of a rod 570 extending across the width of the block 566. Thus, each of the downwardly extending adjustment legs is pivotally secured at its lower end to the rod 570 so that each of the legs is pivotable about a common axis. A plurality of elongated, tuning adjustment screws 550 are journaled at their upper end in the rear support flange 520 and extend downwardly below the flange 520 between the inclined wall 568 of the block 566 and a respective, downwardly extending leg 564 pivotally attached to a respective string retention element 552. The lower ends of the tuning adjustment screws 550 are preferably received in suitable recesses (not shown) provided in the lower lateral extension 565 of the block 566.

A riser block 572 is threadably mounted on each of the tuning adjustment screws 550 between the lower extension and the rear flange 520. In a preferred embodiment, each of the riser blocks 572 comprises a generally cylindrical-shaped rod which includes a threaded opening transversely therethrough so that it may be threadably received on its associated tuning adjustment screw 550. As best seen in FIG. 56, each riser block 572 is arranged between the inclined wall 568 of the lower block 566 secured to the bridge base 516 and the downwardly extending adjustment leg 564 which is pivotably secured to the rear leg portion 562 of the string retaining element 552 and to the lower extension 565 of the block 566.

Accordingly, it will be appreciated that adjustment of the tension on the strings 12 can be easily accomplished simply by rotation of the tuning adjustment screws 550 mounted to the rear flange 520. In particular, rotation of each adjustment screw 550 in a clockwise direction serves to move the associated riser block 572 upwardly along the adjustment screw 550 and thus along the inclined wall 568 and along the length of the associated downwardly extending adjustment leg 564. Because the lower end of the adjustment leg 564 is pivotably mounted to the bridge base 516, as the riser block 572 moves upwardly it urges the upper end of the adjustment leg 564 rearwardly, thus pulling the associated string retaining element 552 rearwardly. This will serve to increase the tension on the string 12 held in the string retaining element 552. Rotation of the tuning adjustment screw 550 in a counterclockwise direction serves to move its associated riser block 572 downwardly along the adjustment screw 550 toward the lower extension 565 of the block 566. By virtue of the string tension on the string retaining element 552, which urges the string retaining element 552 toward the left as shown in FIG. 56, the riser block 572 slides along the inclined wall 586 and along the adjustment leg 564 during this travel. This in turn allows the associated string retention element 552 to move forwardly by virtue of the tension on the strings 12, which tends to pull the string retention element 552 to the left in FIG. 56.

Advantageously, the string holder assemblies 514 employed in the bridge assembly 512 may be used to accomplish convergent tuning of the strings 12, by properly choosing the length of the strings 12 and the placement of the bullets 30 thereon, so that movement of the string retention elements 552 to position the critical contact surfaces in position for precise harmonic tuning of the various particular strings 12 also serves to simultaneously accomplish pitch tuning thereof as well, in accordance with the principles disclosed in U.S. Pat. No. 5,717,150. In other words, during tuning of the strings 12 using a tuning adjustment screw 550, the associated string retention element 552 is moved away relative to the nut assembly (not shown) such that the tension on the associated string 12 is increased until a convergently tuned state is obtained (i.e., when harmonic and pitch tuning are substantially simultaneously achieved).

The bridge assembly 512 as shown with reference to FIGS. 53–56 is a fixed, non-tremolo type bridge assembly for use on an electric or acoustic guitar. However, the principles employed therein, both with respect to the tuning mechanism and with respect to the quick release features, could also be employed with respect to a tremolo mechanism for electric guitars. For instance, a separate tremolo support plate could be provided on which the bridge assembly 512 could be supported, with the tremolo plate itself being mounted in a conventional manner to provide a tremolo action, i.e. mounted for pivotal movement and including a balancing spring system to counterbalance the forces exerted by the strings. In such an arrangement, the tremolo plate would carry the upstanding flanges 526 for pivotally supporting the bridge base 516, and the latch mechanism 540 would be secured to the tremolo base. Alternatively, the bridge assembly 512 without the latch mechanism 540 could be employed as a tremolo bridge itself with only a very minor modification. More particularly, in place of the lower support plate 524 for pivotally mounting the front end of the bridge base 516, the side rails 518 of the bridge base 516 could be provided with suitable knife edge recesses, similar to those employed with respect to the bridge assembly 24 shown with reference to FIGS. 1–19, which are adapted to engage suitable support posts, such as support posts 134, mounted to the body of the guitar. The counterbalancing springs could then be secured to the bottom of the depending block 566 attached to the bridge base. A tremolo arm could then be provided on one of the side rails 518. Depressing of the tremolo arm would then serve to pivot the bridge base 516 to produce special sound effects typical with use of tremolo bridges.

Accordingly, it will be appreciated that in accordance with the present invention, there is provided a bridge assembly 160, 250, 310, 512 for a stringed musical instrument 150, 300, 510 having at least one string 12 and an instrument body 152, 302. The bridge assembly 160, 250, 310, 512 comprises a bridge base 162, 162', 312, 516 for supporting at least one string holder 164, 314, 514 thereon for holding one end of the string 12 of the musical instrument 150, 300, 510. At least one anchor member 180, 182; 264; 324; 546 is attached to the body 152, 302 of the stringed musical instrument 150, 300, 510. The bridge assembly 160, 250, 310, 512 is adapted to be assembled to the musical instrument 150, 300, 510 by means of a releasable latch mechanism 170, 252, 340, 540 which is attached to either the bridge base 162, 162', 312, 516 or to the anchor member 180, 182; 264; 324; 546. The latch mechanism 170, 252, 340, 540 is arranged and operative to engage either the anchor member 180, 182; 264; 324; 546 or the bridge base 162, 162', 312, 516 to secure the bridge base 162, 162', 312, 516 in a position on the instrument 150, 300, 510 so that the string 12 held by the at least one string holder 164, 314, 514 is placed under tension and adapted for play of the instrument 150, 300, 510. The latch mechanism 170, 252, 340, 540, however, is moveable to a release position to permit movement of the bridge base 162, 162', 312, 516 relative to the instrument body 152, 302 to release the tension on the string 12 held by the at least one string holder 164, 314, 514. In a preferred embodiment, the bridge assembly 160, 250, may be removed from the instrument 150, when the latch mechanism 170, 252, has been moved to its release position.

In accordance with another aspect of the present invention, the bridge assembly 160, 250 is a removable bridge assembly 160, 250, and the support mechanism for mounting of the bridge assembly 160, 250 is mountable to the instrument body 150 and has bridge engagement portions 166, 254 which are adapted to be releasably matable with the bridge base 162, 162' to mount the bridge base 162, 162' on the instrument body 152 in a position to place the strings 12 secured in the string holders 164 under tension. A latch mechanism 170, 252 is carried by either the bridge base 162, 162' or the body 152 of the musical instrument 150, and releasably engages the other of the bridge base 162, 162' and the instrument body 152. The latch mechanism 170, 252 is positionable in a latching position and a release position. When in the latching position, the latch mechanism 170, 252 secures the bridge base 162, 162' in mating engagement with the bridge engagement portions 166, 254 of the bridge support mechanism so that the strings 12 secured by the string holders 164 are under tension on the instrument body 152 to permit play of the instrument 150. When in the release position, the latch mechanism 170, 252 permits movement of the bridge base 162, 162' relative to the support mechanism to release the tension on the strings 12 secured in the string holders 164, and to thereby permit disengagement of the bridge base 162, 162' from the bridge engagement portions 166, 254. In a preferred embodiment, the bridge engagement portions 166 advantageously comprise support members 168 having spherical-shaped heads 167 which are adapted to be received in spherical recesses 173 in the bridge base 162, 162'.

In accordance with another aspect of the present invention, there is provided a tuning apparatus for stringed musical instruments 150, 300, 510 in which the strings 12 of the musical instrument 150, 300, 510 make a first critical contact with the instrument 150, 300, 510 at a point of the nut 156, 309 of the instrument 150, 300, 510 and a second critical contact at a point on the bridge 160, 310, 512 of the instrument 150, 300, 510. The tuning apparatus comprises a bridge base 162, 312, 516 having a support surface 174, 522 and a plurality of string holders 164, 134, 514 for the plurality of strings 12. Each of the string holders 164, 314, 514 is operative to hold one end of the string 12 and is supported on the bridge base 162, 312, 516 for movement in a direction toward and away from the nut 156, 309 of the musical instrument 150, 300, 510. Also, each of the string holders 164, 314, 514 includes an extension leg 212, 360, 564 extending below the support surface 174, 522 of the bridge base 162, 312, 516. A tuning mechanism is provided for each of the string holders 164, 314, 514 for adjusting the tension of the string 12 held thereby. Each tuning mechanism is carried by the bridge base 162, 312, 516 and comprises a riser block 232, 364, 572 operatively arranged to be slideably engageable with the extension leg 212, 360, 564 of the associated string holder 164, 314, 514 so that sliding movement of the riser block 232, 364, 572 relative to the extension leg 212, 360, 564 causes the extension leg 212, 360, 564 to move the string holder 164, 314, 514 in a direction toward or away from the nut 156, 309 of the musical instrument 150, 300, 510 to adjust the tension of the string 12 held thereby. An adjustment device 200, 320, 550 is also provided for causing the riser block 232, 364, 572 to move relative to the extension leg 212, 360, 564.

In accordance with yet a further aspect of the present invention, a tuning mechanism is provided for each of the string holders. 164, 314, 514 of a bridge assembly 160, 310, 512 which comprises a threaded rod 200, 320, 550 which is carried by the bridge base 162, 312, 516 and supported for rotation at first and second spaced support positions on the bridge base 162, 312, 516 and a riser block 232, 364, 572 threadably engaged by the threaded rod 200, 320, 550 between the first and second spaced support positions. The riser block 232, 364, 572 is operatively arranged to be slideably engageable with an extension leg 212, 360, 564 of its associated string holder 164, 314, 514 as the threaded rod 200, 320, 550 is rotated so that movement of the riser block 232, 364, 572 relative to the extension leg 212, 360, 564 causes the extension leg 212, 360, 564 to move the string holder 164, 314, 514 in a direction toward or away from the nut 156, 309 of the musical instrument 150, 300, 510 to thereby adjust the tension of the string 12 held thereby.

In accordance with a still further aspect of the present invention, a tuning apparatus is provided for a stringed musical instrument which comprises .a bridge base 52, 378, 402, 452 and a plurality of string retention members 54, 476, 404, 456 for the plurality of strings 12 of the musical instrument. Each of the string retention members 54, 376, 404, 456 is operative to hold one end of a string 12 and is mounted on the bridge base 52, 378, 402, 452 for rotation about a transverse axis extending transverse to the longitudinal extent of the string 12 held thereby. A string tensioning mechanism 94; 390; 414, 432; 464, 492 is provided for each of the string retention members 54, 376, 404, 456. Each string tensioning mechanism 94; 390; 414, 432; 464, 492 is operative to move its associated string retention member 54, 376, 404, 456 to adjust the tension of the string 12 held thereby. Each of the string tensioning mechanisms 94; 390; 414, 432; 456, 492 also includes a latching mechanism 80; 394, 397; 420; 486 which is operative to hold its associated string retention member 54, 376, 404, 456 against rotation about the transverse axis in a first direction as a result of tension on the string 12 held thereby, and is operative to release the latching mechanism 80; 394, 397; 420; 486 from holding the string retention member 54, 376, 404, 456 to permit free rotation of the string retention member 54, 376, 404, 456 in the first direction.

While the foregoing description and figures are directed toward preferred embodiments for the present invention, it should be appreciated that numerous modifications can be made to the structure and arrangement of the various components shown and described. Indeed, such modifications are encouraged to be made in the materials, structure and arrangement of the components of the various bridge assemblies and tuning apparatus in accordance with the present invention. For instance, most of the various components shown and described with particular embodiments can be employed in other of the embodiments. Similarly, the arrangement of various components in particular embodiments to provide particular features and/or advantages could be employed in the other embodiments. All such variations are deemed to be within the scope of the present invention.

Accordingly, although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A removable bridge assembly for a stringed musical instrument having an instrument body and at least one string, said bridge assembly comprising:

a) a bridge base carrying at least one string holder for securing an end of a string of the musical instrument;

b) a support mechanism mountable to the instrument body and having a bridge engagement portion, said bridge engagement portion being releasably mateable with said bridge base to mount said bridge base on the instrument body in a position to place the string secured by said at least one string holder under tension; and c) a latch mechanism carried by one of said bridge base and the body of the musical instrument and releasably engageable with the other of said bridge base and the instrument body, said latch mechanism being positionable in a latching position and a release position, said latch mechanism when in said latching position securing said bridge base in mating engagement with said bridge engagement portion of said bridge support mechanism so that the string secured by said at least one string holder is under tension on the instrument body to permit play of the instrument, and said latch mechanism when in said release position permitting movement of said bridge base relative to said support mechanism to release the tension on the string secured by said at least one string holder, and to thereby permit disengagement of said bridge base from said bridge engagement portion.

2. The removable bridge assembly of claim 1, wherein said latch mechanism is operative to resist movement of said bridge base under the influence of the tension of the string secured by said at least one string holder when said latch mechanism is in said latching position.

3. The removable bridge assembly of claim 2, wherein said latch mechanism comprises a latch member arranged to engage said bridge base at a location remote from the location that said bridge engagement portion mates with said bridge base.

4. The removable bridge assembly of claim 3, wherein said bridge engagement portion is adapted to engage said bridge base along a first edge of said bridge base, and wherein said latch member is engageable with said bridge base at a location spaced from said first edge.

5. The removable bridge assembly of claim 4, wherein said bridge base includes a recess adapted to receive said latch member when said latch member is in said latching position.

6. The removable bridge assembly of claim 5, wherein said recess in said bridge base comprises a slotted recess extending from an edge of said bridge base, and wherein said latch member is arranged and operative to move into and out of said slotted recess when said latch member is in its latching position.

7. The removable bridge assembly of claim 6, wherein said latch member includes an elongated shaft which is arranged to move in and out of said slotted recess and an enlarged head which engages said bridge base adjacent to said slotted recess when said shaft is in said latching position.

8. The removable bridge assembly of claim 1, wherein said latch mechanism comprises a rotatable latch member mounted to the body of the stringed musical instrument for rotation between said latching position and said release position.

9. The removable bridge assembly of claim 8, wherein said latch member is mounted for rotation about an axis extending transversely to the longitudinal extent of the string secured by said at least one string holder.

10. The removable bridge assembly of claim 9, wherein said latch member is spring biased toward said latching position.

11. The removable bridge assembly of claim 8, wherein said latch member is adapted to be secured to the body of the instrument by a longitudinally extending fastening member having an axis, and wherein said latch member is mounted for rotation about said axis of said fastening member.

12. The removable bridge assembly of claim 8, wherein said latch member is adapted to be secured to the body of the instrument with an over-center toggle lever system.

13. The removable bridge assembly of claim 12, wherein said over-center toggle lever system includes a lever arm pivotally mounted to said instrument body and pivotably secured to said latch member.

14. The removable bridge assembly of claim 1, wherein said bridge engagement portion comprises at least one support post mountable to the instrument body and wherein said bridge base includes a recess engageable with said at least one support post.

15. The removable bridge assembly of claim 14, wherein said bridge engagement portion includes a pair of support posts mountable to said instrument body at spaced locations along a line extending transverse to the longitudinal extent of the string secured by said at least one string holder, and wherein said bridge base includes a pair of spaced recesses for said pair of support posts.

16. The removable bridge assembly of claim 15, wherein each of said support posts includes a spherically-shaped head, and wherein each of said recesses in said bridge base comprises a spherical recess for said spherically-shaped heads of said support posts.

17. The removable bridge assembly of claim 1, wherein said support mechanism comprises a support bracket for mounting said bridge base for movement along a longitudinal direction parallel to the longitudinal extent of the string secured by said at least one string holder.

18. The removable bridge assembly of claim 17, wherein said support bracket includes lateral side sections for holding said bridge base against lateral movement relative to said support bracket while permitting said bridge base to move longitudinally between said lateral side portions.

19. The removable bridge assembly of claim 1, wherein said support mechanism is operative to support said bridge base for pivotable movement on the body of the instrument.

20. The removable bridge assembly of claim 19, wherein said support mechanism comprises a support member adapted to be secured to the instrument body, and wherein said bridge engagement portion comprises a pair of spaced apart, upstanding flanges on said support member for mounting said bridge base for said pivotable movement on the body of the instrument.

21. The removable bridge assembly of claim 20, wherein said bridge base includes a pair of spaced apart recesses for receiving said upstanding flanges on said support member, and wherein said support mechanism further includes transversely extending pins carried by said bridge base and passing through said upstanding flanges for mounting said bridge base for said pivotable movement.

22. The removable bridge assembly of claim 20, in which the stringed musical instrument is an acoustic guitar having an instrument body having a hollow sound chamber and a sound hole, and wherein said support member is adapted to be mounted to the instrument body inside the hollow sound chamber.

23. The removable bridge assembly of claim 22, wherein said support member comprises a support ring adapted to be mounted inside the hollow sound chamber and arranged to extend about the sound hole.

24. A bridge for a stringed musical instrument having at least one string and an instrument body, said bridge comprising:

a) a bridge base for supporting at least one string holder thereon for holding one end of a string of the musical instrument;

b) an anchor member attached to the body of said stringed musical instrument; and c) a releasable latch mechanism attached to one of said bridge base and said anchor member, said latch mechanism being arranged and operative to engage the other of said bridge base and said anchor member to secure said bridge base in a position on the instrument body so that the string held by said at least one string holder is placed under tension, and said latch mechanism being moveable to a release position to permit movement of said bridge base relative to the instrument body to release the tension on said string held by said at least one string holder.

25. The bridge of claim 24, wherein said releasable latch mechanism is operative to resist movement of said bridge base under the influence of the tension of the string secured by said at least one string holder when said latch mechanism is arranged and operative to engage the other of said bridge base and said anchor member.

26. The bridge of claim 25, wherein said latch mechanism is attached to said anchor and is arranged and operative to engage said bridge base.

27. The bridge of claim 26, wherein said latch mechanism comprises a latch member rotatably mounted to said anchor.

28. The bridge of claim 27, wherein said latch member is mounted to said anchor for rotation about an axis extending transversely to the longitudinal extent of the string secured by said at least one string holder.

29. The bridge of claim 28, wherein said latch member is spring biased toward engagement with said bridge base.

30. The bridge of claim 28, wherein said bridge base includes a recess to receive said latch member.

31. The bridge of claim 30, wherein said recess in said bridge base comprises a slotted recess extending from an edge of said bridge base, and wherein said latch member is arranged and operative to move into and out of said slotted recess.

32. The bridge of claim 31, wherein said latch member includes an elongated shaft arranged to move in and out of said slotted recess and an enlarged head which engages said bridge base adjacent to said slotted recess.

33. The bridge of claim 27, wherein said anchor comprises a fastening member having an axis and wherein said latch member is attached to said anchor for rotation about said axis of said fastening member.

34. The bridge of claim 27, wherein said latch member is attached to said anchor by an over-center toggle lever system.

35. The bridge of claim 34, wherein said over-center toggle lever system includes a lever arm pivotally mounted to said anchor and pivotally secured to said latch member.

36. The bridge of claim 24, further including a support mechanism mountable to the instrument body and engageable with said bridge base.

37. The bridge of claim 36, wherein said support mechanism comprises at least one support post mountable to the instrument body and wherein said bridge base includes a recess engageable with said at least one support post.

38. The bridge of claim 37, wherein said at least one support post includes a spherically-shaped head, and wherein said recess in said bridge base comprises a spherical recess for said spherically-shaped head.

39. The bridge of claim 38, wherein said support mechanism is operative to support said bridge base for pivotable movement on the body of the instrument.

40. The bridge of claim 36, wherein said support mechanism comprises a support bracket for mounting said bridge base for movement along a direction parallel to the longitudinal extent of the string secured by said at least one string holder.

41. The bridge of claim 40, wherein said support bracket includes lateral side sections for holding said bridge base against lateral movement relative to said support bracket while permitting said bridge base to move longitudinally between said lateral side sections.

42. A tuning apparatus for a stringed musical instrument having a plurality of strings, in which each of the strings of the musical instrument makes a first critical contact with the instrument at a point on the nut of the instrument and a second critical contact at a point on the bridge of the instrument, the tuning apparatus comprising:

a) a bridge base having a support surface;

b) a plurality of string holders for the plurality of strings of the musical instrument, each of said string holders being operative to hold one end of a string and being supported on said bridge base for movement in a direction toward or away from the nut of the musical instrument, and each of said string holders including an extension leg extending below said support surface of said bridge base; and c) a tuning mechanism for each of said string holders for adjusting the tension of the string held thereby, each said tuning mechanism being carried by said bridge base and comprising (i) a riser block operatively arranged to be slideably engageable with said extension leg of its associated string holder so that sliding movement of said riser block relative to said extension leg causes said extension leg to move said string holder in a direction toward or away from the nut of the musical instrument to adjust the tension of the string held thereby; and (ii) an adjustment device for causing said riser block to move relative to said extension leg.

43. The tuning apparatus of claim 42, wherein said adjustment device comprises a threaded member mounted on said bridge base for rotation, and wherein said riser block is threadably mounted to said threaded member for movement along said threaded member in response to rotation of said threaded member.

44. The tuning apparatus of claim 43, wherein said bridge base includes a support wall provided below said support surface of said bridge base and arranged so that said riser block is operatively arranged between said extension leg of its associated string holder and said support wall for sliding movement along both said extension leg and said support wall.

45. The tuning apparatus of claim 44, wherein said support wall is inclined relative to the orientation of said support surface of said bridge base.

46. The tuning apparatus of claim 45, wherein said extension leg extends in a direction below said support surface of said bridge base which is inclined relative to the orientation of said support surface of said bridge base.

47. The tuning apparatus of claim 42, wherein said string holder includes a string slide member mounted on said bridge base for movement along said support surface in a direction toward or away from the nut of the musical instrument, and a string retention element carried by said string slide member and operative to hold the end of a string, and wherein said string slide member includes said extension leg.

48. The tuning apparatus of claim 47, wherein said string slide member includes a slide surface arranged to slide along said support surface of said bridge base, and wherein said extension leg extends at an angle of between 15° and 90° to said slide surface.

49. The tuning apparatus of claim 48, wherein said support wall is arranged at an angle of between 15° and 90° to said support surface of said bridge base.

50. The tuning apparatus of claim 47, wherein said string retention element is pivotally mounted to said string slide member and includes a height adjustment member for adjusting the height of such string retention member relative to said string slide member.

51. The tuning apparatus of claim 42, wherein said extension leg is pivotably mounted to said string holder and wherein said string holder is mounted to slide directly along said support surface of said bridge base.

52. The tuning apparatus of claim 51, wherein said support surface includes an insert of hardened metal.

53. The tuning apparatus of claim 51, wherein said string holder includes a leg extending below said support surface and to which said extension leg is pivotally mounted.

54. The tuning apparatus of claim 53, wherein said extension leg is pivotally mounted at a first end to said string holder and pivotally connected at a second end to said bridge base.

55. The tuning apparatus of claim 54, wherein said bridge base includes a depending block member having a wall, and wherein said second end of said extension leg is pivotally connected to said block member at a location spaced from said support surface of said bridge base.

56. The tuning apparatus of claim 55, wherein said wall of said block member is inclined at an angle of between 15° and 90° to the orientation of said support surface of said bridge base.

57. The tuning apparatus of claim 42, wherein said string holder includes a height adjustment device for adjusting the height of said string holder relative to said support surface of said bridge base.

58. The tuning apparatus of claim 42, wherein said string holder includes a cavity for receipt of a string anchor and a slot in the surface thereof extending from said cavity for the string to extend from said string holder.

59. The tuning apparatus of claim 42, wherein said string holder includes a range adjustment device for adjusting the position of the string anchor in said cavity.

60. A tuning apparatus for a stringed musical instrument having a plurality of strings, in which each of the strings of the musical instrument makes a first critical contact with the instrument at a point on the nut of the instrument and a second critical contact at a point on the bridge of the instrument, the tuning apparatus comprising:

a) a bridge base;

b) a plurality of string holders for the plurality of strings of the musical instrument, each of said string holders being operative to hold one end of a string and being supported on said bridge base for movement in a direction toward or away from the nut of the musical instrument, and each of said string holders including an extension leg; and c) a tuning mechanism for each of said string holders for adjusting the tension of the string held thereby, each said tuning mechanism comprising a longitudinally-extending threaded member carried by said bridge base and supported for rotation at first and second spaced support positions on said bridge base, and a riser block threadably engaging said threaded member between said first and second spaced support positions, said riser block being operatively arranged to be slideably engageable with said extension leg of its associated string holder as said threaded member is rotated so that movement of said riser block relative to said extension leg causes said extension leg to move said string holder in a direction toward or away from the nut of the musical instrument to thereby adjust the tension of the string held thereby.

61. The tuning apparatus of claim 60, wherein said bridge base includes a support surface along which said plurality of string holders are supported for movement in a direction toward or away from the nut of the musical instrument and a support wall arranged to support said riser block for sliding movement therealong in response to rotation of said threaded member, said support wall, said riser block and said extension leg of said string holder being arranged so that said riser block is positioned between said support wall and said extension leg and is operative to slide along said support wall and said extension leg in response to rotation of said threaded member.

62. The tuning apparatus of claim 61, wherein said support wall is inclined relative to the orientation of said support surface of said bridge base.

63. The tuning apparatus of claim 62, wherein said extension leg extends in a direction which is inclined relative to the orientation of said support surface of said bridge base.

64. The tuning apparatus of claim 61, wherein said string holder includes a string slide member mounted on said bridge base for movement along said support surface in a direction toward or away from the nut of the musical instrument, and a string retention element carried by said string slide member and operative to hold the end of a string, and wherein said string slide member includes said extension leg.

65. The tuning apparatus of claim 64, wherein said string slide member includes a slide surface arranged to slide along said support surface of said bridge base, and wherein said extension leg extends at an angle of between 15° and 90° to said slide surface.

66. The tuning apparatus of claim 65, wherein said support wall is arranged at an angle of between 15° and 90° to said support surface of said bridge base.

67. The tuning apparatus of claim 64, wherein said string retention element is pivotally mounted to said string slide member and includes a height adjustment device for adjusting the height of said string retention member relative to said string slide member.

68. The tuning apparatus of claim 67, wherein said extension leg is pivotably mounted to said string holder and wherein said string holder is mounted to slide directly along said support surface of said bridge base.

69. The tuning apparatus of claim 68, wherein said support surface includes an insert of hardened metal.

70. The tuning apparatus of claim 68, wherein said string holder includes a leg portion to which said extension leg is pivotally mounted.

71. The tuning apparatus of claim 70, wherein said extension leg is pivotally mounted at a first end to said leg portion of said string holder and pivotally connected at a second end to said bridge base.

72. The tuning apparatus of claim 71, wherein said bridge base includes a block member having said support wall thereon, and wherein said second end of said extension leg is pivotally connected to said block member at a location spaced from said support surface of said bridge base.

73. The tuning apparatus of claim 72, wherein said support wall of said block member is inclined at an angle of between 15° and 90° to the orientation of said support surface of said bridge base.

74. The tuning apparatus of claim 60, wherein said string holder includes a height adjustment device for adjusting the height of said string holder on said bridge base.

75. The tuning apparatus of claim 60, wherein said string holder includes a cavity for receipt of a string anchor and a slot in the surface thereof extending from said cavity for the string to extend from said string holder.

76. The tuning apparatus of claim 60, wherein said string holder includes a range adjustment device for adjusting the position of the string anchor in said cavity.

77. A tuning apparatus for a stringed musical instrument having a plurality of strings, the tuning apparatus comprising:

a) a bridge base;

b) a plurality of saddle base members mounted for movement on said bridge base;

c) a plurality of string retention members for the plurality of strings of the musical instrument, each of said string retention members being operative to hold one end of a string and being mounted on one of said saddle base members for rotation about a transverse axis extending transverse to the longitudinal extent of the string held thereby; and d) a string tensioning mechanism for each of said string retention members, each of said string tensioning mechanisms being operative to move its associated string retention member to adjust the tension of the string held thereby, and each of said string tensioning mechanisms including a latching mechanism operative to hold its associated string retention member against rotation about said transverse axis in a first direction as a result of tension on the string held thereby, and operative to release said latching mechanism from holding said string retention member to permit free rotation of said string retention member in said first direction.

78. The tuning apparatus of claim 77, wherein each of said string tensioning mechanisms comprises an adjustment member rotatably supported on said bridge base and operatively arranged to cause its respective saddle base member to move in response to rotation of said adjustment member.

79. The tuning apparatus of claim 78, wherein each of said string tensioning mechanisms is operative to rotate its associated string retention member relative to its associated saddle base member to adjust the tension of the string held by said associated string retention member.

80. The tuning apparatus of claim 79, wherein each of said latch mechanisms comprises a slideable latch member mounted for sliding movement relative to its respective saddle base member between a latching position and a release position.

81. The tuning apparatus of claim 80, wherein said slideable latch member is biased toward said latching position.

82. The tuning apparatus of claim 80, wherein each of said adjustment members is arranged to engage said slideable latch member to cause its respective saddle base member to move in response to movement of said adjustment member to cause its respective string retention member to move to adjust the tension of the string held thereby.

83. The tuning apparatus of claim 82, wherein each of said adjustment members is arranged and operative to cause its respective saddle base member to rotate about an axis extending transversely to the longitudinal extent of the string held thereby to cause its respective string retention member to move to adjust the tension of the string held thereby.

84. The tuning apparatus of claim 83, wherein each of said latch mechanisms further includes a latch bar extending from its respective saddle base member and carrying said slideable latch member thereon for sliding movement between said latching position and said release position, and wherein each of said slideable latch members when in said latching position engages its respective string retention member to prevent rotation of said string retention member relative to said saddle base member, and when in said release position permits its respective string retention member to rotate relative to said saddle base member.

85. The tuning apparatus of claim 84, wherein each of said saddle base members is mounted for rotational movement about a transverse axis, and wherein each of said adjustment members engages its respective slideable latch member to adjust the rotational position of its respective saddle base member to in turn adjust the position of its respective string retention member to adjust the tension on the string held thereby.

86. The tuning apparatus of claim 85, further including an intonation adjustment member for each of said saddle base members and said string retention members for adjusting the intonation of the string held by its respective string retention member, each of said intonation adjustment members being mounted to said bridge base and each of said saddle base members and each of said string retention members being pivotably mounted to their respective intonation adjustment members for rotation about a transverse axis.

87. The tuning apparatus of claim 86, wherein each of said string retention members is mounted for rotation about a transverse axis coinciding with the transverse axis of rotation of its respective saddle base member.

88. The tuning apparatus of claim 80, wherein each of said latch members includes a latch finger engageable with its respective string retention member.

89. The tuning apparatus of claim 77, wherein each of said saddle base members is mounted on said bridge base for movement in a longitudinal direction corresponding to the longitudinal extent of the string held by its respective string retention member.

90. The tuning apparatus of claim 89, wherein each of said string retention members includes a cavity for receipt of a string anchor on a string and a slot for the string to extend from said string retention member.

91. The tuning apparatus of claim 90, further including a range adjustment device for each of said string retention members for adjusting the position of a string anchor within said cavity of said string retention member.

92. The tuning apparatus of claim 91, wherein each of said range adjustment devices comprises a threaded bore in its respective string retention member extending into said cavity in said string retention member, and a range adjustment member threadably mounted in said bore and including a portion engageable with a string anchor for adjusting the position of the string anchor within said cavity.

93. The tuning apparatus of claim 89, wherein each of said string tensioning mechanisms is operative to move its associated saddle base member in said longitudinal direction to move its associated string retention member to adjust the tension of the string held thereby.

94. The tuning apparatus of claim 93, wherein each of said saddle base members is mounted for sliding movement in said longitudinal direction on said bridge base, and wherein each of said string tensioning mechanisms is operative to cause said saddle base member to slide in said longitudinal direction to adjust the tension of the string held by said string retention member.

95. The tuning apparatus of claim 94, wherein each of said saddle base members includes an extension leg and wherein each of said string tensioning mechanisms comprises an adjustment member arranged to engage said extension leg to cause movement of said saddle base member.

96. The tuning apparatus of claim 95, wherein each of said extension legs is pivotably supported by its respective saddle base member.

97. The tuning apparatus of claim 96, wherein each of said extension legs comprises a dog leg lever pivotably supported by said bridge base, said dog leg lever having a first leg pivotably connected to its respective saddle base member and a second leg, and wherein each of said adjustment members engages said second leg of its respective dog leg lever to cause said dog leg lever to rotate to cause said first leg to move its respective saddle base member.

98. The tuning apparatus of claim 77, wherein each of said latch mechanisms comprises a latch member pivotably mounted on its respective saddle base member to pivot between a latching position and a release position.

99. The tuning apparatus of claim 98, wherein said latch member is biased toward said latching position.

100. The tuning apparatus of claim 98, wherein each of said latch members includes a latch finger engageable with its respective string retention member.

101. The tuning apparatus of claim 100, wherein each of said latch members engages its respective string retention member at a position remote from said transverse axis.

102. The tuning apparatus of claim 77, wherein each of said saddle base members includes a height adjustment device operatively arranged to adjust the height of said saddle base member relative to said bridge base.

103. The tuning apparatus of claim 102, wherein each of said height adjustment devices is threadably received in its respective saddle base member so as to extend out of the bottom thereof.

104. The tuning apparatus of claim 77, wherein said bridge base comprises a tremolo bridge adapted to be mounted on the musical instrument for movement about an axis transverse to the extent of the strings held thereby in a manner to release the tension on all of the strings to permit special sound effects, said tremolo bridge including a tremolo arm mounted on said bridge base.

105. The tuning apparatus of claim 77, wherein each of said string retention members is adapted to rotate about said transverse axis so as to release the tension on the strings held thereby when its respective latch mechanism is moved to said release position to permit removal of the string from ts respective string retention member.

106. A tuning apparatus for a stringed musical instrument having a plurality of strings, the tuning apparatus comprising:

a) a bridge base;

b) a plurality of string retention members for the plurality of strings of the musical instrument, each of said string retention members being operative to hold one end of a string and being mounted on said bridge base for rotation about a transverse axis extending transverse to the longitudinal extent of the string held thereby; and c) a string tensioning mechanism for each of said string retention members, each of said string tensioning mechanisms comprising an adjustment member supported by said bridge base for movement relative thereto and operatively arranged to cause its associated string retention member to rotate about said transverse axis in response to movement of said adjustment member to adjust the tension of the string held thereby, and each of said string tensioning mechanisms further including a latching mechanism operative to hold its associated string retention member against rotation about said transverse axis in a first direction as a result of tension on the string held thereby, and operative to release said latching mechanism from holding said string retention member to permit free rotation of said string retention member in said first direction.

107. The tuning apparatus of claim 106, wherein each of said adjustment members includes an engagement portion engageable with its respective string retention member at a location remote from said transverse axis, and wherein each of said adjustment members is supported by said bridge base for movement to adjust the position of said engagement portion relative to said bridge base to thereby adjust the rotational position of its respective string retention member.

108. The tuning apparatus of claim 107, wherein each of said latching mechanisms comprises a pivotable latch support member pivotably supported by said bridge base so as to be pivotable between a latch position and a release position, and wherein each of said adjustment members is supported by said pivotable latch support member for movement relative thereto and arranged so that said engagement portion of said adjustment member is in engagement with its respective string retention member when said pivotable latch support member is in said latch position and so that said engagement portion is removed from engagement with its respective string retention member when said pivotable latch support member is in said release position.

109. The tuning apparatus of claim 108, wherein each of said string retention members includes a slot therein at said location remote from said transverse axis for receipt of said engagement portion of said adjustment member.

110. The tuning apparatus of claim 109, wherein each of said engagement portions comprises an enlarged head on its respective adjustment member, and wherein said each of said adjustment members includes a threaded shaft threadably supported in its respective pivotable latch support member, each of said threaded shafts being adapted to be received in said slot of its respective string retention member with said enlarged head engaging said string retention member.

111. The tuning apparatus of claim 110, wherein each of said pivotable support members comprises a pivotably mounted block member having a threaded bore therein for receipt of said threaded shaft of its respective adjustment member.

112. The tuning apparatus of claim 111, wherein each of said adjustment members when in said latch position has said enlarged head engaging its respective string retention member at said location remote from such transverse axis, and wherein each of said adjustment members when in said release position is out of engagement with its respective string retention member.

113. The tuning apparatus of claim 112, wherein said bridge base includes an opening for receipt of said enlarged head of each of said adjustment members when each said adjustment member is pivoted to said release position.

114. The tuning apparatus of claim 106, wherein said bridge base includes string contact blocks thereon for supporting the strings of the musical instrument, each of said string contact blocks being arranged on said bridge base adjacent to said transverse axes of said string retention members.

115. The tuning apparatus of claim 114, wherein each of said string contact blocks provide a critical contact surface for a string.

116. The tuning apparatus of claim 115, wherein each of said string retention members is pivotally mounted on said bridge base to pivot about said transverse axis.

117. The tuning apparatus of claim 116, wherein each of said plurality of string retention members is supported by a transversely extending shaft carried by said bridge base and extending transversely of said bridge base.

118. The tuning apparatus of claim 117, wherein each of said string retention members is arranged for rotation about a common transverse axis provided on said bridge base.

119. The tuning apparatus of claim 106, wherein each of said string retention members includes a cavity therein for receipt of a string anchor and a slot extending from said cavity through which the string extends from said string retention member.

120. The tuning apparatus of claim 106, wherein each of said string retention members is adapted to rotate about said transverse axis so as to release the tension on the strings held thereby when its respective latch mechanism is moved to said release position to permit removal of the string from its respective string retention member.

121. A tuning apparatus for a stringed musical instrument having a plurality of strings, the tuning apparatus comprising:

a) a bridge base;

b) a plurality of string retention members for the plurality of strings of the musical instrument, each of said string retention members being operative to hold one end of a string and being mounted on said bridge base for rotation about a transverse axis extending transverse to the longitudinal extent of the string held thereby; and c) a string tensioning mechanism for each of said string retention members, each of said string tensioning mechanisms comprising an adjustment member supported by said bridge base for movement relative thereto and operatively arranged to cause its associated string retention member to move in response to movement of said adjustment member to adjust the tension of the string held thereby, and each of said string tensioning mechanisms further including a latching mechanism operative to hold its associated string retention member against rotation about said transverse axis in a first direction as a result of tension on the string held thereby, and operative to release said latching mechanism from holding said string retention member to permit free rotation of said string retention member in said first direction.

122. The tuning apparatus of claim 121, wherein each of said string retention members is supported on its respective adjustment member for rotation about said transverse axis.

123. The tuning apparatus of claim 122, wherein said bridge base includes a rear flange; wherein each of said adjustment members includes an elongated shaft extending through said rear flange in a direction corresponding to the longitudinal extent of the string held by its respective string retention member, and a movement device for causing said shaft to move longitudinally relative to said rear flange of said bridge base to adjust the tension on said string held by its respective string retention member, each of said shafts including a first end and a second end; and wherein each of said string retention members is pivotally mounted to said first end of said shaft of its respective adjustment member.

124. The tuning apparatus of claim 123, wherein each of said shafts includes a threaded portion of said second end, and wherein each of said movement devices comprises a knob threadably mounted to said second end of said shaft whereby rotation of said knob serves to move said shaft longitudinally relative to said rear flange of said bridge base.

125. The tuning apparatus of claim 123, wherein each of said latch mechanisms comprises a latch member mounted for sliding movement on said elongated shaft of its respective adjustment member between a latch position and a release position, each of said latch members being arranged between its respective string retention member and said rear flange of said bridge base.

126. The tuning apparatus of claim 125, wherein each of said latch members when in said latch position engages a portion of said string retention member at a location remote from said transverse axis, and wherein each of said latch members is slideable towards said second end of said shaft of its respective adjustment member to release said string retention member.

127. The tuning apparatus of claim 126, wherein each of said slideable latch members includes a latch finger for engaging said string retention member at said location remote from said transverse axis and wherein each of said string retention members has a locking finger adapted to interlock with said latch finger when its respective latch member is in said latch position.

128. The tuning apparatus of claim 127, wherein each of said string retention members is adapted to be rotated to disengage said interlocked fingers to permit said latch member to slide away from its respective string retention member.

129. The tuning apparatus of claim 128, wherein each of said slideable latch members includes a thumb engageable portion for moving said latch member between said latch position and said release position.

130. The tuning apparatus of claim 125, further including a spring for biasing said latch member toward said latch position.

131. The tuning apparatus of claim 122, wherein each of said string retention members includes a cavity for receipt of a string anchor and a slot therein for a string to extend from said string retention member.

132. The tuning apparatus of claim 131, wherein each of said string retention members includes a range adjustment device for adjusting the position of a string anchor within said cavity of said string retention member.

133. The tuning apparatus of claim 132, wherein each of said range adjustment devices comprises a threaded bore in its respective string retention member extending into said cavity in said string retention member, and a range adjustment member threadably mounted in said threaded bore and including a portion engageable with a string anchor for adjusting the position of the string anchor within said cavity.

134. The tuning apparatus of claim 121, wherein each of said string retention members includes a cavity therein for receipt of a string anchor and a slot extending from said cavity through which the string extends from said string retention member.

135. The tuning apparatus of claim 121, wherein each said string retention members is adapted to rotate about said transverse axis so as to release the tension on the strings held thereby when its respective latch mechanism is moved to said release position to permit removal of the string from its respective string retention member.

136. A stringed musical instrument comprising:

a) an instrument body;

b) a plurality of strings each having a first end secured to said instrument body and a second end;

c) a removable bridge assembly having a bridge base and a plurality of string holders for holding said second ends of said strings;

d) a support mechanism mounted to said instrument body and having a bridge engagement portion, said bridge engagement portion being releasably mateable with said bridge base to mount said bridge base on said instrument body in a position to place said strings held by said string holders under tension; and e) a latch mechanism carried by one of said bridge base and said instrument body and releasably engagable with the other of said bridge base and said instrument body, said latch mechanism being positionable in a latching position and a release position, said latch mechanism when in said latching position securing said bridge base in mating engagement with said bridge engagement portion of said support mechanism so that said strings held by said string holders are under tension on said instrument body to permit play of said instrument, and said latch mechanism when in said release position permitting movement of said bridge base relative to said support mechanism to release the tension on said strings held by said string holders and to thereby permit disengagement of said bridge base from said bridge engagement portion of said support mechanism to allow removal of said bridge assembly from said instrument body.

137. The stringed musical instrument of claim 136, wherein said latch mechanism is operative to resist movement of said bridge base under the influence of the tension of said strings held by said string holders when said latch mechanism is in said latching position.

138. The stringed musical instrument of claim 137, wherein said latch mechanism comprises a latch member arranged to engage said bridge base at a location remote from the location that said bridge engagement portion mates with said bridge base.

139. The stringed musical instrument of claim 136, wherein said latch mechanism comprises a rotatable latch member mounted to said instrument body for rotation between said latching position and said release position.

140. A stringed musical instrument comprising:

a) an instrument body;

b) a plurality of strings each having a first end secured to said instrument body and a second end;

c) a bridge having a plurality of string holders thereon for holding said second ends of said strings;

d) an anchor member attached to said instrument body; and e) a releasable latch mechanism attached to one of said bridge and said anchor member, said latch mechanism being arranged and operative to engage the other of said bridge and said anchor member to secure said bridge in a position on said instrument body so that said strings held by said string holders on said bridge are placed under tension, and said latch mechanism being moveable to a release position to permit movement of said bridge relative to said instrument body to release the tension on said strings held by said string holders on said bridge.

141. The stringed musical instrument of claim 140, wherein said releasable latch mechanism is operative to resist movement of said bridge under the influence of the tension of said strings held by said string holders on said bridge when said latch mechanism is arranged and operative to engage the other of said bridge and said anchor member.

142. The stringed musical instrument of claim 140, further including a support mechanism mounted on said instrument body and engageable with said bridge.

143. The stringed musical instrument of said 142, wherein said support mechanism comprises at least one support post mountable to said instrument body, and wherein said bridge includes a recess engageable with said at least one support post.

144. The stringed musical instrument of claim 142, wherein said support mechanism comprises a support bracket for mounting said bridge for movement along a direction parallel to the longitudinal extent of said strings held by said string holders on said bridge.

145. The stringed musical instrument of claim 142, wherein said instrument body comprises an instrument body having a hollow sound chamber therein and a sound hole, wherein said support mechanism comprises a support frame adapted to be mounted inside said hollow sound chamber adjacent said sound hole, and wherein said support frame includes a pair of spaced apart, upstanding flanges for mounting said bridge base for pivotable movement relative to said support frame.

146. A stringed musical instrument comprising:

a) an instrument body;

b) a neck attached to said instrument body and having a string nut thereon;

c) a bridge assembly mounted on said instrument body;

d) a plurality of strings, each of said strings making a first critical contact on said string nut of said neck and a second critical contact on said bridge assembly mounted on said instrument body; and e) said bridge assembly having a bridge base having a support surface, a plurality of string holders for holding said plurality of strings, and a tuning mechanism for each of said string holders for adjusting the tension of said strings held thereby, each of said string holders being operative to hold one end of one of said strings and being supported on said bridge base for movement in a direction toward or away from said string nut on said neck, and each of said string holders including an extension leg extending below said support surface of said bridge base, and each of said tuning mechanisms being carried by said bridge base and comprising (i) a riser block operatively arranged to be slidably engageable with said extension leg of its associated string holder so that sliding movement of said riser block relative to said extension leg causes said extension leg to move said associated string holder in a direction toward or away from said string nut on said neck to adjust the tension of said string held thereby; and (ii) an adjustment device for causing said riser block to move relative to said extension leg.

147. The stringed musical instrument of claim 146, wherein said adjustment device comprises a threaded member mounted on said bridge base for rotation, and wherein said riser block is threadably mounted to said threaded member for movement along said threaded member in response to rotation of said threaded member.

148. The stringed musical instrument of claim 147, wherein said bridge base includes a support wall provided below said support surface of said bridge base and arranged so that said riser block is operatively arranged between said extension leg of its associated string holder and said support wall for sliding movement along both said extension leg and said support wall.

149. The stringed musical instrument of claim 148, wherein said support wall is inclined relative to the orientation of said support surface of said bridge base.

150. A stringed musical instrument comprising:

a) an instrument body;

b) a neck attached to said instrument body and having a string nut thereon;

c) a bridge assembly mounted on said instrument body;

d) a plurality of strings, each of said strings making a first critical contact on said string nut of said neck and a second critical contact on said bridge assembly mounted on said instrument body; and e) said bridge assembly having a bridge base, a plurality of string holders for holding said plurality of strings, and a tuning mechanism for each of said string holders for adjusting the tension of said strings held thereby, each of said string holders being operative to hold one end of one of said strings and being supported on said bridge base for movement in a direction toward or away from said string nut on said neck, and each of said string holders including an extension leg, and each of said tuning mechanisms comprising a longitudinally-extending threaded member carried by said bridge base and supported for rotation at first and second spaced support positions on said bridge base, and a riser block threadably engaging said threaded member between said first and second spaced support positions, said riser block being operatively arranged to be slidably engageable with said extension leg of its associated string holder as said threaded member is rotated so that movement of said riser block relative to said extension leg causes said extension leg to move said associated string holder in a direction toward or away from said string nut on said neck to adjust the tension of said string held thereby.

151. The stringed musical instrument of claim 150, wherein said bridge base includes a support surface along which said plurality of string holders are supported for movement in a direction toward or away from the nut of the musical instrument and a support wall arranged to support said riser block for sliding movement therealong in response to rotation of said threaded member, said support wall, said riser block and said extension leg of said string holder being arranged so that said riser block is positioned between said support wall and said extension leg and is operative to slide along said support wall and said extension leg in response to rotation of said threaded member.

152. The stringed musical instrument of claim 151, wherein said support wall is inclined relative to the orientation of said support surface of said bridge base.

153. A stringed musical instrument comprising:

a) an instrument body;

b) a plurality of strings;

c) a bridge base mounted on said instrument body;

d) a plurality of saddle base members mounted for movement on said bridge base;

e) a string retention member for each of said saddle base members, each of said string retention members being operative to hold one end of one of said strings and being mounted on one of said saddle base members for rotation about a transverse axis extending transverse to the longitudinal extent of said string held thereby; and f) a string tensioning mechanism for each of said string retention members, each of said string tensioning mechanisms being operative to move its associated string retention member to adjust the tension of said string held thereby, and each of said string tensioning mechanisms including a latching mechanism operative to hold its associated string retention member against rotation about said transverse axis in a first direction as a result of tension on said string held thereby, and operative to release said latching mechanism from holding said string retention member to permit free rotation of said string ret tion member in said first direction.

154. The stringed musical instrument of claim 153, wherein each of said string tensioning mechanisms comprises an adjustment member rotatably supported on said bridge base and operatively arranged to cause its respective saddle base member to move in response to rotation of said adjustment member.

155. The stringed musical instrument of claim 154, wherein each of said string tensioning mechanisms is operative to rotate its associated string retention member relative to its associated saddle base member to adjust the tension of said string held by said associated string retention member.

156. The stringed musical instrument of claim 153, wherein each of said saddle base members is mounted on said bridge base for movement in a longitudinal direction corresponding to the longitudinal extent of said string held by its respective string retention member.

157. The stringed musical instrument of claim 156, wherein each of said string tensioning mechanisms is operative to move its associated saddle base member in said longitudinal direction to move its associated string retention member to adjust the tension of said string held thereby.

158. The stringed musical instrument of claim 153, wherein each of said string retention members is adapted to rotate about said transverse axis so as to release the tension on said string held thereby when its respective latch mechanism is moved to said release position to permit removal of said string from its respective string retention member.

159. A stringed musical instrument comprising:

a) an instrument body;

b) a plurality of strings;

c) a bridge base mounted on said instrument body;

d) a plurality of string retention members for said plurality of strings, each of said string retention members being operative to hold one end of one of said strings and being mounted on said bridge base for rotation about a transverse axis extending transverse to the longitudinal extent of said string held thereby; and e) a string tensioning mechanism for each of said string retention members, each of said string tensioning mechanisms comprising an adjustment member supported by said bridge base for movement relative thereto and operatively arranged to cause its associated string retention member to move in response to movement of said adjustment member to adjust the tension of said string held by said associated retention member, and each of said string tensioning mechanisms including a latching mechanism operative to hold its associated string retention member against rotation about said transverse axis in a first direction as a result of tension on said string held thereby, and operative to release said latching mechanism from holding said string retention member to permit free rotation of said string retention member in said first direction.

160. The stringed musical instrument of claim 159, wherein each of said adjustment members includes an engagement portion engageable with its respective string retention member at a location remote from said transverse axis, and wherein each of said adjustment members is supported by said bridge base for movement to adjust the position of said engagement portion relative to said bridge base to thereby adjust the rotational position of its respective string retention member.

161. The stringed musical instrument of claim 159, wherein each of said string retention members is supported on its respective adjustment member for rotation about said transverse axis.

162. The stringed musical instrument of claim 161, wherein said bridge base includes a rear flange; wherein each of said adjustment members includes an elongated shaft extending through said rear flange in a direction corresponding to the longitudinal extent of said string held by its respective string retention member, and a movement device for causing said shaft to move longitudinally relative to said rear flange of said bridge base to adjust the tension on said string held by its respective string retention member, each of said shafts including a first end and a second end; and wherein each of said string retention members is pivotally mounted to said first end of said shaft of its respective adjustment member.

163. The stringed musical instrument of claim 159, wherein each of said string retention members includes a cavity therein for receipt of a string anchor and a slot extending from said cavity through which said string extends from said string retention member.

164. The stringed musical instrument of claim 159, wherein each of said string retention members is adapted to rotate about said transverse axis so as to release the tension on said string held thereby when its respective latch mechanism is moved to said release position to permit removal of said string from its respective string retention member.

* * * * *

UNITED STATES PATENT AND TRADEMARK OFFICE

CERTIFICATE OF CORRECTION

PATENT NO. : 7,045,693 B2
APPLICATION NO. : 10/341219
DATED : May 16, 2006
INVENTOR(S) : Floyd D. Rose and John Thomas Riboloff It is certified that error appears in the above-identified patent and that said Letters Patent is hereby corrected as shown below:

Column 29, line 52, “that.the” should read --that the--
Column 34, line 40, “Each.of” should read --Each of--
Column 44, line 33, “comprises.a” should read --comprises a--
Column 56, line 15, “shaft” should read --shaft,--
Column 57, line 4, “each said” should read --each of said--
Column 60, line 21, “ret tion member” should read --retention member--

Signed and Sealed this

Fourteenth Day of November, 2006

JON W. DUDAS
*Director of the United States Patent and Trademark Office*